US010648294B2

(12) United States Patent
Miller et al.

(10) Patent No.: US 10,648,294 B2
(45) Date of Patent: May 12, 2020

(54) SUBSEA CONTROL POD DEPLOYMENT AND RETRIEVAL SYSTEMS AND METHODS

(71) Applicant: National Oilwell Varco, L.P., Houston, TX (US)

(72) Inventors: Travis James Miller, Cypress, TX (US); Frank Benjamin Springett, Spring, TX (US); Richard Watson Cowan, Houston, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 24 days.

(21) Appl. No.: 15/758,197

(22) PCT Filed: Sep. 16, 2016

(86) PCT No.: PCT/US2016/052103

§ 371 (c)(1),
(2) Date: Mar. 7, 2018

(87) PCT Pub. No.: WO2017/049067

PCT Pub. Date: Mar. 23, 2017

(65) Prior Publication Data

US 2018/0245417 A1 Aug. 30, 2018

Related U.S. Application Data

(60) Provisional application No. 62/219,468, filed on Sep. 16, 2015, provisional application No. 62/237,769, filed on Oct. 6, 2015.

(51) Int. Cl.
*E21B 41/04* (2006.01)
*E21B 19/00* (2006.01)
(Continued)

(52) U.S. Cl.
CPC ..... *E21B 41/04* (2013.01); *E21B 19/002* (2013.01); *E21B 19/008* (2013.01);
(Continued)

(58) Field of Classification Search
CPC ..... E21B 41/10
See application file for complete search history.

(56) References Cited

U.S. PATENT DOCUMENTS 4,075,862 A * 2/1978 Ames ..... E21B 43/013 166/343
6,161,618 A 12/2000 Parks et al.
(Continued)

FOREIGN PATENT DOCUMENTS

GB 2357537 B 11/2002
GB 2484192 A 4/2012

OTHER PUBLICATIONS

PCT/US2016/052103 International Search Report and Written Opinion dated Jan. 24, 2017 (15 p.).
(Continued)

*Primary Examiner* — James G Sayre
*Assistant Examiner* — Aaron L Lembo
(74) *Attorney, Agent, or Firm* — Conley Rose, P.C.

(57) ABSTRACT

A method for replacing a first control pod of a BOP stack includes (a) lowering a control pod exchange device subsea. In addition, the method includes (b) coupling the control pod exchange device to the BOP stack. Further, the method includes (c) transferring the first control pod from the BOP stack to the control pod exchange device after (b). Still further, the method includes (d) lifting the control pod exchange device to the surface after (c).

25 Claims, 64 Drawing Sheets

(51) Int. Cl.

| | |
|---|---|
| ***E21B 33/035*** | (2006.01) |
| ***E21B 33/038*** | (2006.01) |
| *E21B 33/064* | (2006.01) |
| *E21B 47/06* | (2012.01) |

(52) U.S. Cl.
CPC ..... *E21B 33/038* (2013.01); *E21B 33/0355* (2013.01); *E21B 33/064* (2013.01); *E21B 47/06* (2013.01); *E21B 47/065* (2013.01)

(56) References Cited

U.S. PATENT DOCUMENTS

| | | | | |
|---|---|---|---|---|
| 6,209,565 | B1 | 4/2001 | Hughes et al. | |
| 6,257,162 | B1 * | 7/2001 | Watt | B63G 8/001 114/244 |
| 6,422,315 | B1 * | 7/2002 | Dean | E21B 33/0355 166/339 |
| 6,860,525 | B2 | 3/2005 | Parks | |
| 6,938,695 | B2 * | 9/2005 | Williams | E21B 33/038 166/341 |
| 8,020,623 | B2 | 9/2011 | Parks et al. | |
| 8,376,049 | B2 * | 2/2013 | Bell | E21B 41/04 166/339 |
| 8,727,013 | B2 | 5/2014 | Buckley et al. | |
| 8,820,410 | B2 | 9/2014 | Parks et al. | |
| 2004/0154804 | A1 | 8/2004 | Williams | |
| 2005/0029476 | A1 * | 2/2005 | Biester | E21B 33/0355 251/58 |
| 2010/0155073 | A1 * | 6/2010 | Blank | E21B 34/16 166/338 |

OTHER PUBLICATIONS

Choate, T.G.A., et al., "EDIPS ROV Control Pod Replacement Tool," Offshore Technology Conference, May 1, 1989, pp. 35-44 (10 p.).

PCT/US2016/052111 International Search Report and Written Opinion dated Jan. 25, 2017 (14 p.).

* cited by examiner

SUBSEA CONTROL POD DEPLOYMENT AND RETRIEVAL SYSTEMS AND METHODS

CROSS-REFERENCE TO RELATED APPLICATIONS

This application is a 35 U.S.C. § 371 national stage application of PCT/US2016/052103 filed Sep. 16, 2016, and entitled "Subsea Control Pod Deployment and Retrieval Systems and Methods," which claims benefit of U.S. provisional patent application Ser. No. 62/237,769 filed Oct. 6, 2015, and entitled "Subsea Control Pod Deployment and Retrieval Systems and Methods," and also claims the benefit of U.S. provisional patent application Ser. No. 62/219,468 filed Sep. 16, 2015, and entitled "Subsea Control Pod Deployment and Retrieval Systems and Methods," each of which is hereby incorporated herein by reference in its entirety for all purposes.

STATEMENT REGARDING FEDERALLY SPONSORED RESEARCH OR DEVELOPMENT

Not applicable.

BACKGROUND

Embodiments described herein relate generally to systems and methods for deploying and retrieving subsea control pods. More particularly, embodiments described herein relate generally to systems and methods for deploying and retrieving subsea blowout preventer (BOP) and lower marine riser package (LMRP) control pods in deepwater environments exceeding 5,000 feet independent of subsea remotely operated vehicles (ROVs).

Subsea wells are typically made up by installing a primary conductor into the seabed and securing a wellhead secured to the upper end of the primary conductor at the sea floor. In addition, a subsea stack, also referred to as a blowout preventer (BOP) stack, is installed on the wellhead. The stack usually includes a blowout preventer mounted to the upper end of the wellhead and a lower marine riser package (LMRP) mounted to the upper end of the BOP. The primary conductor, wellhead, BOP, and LMRP are typically installed in a vertical arrangement one-above-the-other. The lower end of a riser extending subsea from a surface vessel or rig is coupled to a flex joint at the top of the LMRP. For drilling operations, a drill string is suspended from the surface vessel or rig through the riser, LMRP, BOP, wellhead, and primary conductor to drill a borehole. During drilling, casing strings that line the borehole are successively installed and cemented in place to ensure borehole integrity.

A subsea control system is used to operate and monitor the BOP stack as well as monitor wellbore conditions. For example, the control system can actuate valves (e.g., safety valves, flow control choke valves, shut-off valves, diverter valves, etc.), actuate chemical injection systems, monitor operation of the BOP and LMRP, monitor downhole pressure, temperature and flow rates, etc. The subsea control system typically comprises control modules or pods removably mounted to the BOP and LMRP. Redundant control pods are typically provided on each BOP and LMRP to enable operation and monitoring functions in the event one of the redundant control pods fails. Control pods mounted to the LMRP are often referred to as "primary" pods, whereas control pods mounted to the BOP are often referred to as "secondary" or "backup" pods. Electrical power, hydraulic power, and command signals are provided to the control pods from the surface vessel or rig. The control pods utilize the electrical and hydraulic power to operate and monitor the BOP stack as well as monitor the wellbore conditions in accordance with the command signals.

In the event of a control pod component failure, it may be desirable to retrieve the control pod to the surface to be repaired or replaced, and then deploy the repaired control pod or a replacement control pod subsea to effectively replace the faulty control pod. Traditionally, there are limited options for doing so, and further, some of the options are only applicable in shallow water environments or require the retrieval of the entire LMRP.

BRIEF SUMMARY OF THE DISCLOSURE

Embodiments methods for replacing a first control pod of a BOP stack are disclosed herein. In one embodiment, a method comprises (a) lowering a control pod exchange device subsea. In addition, the method comprises (b) coupling the control pod exchange device to the BOP stack. Further, the method comprises (c) transferring the first control pod from the BOP stack to the control pod exchange device after (b). Still further, the method comprises (d) lifting the control pod exchange device to the surface after (c).

Embodiments of systems for replacing a first control pod coupled to a subsea BOP stack are disclosed herein. In one embodiment, a system comprises a lifting device coupled to a surface vessel. In addition, the system comprises a control pod exchange device suspended from the lifting device and configured to be raised and lowered subsea by the lifting device. The control pod exchange device comprises a housing configured to receive the first control pod. Still further, the system comprises a BOP stack connection assembly coupled to the control pod exchange device. The BOP stack connection assembly is configured to couple the control pod exchange device to the BOP stack.

Embodiments of methods for replacing a first control pod of a BOP stack are disclosed herein. In one embodiment, a method comprises (a) loading a second control pod onto a control pod exchange device. In addition, the method comprises (b) lowering the control pod exchange device subsea after (a) with a lifting device mounted to a surface vessel. The control pod exchange device is suspended from the lifting device with a first rope or a pipe string. Further, the method comprises (c) coupling a BOP stack connector to the BOP stack after (b). A second rope has a first end coupled to the control pod exchange device and a second end coupled to the BOP stack connector. Still further, the method comprises (d) lowering the first rope or the pipe string to lower the control pod exchange device relative to the first rope or the pipe string to the BOP stack connector after (c).

Embodiments of methods for replacing a first control pod of a BOP stack are disclosed herein. In one embodiment, a method comprises (a) lowering a rope from a lifting device mounted to a surface vessel. In addition, the method comprises (b) coupling a lower end of the rope to the first control pod of the BOP stack after (a). Further, the method comprises (c) removing the first control pod from the BOP stack after (b). Still further, the method comprises (d) lifting the first control pod to the surface with the rope and the lifting device.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
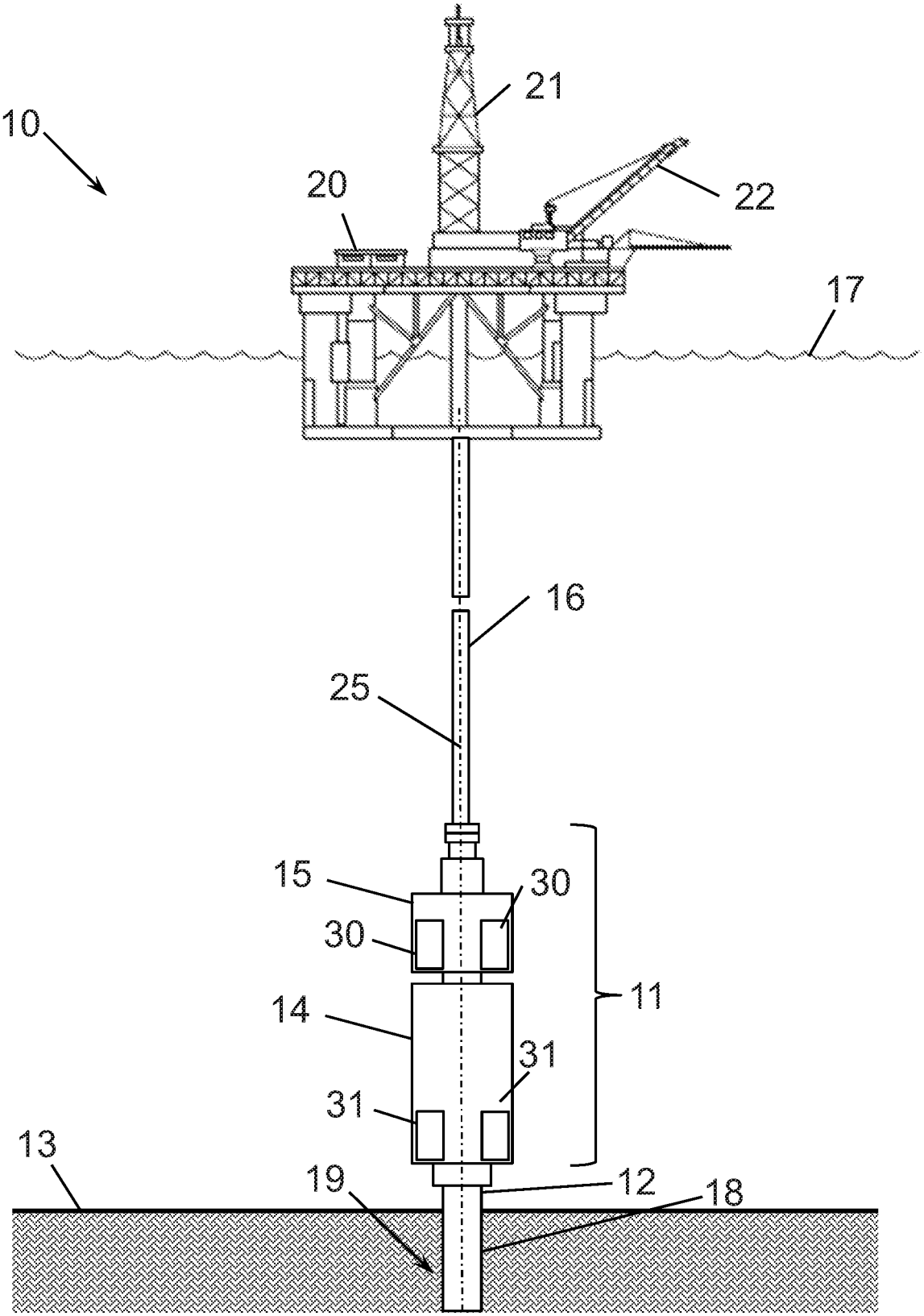
FIG. 1 is a schematic view of an embodiment of an offshore system for drilling and/or production.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

As previously described, a failing subsea control pod can be retrieved to the surface and replaced with a properly functioning control pod. In shallow water offshore operations (i.e., at water depths up to about 6,000 ft.), guidelines or wires extending vertically from the surface vessel or rig to the subsea template or wellhead are used to guide and land the BOP and LMRP onto the wellhead for the initial assembly of the BOP stack. The guidelines generally remain in place after building up the BOP stack, and thus, are generally considered to be permanently installed. Such guidelines can be used to guide and run control pods to and from the BOP stack. However, this technique is typically limited to shallow water operations (guidelines are usually only installed and available for use in shallow water operations), and further, this technique usually cannot be used to retrieve and deploy control pods mounted to the lower portion of the BOP stack (e.g., control pods mounted to the BOP) because LMRP at the upper end of the BOP stack does not provide sufficient clearance around the guidewires to enable the direct vertical movement of control pods along the guidelines to and from the portions of the BOP stack below the LMRP. Thus, control pods mounted to the lower portion of the BOP stack usually cannot utilize guidelines for retrieval and deployment because the guidelines extend vertically, whereas the control pods must be moved laterally away from the BOP stack before being moved vertically upward to the surface. In deep water offshore operations (i.e., at water depths greater than 6,000 ft.), guidelines are typically not available. In some cases, subsea remotely operated vehicles (ROVs) may be used to facilitate the retrieval, deployment, and installation of subsea control pods. However, operation of subsea ROVs can be negatively impacted by a variety of factors including, without limitation, subsea currents, limitations on visibility, payload limits, thrust capacity and accuracy, and ROV pilot skill and experience. For example, modern control pods are often substantially heavier than shallow water guideline retrievable control pods (e.g., 40,000 lbs. versus 2,000 lbs). Consequently, retrieving, deploying, and installing control pods via subsea ROVs may not be desirable or a viable option. Thus, embodiments of systems and devices described herein enable the retrieval, deployment, and installation of subsea control pods on any part of the BOP stack (e.g., the BOP, LMRP, upper part of the BOP stack, lower part of the BOP stack, etc.) without the use of conventional guidelines and with limited or no reliance on subsea ROVs. Although embodiments described herein reduce and/or eliminate reliance on subsea ROVs to physically manipulate and move the control pods, it should be appreciated that one or more subsea ROVs can be used to visually monitor and verify the subsea retrieval, deployment, and installation of the control pods. Moreover, although this disclosure generally describes the retrieval and replacement of faulty subsea control pods (i.e., with a different control pod), it should be appreciated embodiments described herein can also be used to retrieve a faulty control pod to the surface, rapidly repair of the faulty control pod at the surface, and then deploy the repaired control pod subsea for subsequent installation on the BOP stack.

Referring now to FIG. 1, an embodiment of an offshore system 10 for drilling and/or producing a subsea well is shown. In this embodiment, system 10 includes a subsea blowout preventer (BOP) stack 11 mounted to a wellhead 12 at the sea floor 13. Stack 11 includes a blowout preventer (BOP) 14 attached to the upper end of wellhead 12 and a lower marine riser package (LMRP) 15 connected to the upper end of BOP 14. A marine riser 16 extends from a surface vessel 20 at the sea surface 17 to LMRP 15. In this embodiment, vessel 20 is a floating platform, and thus, may also be referred to as platform 20. In other embodiments, the vessel (e.g., vessel 20) can be a drill ship or any other vessel disposed at the sea surface for conducting offshore drilling and/or production operations. Platform 20 includes a drilling derrick 21 and a lifting device 22, which in this embodiment is a full depth crane.

Riser 16 is a large-diameter pipe that connects LMRP 15 to floating platform 20. During drilling operations, riser 16 takes mud returns to platform 20. A primary conductor 18 extends from wellhead 12 into the subterranean wellbore 19.

BOP 14, LMRP 15, wellhead 12, and conductor 18 are arranged such that each shares a common central axis 25. In other words, BOP 14, LMRP 15, wellhead 12, and conductor 18 are coaxially aligned. In addition, BOP 14, LMRP 15, wellhead 12, and conductor 18 are vertically stacked one-above-the-other, and the position of platform 20 is controlled such that axis 25 is vertically or substantially vertically oriented. In general, platform 20 can be maintained in position over stack 11 with mooring lines and/or a dynamic positioning (DP) system. However, it should be appreciated that platform 20 moves to a limited degree during normal drilling and/or production operations in response to external loads such as wind, waves, currents, etc. Such movements of platform 20 result in the upper end of riser 16, which is secured to platform 20, moving relative to the lower end of riser 16, which is secured to LMRP 15. Wellhead 12, BOP 14 and LMRP 15 are generally fixed in position at the sea floor 13, and thus, riser 16 may flex and pivot about its lower and upper ends as platform 20 moves at the surface 17. Consequently, although riser 16 is shown as extending vertically from platform 20 to LMRP 15 in FIG. 1, riser 16 may deviate somewhat from vertical as platform 20 moves at the surface 17.

Referring still to FIG. 1, a pair of control pods 30 are releasably coupled to LMRP 15 and a pair of control pods 31 are releasably coupled to BOP 14. Pods 30 are positioned above pods 31 (pods 30 are not necessarily directly over pods 31), and pods 30 are coupled to LMRP 15, whereas pods 31 are coupled to BOP 14. It should be appreciated that pods 30 and pods 31 can control functions in the LMRP 15 and/or BOP 14. For purposes of clarity and further explanation, pods 30 may also be referred to as "primary" pods 30, and pods 31 may also be referred to as "secondary" pods 31. In this embodiment, primary pods 30 are redundant meaning each primary pod 30 can perform all of the functions as the other primary pod 30, and secondary pods 31 are backups to the primary pods 30, each pod 30, 31 being able to control select functions in LMRP 15 and BOP 14. In general, control pods 30, 31 can perform any of the functions performed by subsea control pods known in the art. For example, each primary control pod 30 can operate and monitor LMRP 15 and BOP 14, and monitor conditions within LMRP 15 and BOP 14 (e.g., temperature, pressure, flow rates, etc.), and each secondary control pod 31 can operate and monitor LMRP 15 and BOP 14, and monitor conditions within LMRP 15 and BOP 14 (e.g., temperature, pressure, flow rates, etc.). Electrical power, hydraulic power, and command signals are provided to primary control pods 30 from platform 20. Secondary control pods 31 are provided power BOP stack 11 (e.g., stored power). In addition, the interface between each control pod 30, 31 BOP stack 11 includes hydraulic and/or electrical couplings that enable pods 30, 31 to control hydraulic and/or electrical functions of LMRP 15 and BOP 14.

As will be described in more detail below, embodiments described and illustrated herein are directed to systems and methods for retrieving a failed or faulty control pod (e.g., control pod 30 or control pod 31), and replacing it with a replacement control pod (e.g., control pod 30 or control pod 31). Although embodiments described herein specifically show and described replacing a control pod 30 mounted to LMRP 15, it is to be understood that embodiments described herein can also be used in the manners described to replace a control pod 31 mounted to BOP 14.

Referring now to FIGS. 2A-2I, an embodiment of a system 100 for retrieving a failed or faulty control pod 30, and replacing it with a replacement control pod 30 is schematically shown. More specifically, in FIGS. 2A-2D, system 100 is shown removing the failed or faulty control pod 30 from BOP stack 11; in FIGS. 2D and 2E, system 100 is shown retrieving the failed or faulty control pod 30 to vessel 20 at the surface 17; in FIGS. 2F-2H, system 100 is shown delivering the replacement control pod 30 subsea to BOP stack 11; and in FIGS. 2H and 2I, system 100 is shown installing replacement control pod 30 on BOP stack 11.

For purposes of clarity and further explanation (e.g., to aid in distinguishing failed or faulty pod 30 from replacement pod 30), in embodiments described herein, the failed or faulty pod 30 is labeled with reference numeral 30' and the replacement pod 30 is labeled with reference numeral 30". In general, the replacement pod 30" can be a new pod 30 or a repaired pod 30.

In this embodiment, system 100 includes lifting device 22 mounted to surface vessel 20 and rigging 50 coupled to lifting device 22. In this embodiment, rigging 50 is rope that extends from lifting device 22 and can be paid in or paid out from lifting device 22 to raise or lower loads. As used herein, the term "rope" may be used to refer to any flexible type of rope including, without limitation, wire rope, cable, synthetic rope, or the like. In this embodiment, as well as other embodiments described herein, one or more subsea remotely operated vehicles 40 are used, to varying degrees, to assist in the retrieval of pod 30' and deployment of pod 30". Each ROV 40 includes an arm 41 having a claw 42, a subsea camera 43 for viewing the subsea operations (e.g., the relative positions of LMRP 15, BOP 14, pods 30, 31, the positions and movement of arm 41 and claw 42, etc.), and an umbilical 44. Streaming video and/or images from cameras 43 are communicated to the surface or other remote location via umbilical 44 for viewing on a continuous live basis. Arms 41 and claws 42 are controlled via commands sent from the surface through umbilical 44.

Referring again to FIGS. 2A-2I, an embodiment of a method for replacing control pod 30' with control pod 30" using system 100 will be described. In general, the method includes removing control pod 30' from BOP stack 11 as shown in FIGS. 2A-2E; lifting control pod 30' to vessel 20 at the surface 17 as shown in FIGS. 2E and 2F; deploying control pod 30" from vessel 20 subsea to BOP stack 11 as shown in FIGS. 2G and 2H; and installing control pod 30" on BOP stack as shown in FIGS. 2H and 2I.

Figure 2A:
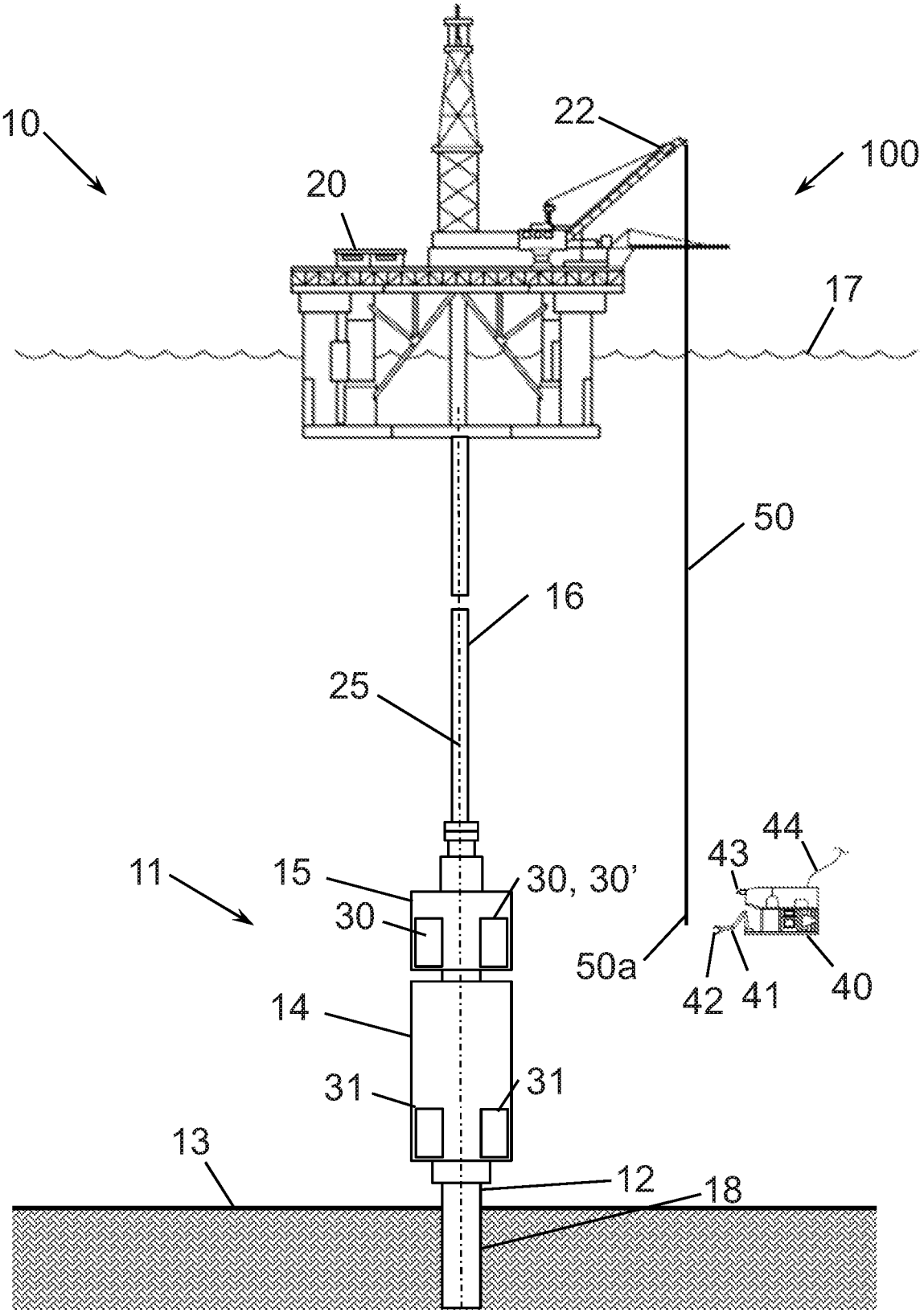
FIGS. 2A-2I are schematic views of an embodiment of a system and associated method in accordance with the principles described herein for replacing a control pod of the offshore system of FIG. 1.
Figure 2B:
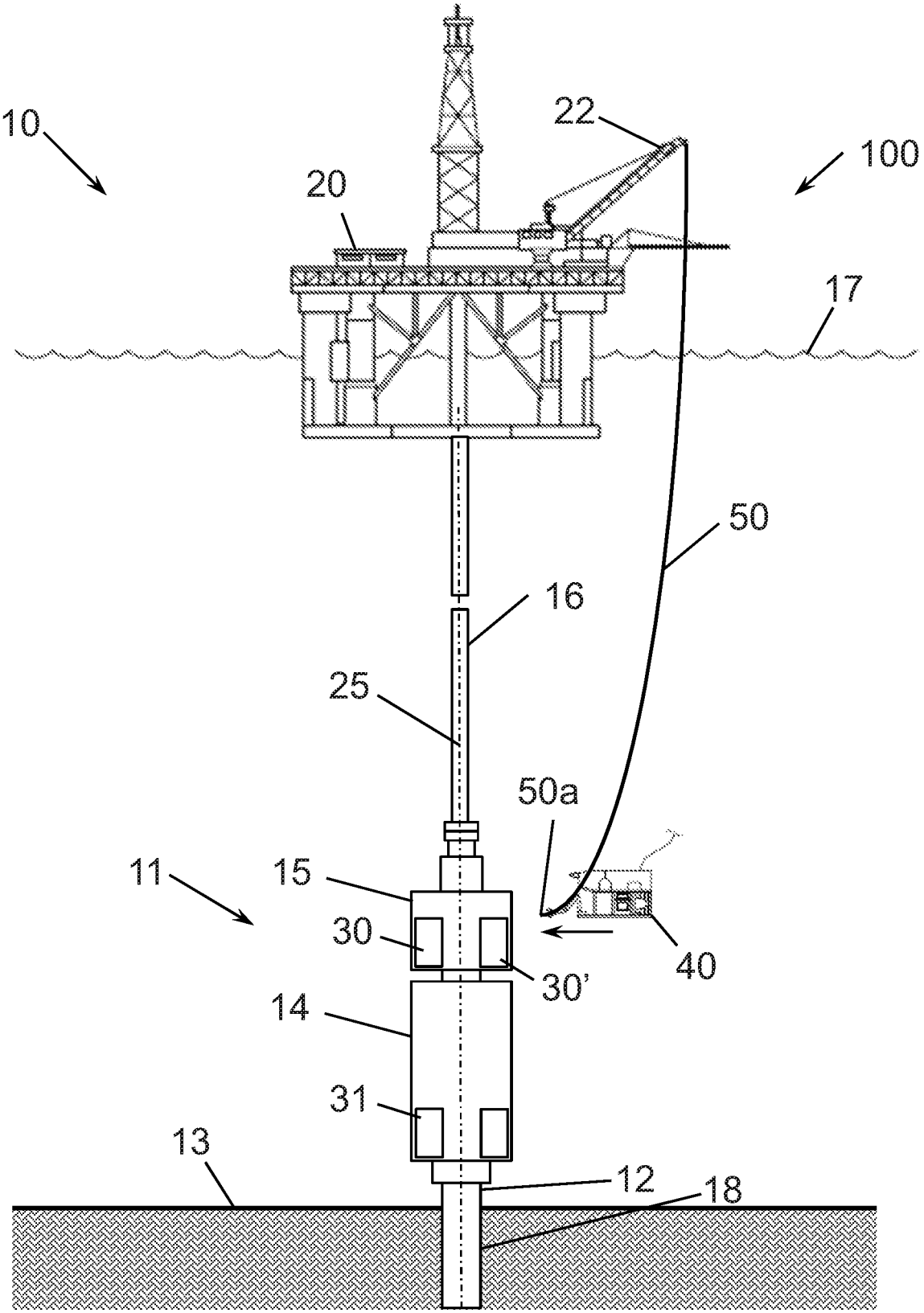
Figure 2C:
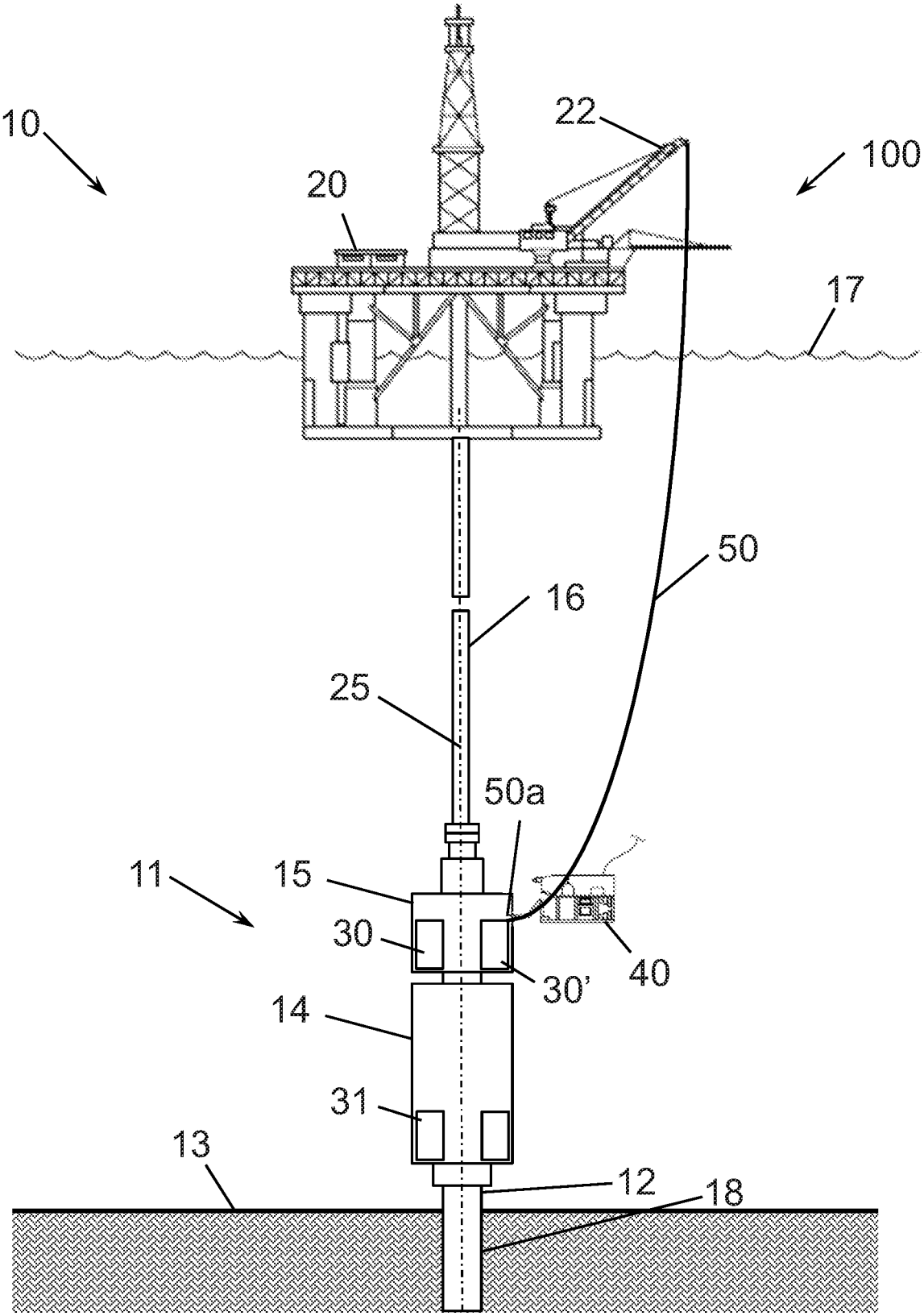
Figure 2D:
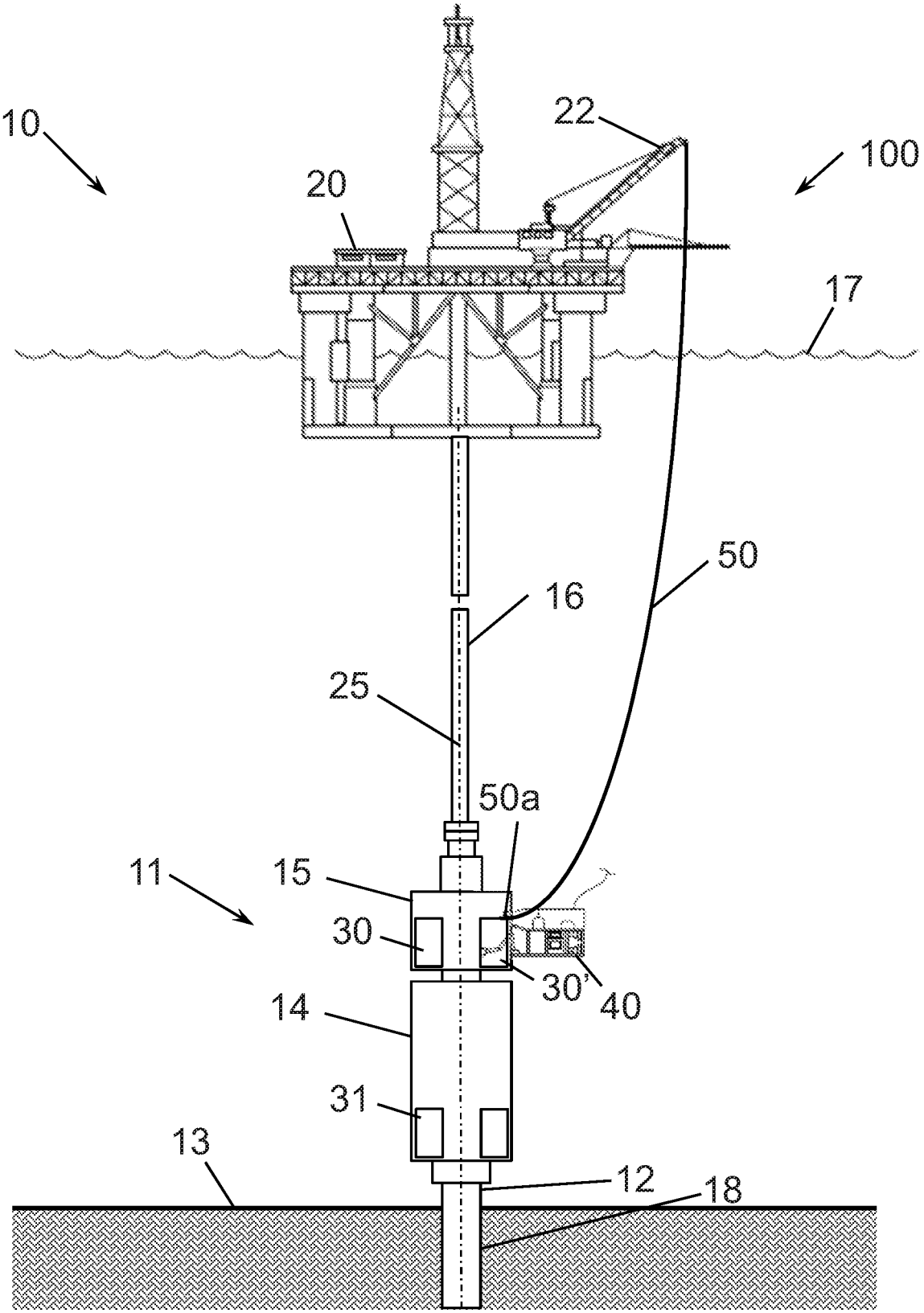
Figure 2E:
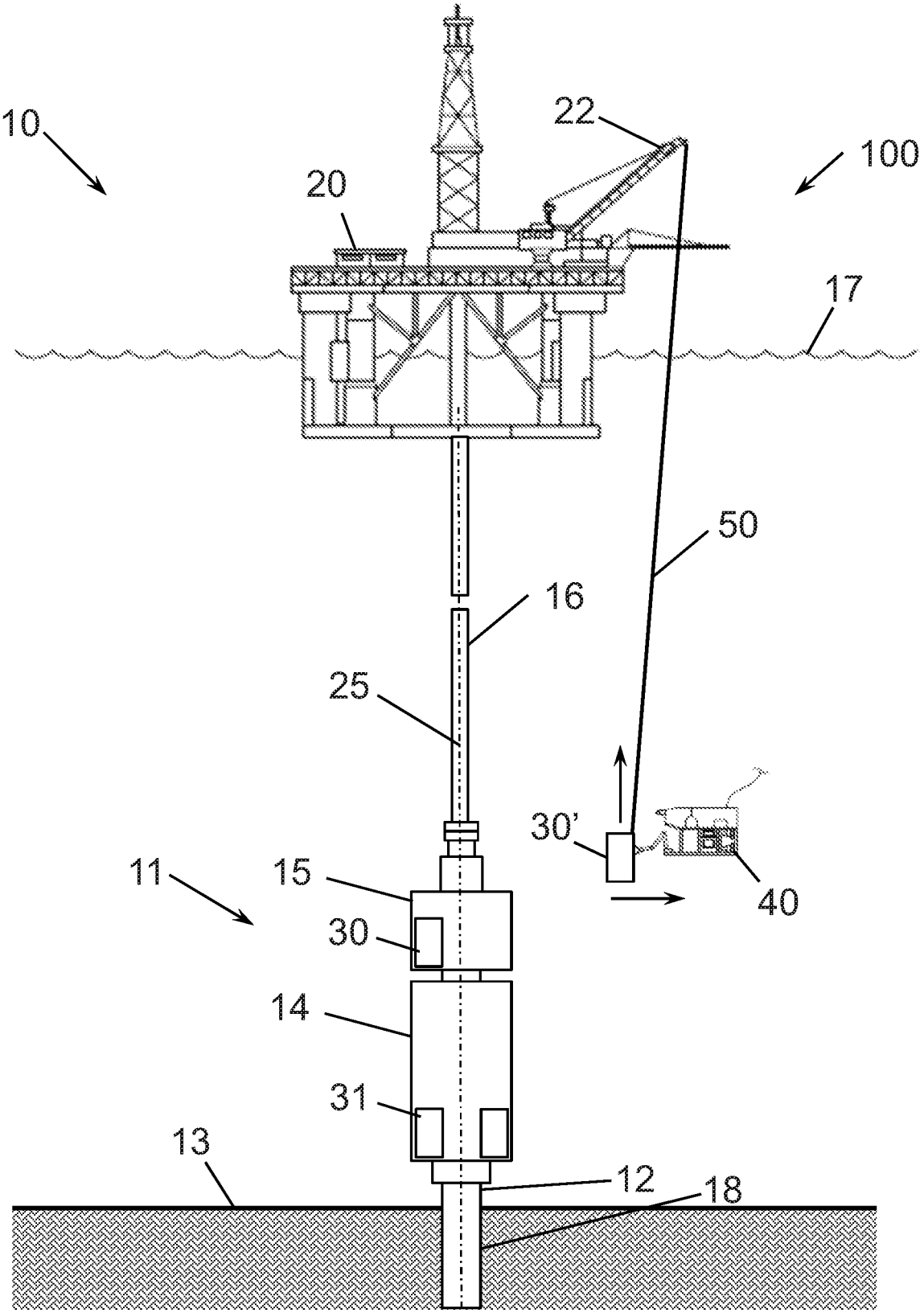

Referring first to FIGS. 2A-2B, rope 50 is coupled to the failed or faulty control pod 30' In particular, rope 50 is paid out from lifting device 22 until the free, subsea end 50*a* of rope 50 is at a depth equal to or greater than the depth of control pod 30' as shown in FIG. 2A. Next, with sufficient slack in rope 50, ROV 40 grabs end 50*a* with its claw 42, moves end 50*a* to control pod 30', and secures end 50*a* to control pod 30' as shown in FIGS. 2B and 2C. If necessary, ROV 40 can then be used to decouple any connections between pod 30' and BOP stack 11 (e.g., mechanical and/or hydraulic connections between pod 30' to BOP stack 11) as shown in FIG. 2D. Moving now to FIGS. 2E and 2F, ROV 40 is employed to pull pod 30' from BOP stack 11 as rope 50 is paid-in to apply tension to rope 50, thereby lifting pod 30' to vessel 20.

Figure 2F:
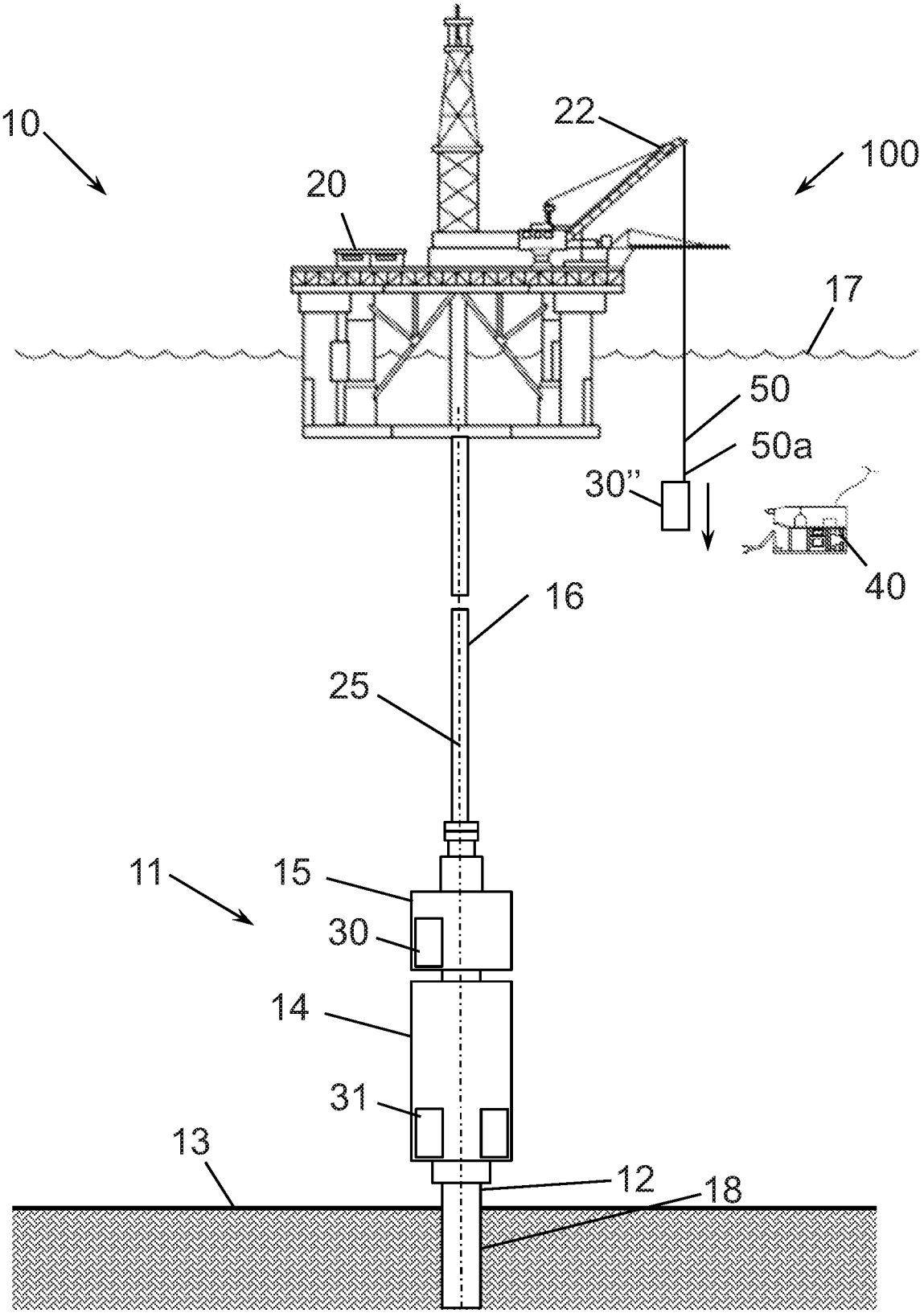
Figure 2G:
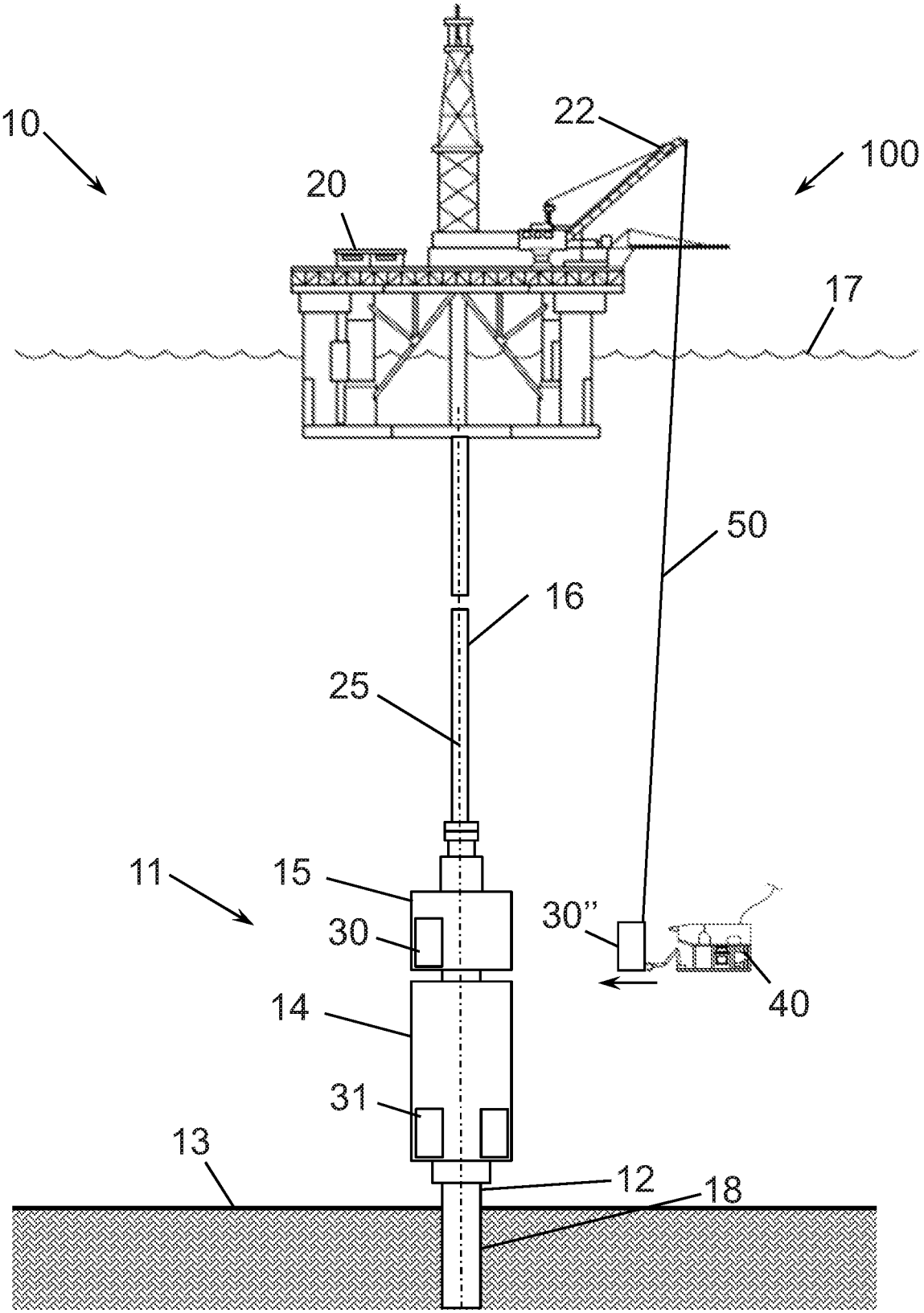
Figure 2H:
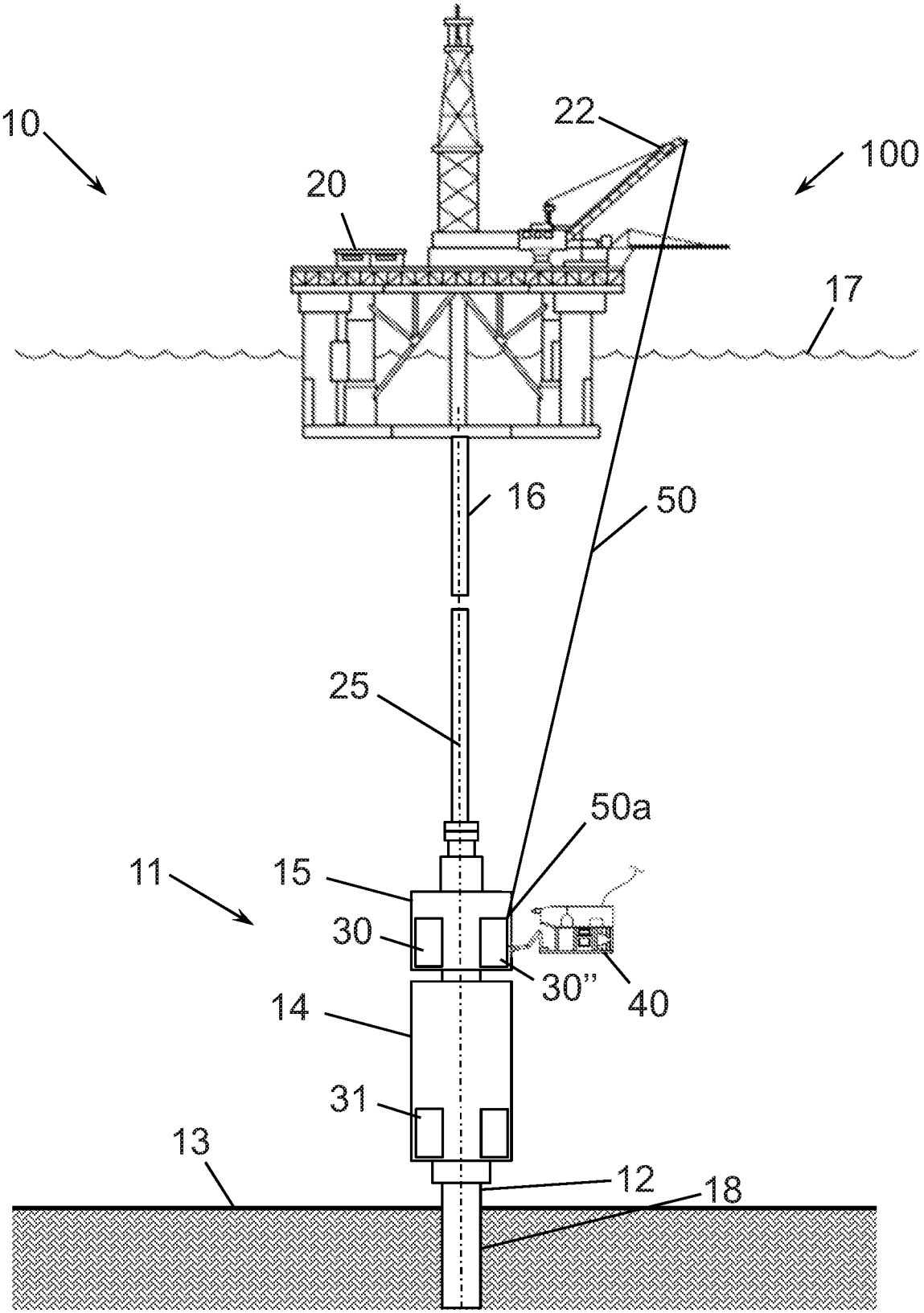
Figure 2I:
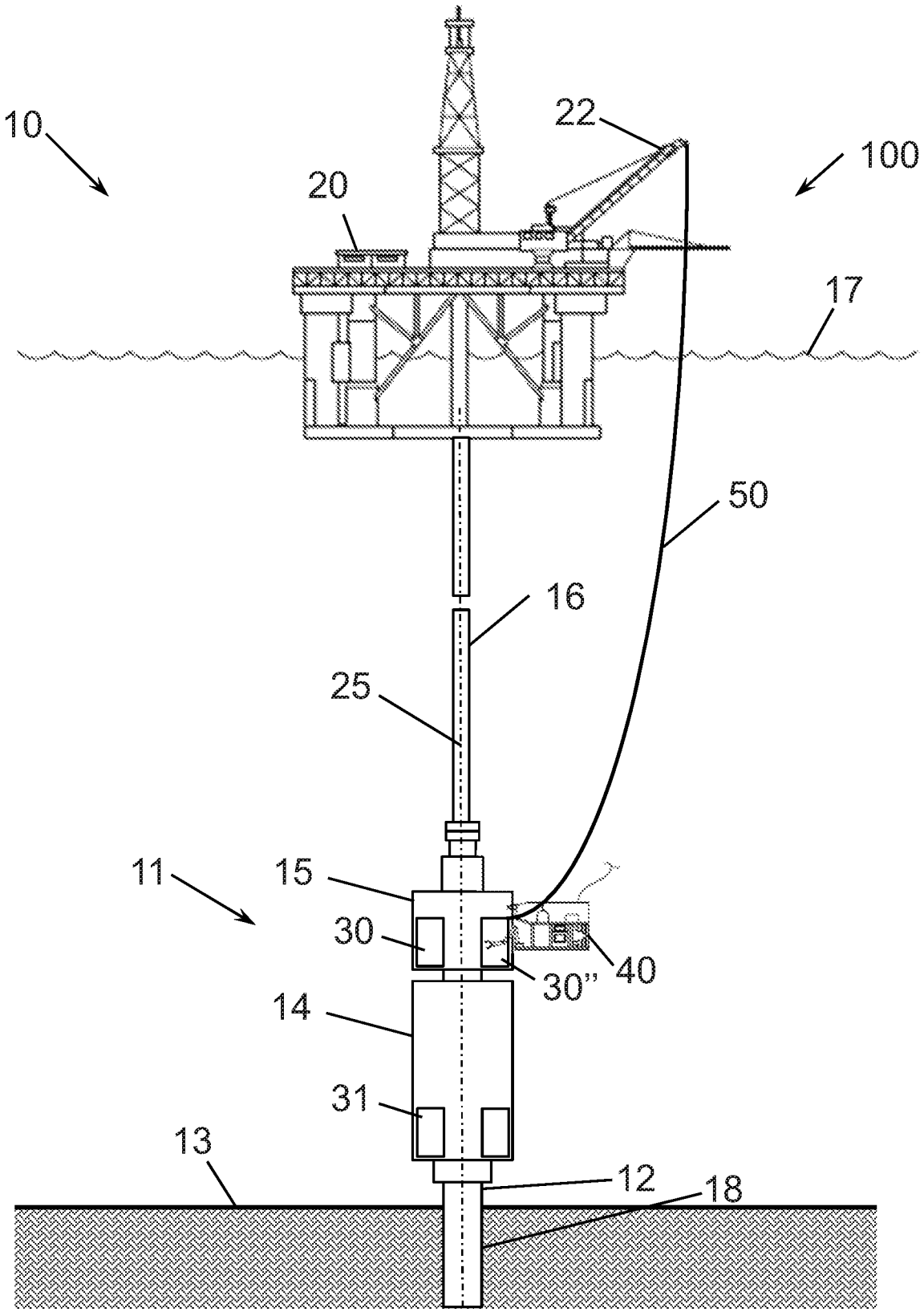

Referring now to FIGS. 2F-2I, replacement pod 30" is deployed subsea from vessel 20 and attached to BOP stack 11 to replace pod 30' by effectively performing the steps of the retrieval process shown in FIGS. 2A-2E in reverse order. Namely, as shown in FIG. 2F, the free end 50*a* of rope 50 is attached to replacement pod 30" on vessel 20, and lifting device 22 is used to lower replacement pod 30" subsea. Using lifting device 22, replacement pod 30" is lowered to a depth that is equal to or slightly greater than the depth at which pod 30" is to be installed on BOP stack 11 as shown in FIG. 2G. Moving now to FIGS. 2H and 2I, ROV 40 pushes pod 30" into place on BOP stack 11. If necessary, ROV 40 can then be used to make up any connections between pod 30' and BOP stack 11 (e.g., mechanical and/or hydraulic connections between pod 30' to BOP stack 11). Once replacement pod 30" is properly installed on BOP stack 11, ROV 40 disconnects end 50*a* of wire from pod 30", and lifting devices pays-in rope 50 to lift end 50*a* back to the surface 17.

In the manner described and shown in FIGS. 2A-2I, system 100 can be used to retrieve control pod 30' and replace it with control pod 30". During retrieval of pod 30' to the surface 17, ROV 40 is used to connect rope 50 to pod 30', disconnect pod 30' from BOP stack 11, and move pod 30' from BOP stack 11. During deployment of pod 30" from the surface 17, ROV 40 is used to move pod 30" onto BOP stack 11, connect pod 30' to BOP stack 11, and disconnect rope 50 from pod 30". It should be appreciated that rope 50 is different from a conventional guideline as rope 50 is not permanently installed and used to assemble the BOP stack (e.g., BOP stack 11). Rather, rope 50 can be deployed for use with system 100 on an as needed basis after BOP stack 11 is installed and mounted to wellhead 12. In addition, ROV 40 can be used to guide and/or monitor pod 30" as it is lifted, lowered, or otherwise moved subsea. However, it should be appreciated that during both the retrieval of pod 30' and the deployment of pod 30", the weight of pod 30' and pod 30", respectively, is supported by rope 50, thereby reducing the payload lifting requirements for ROV 40.

A rough alignment system such as a stabbing spear and mating guide or funnel can be included in system 100 to assist in guiding pod 30' as it is removed from BOP stack 11 and assist in guiding pod 30" as it is advanced to BOP stack 11. For example, a stabbing spear extending from BOP stack 11 and a funnel slidingly disposed about the spear and attached to pod 30' can be used to guide pod 30' as it is pulled from BOP stack 11, and a funnel attached to pod 30" can be used to slidingly receive the spear as pod 30" is moved to BOP stack 11. It should be appreciated that one benefit of such a rough alignment system is a reduction in the demands placed on the ROV 40 in terms of the precision needed in positioning and aligning pod 30" with BOP stack 11.

Figure 3A:
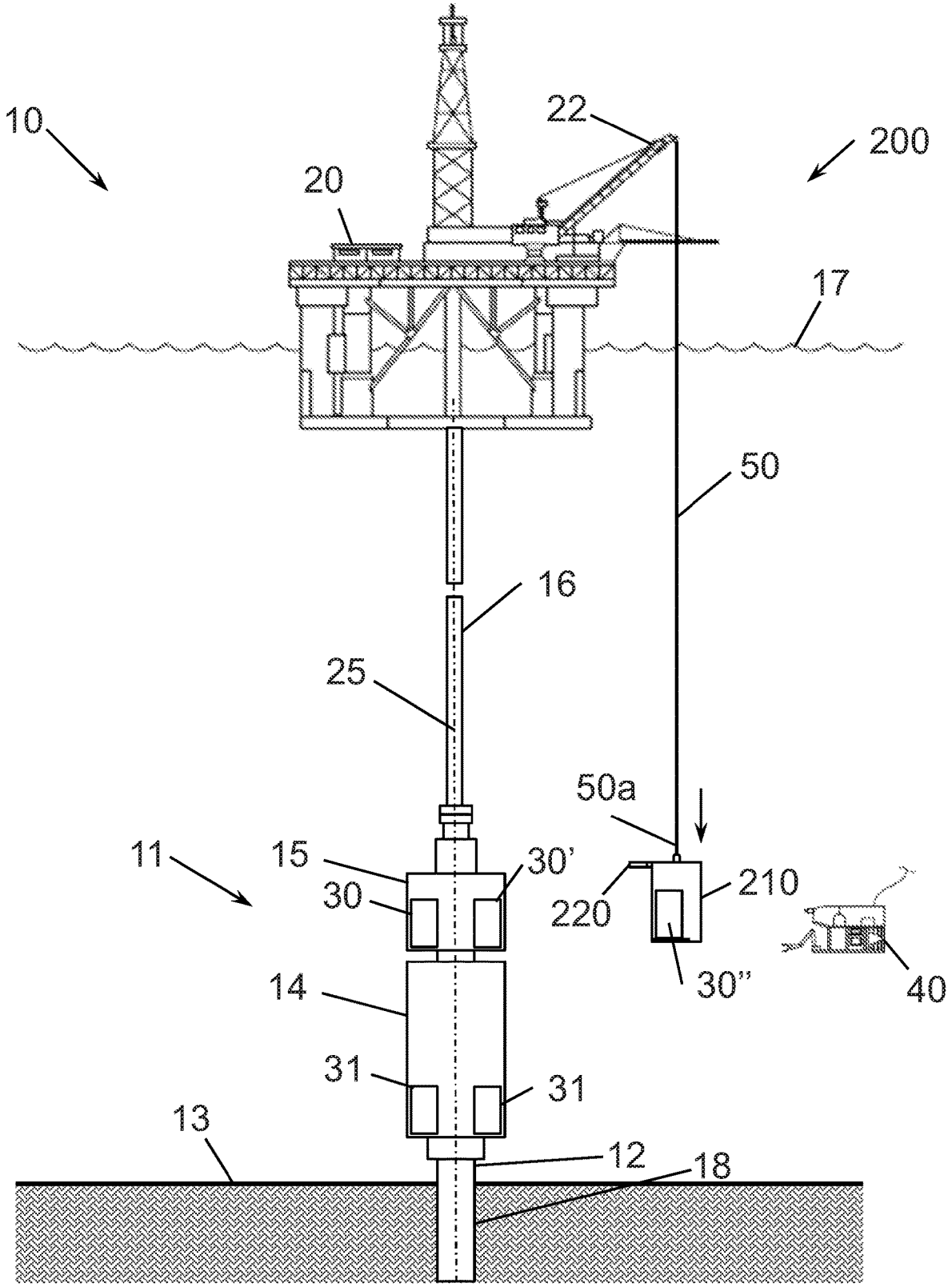
FIGS. 3A-3N are schematic views of an embodiment of a system and associated method in accordance with the principles described herein for replacing a control pod of the offshore system of FIG. 1.
Figure 3B:
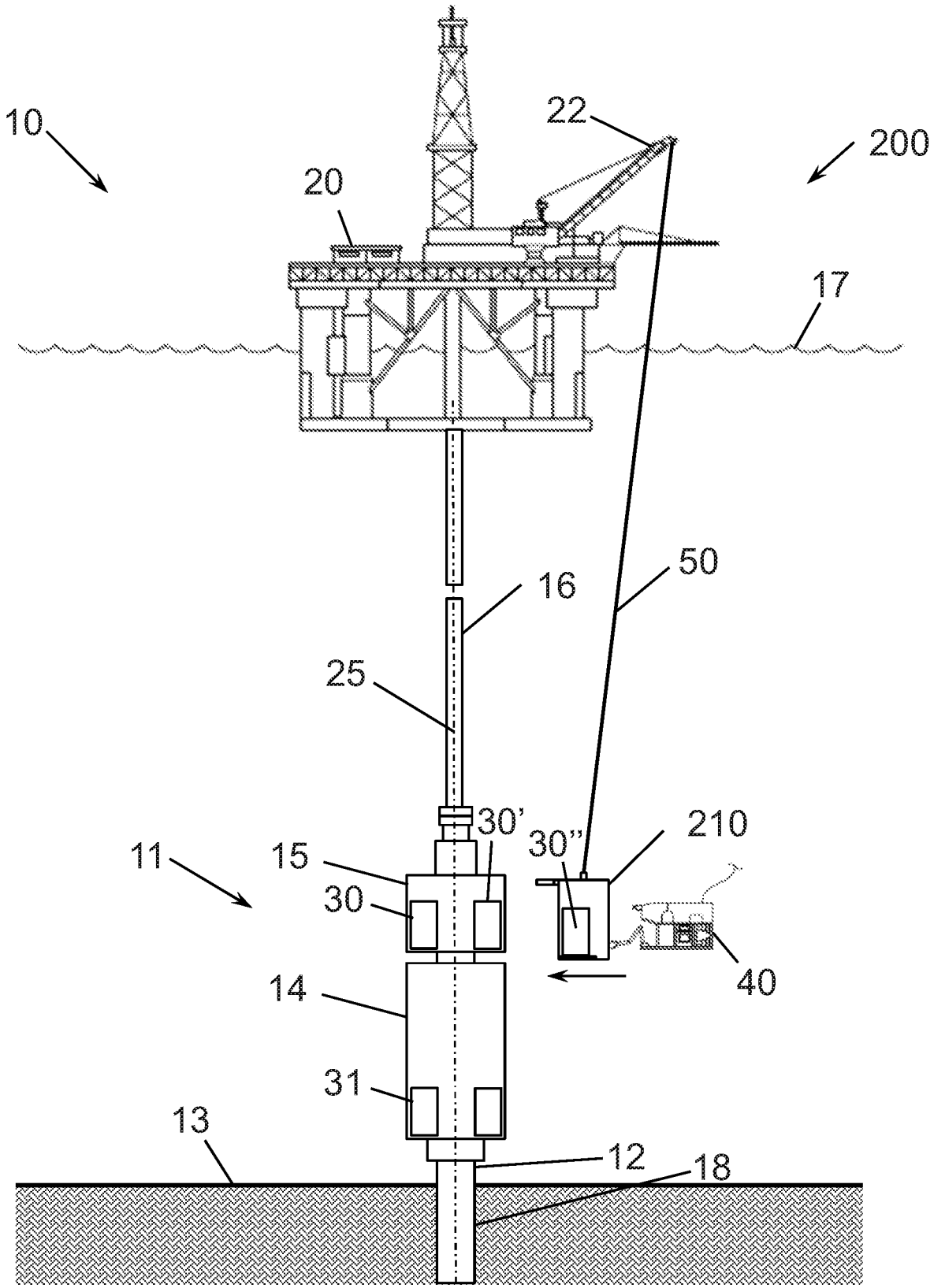
Figure 3C:
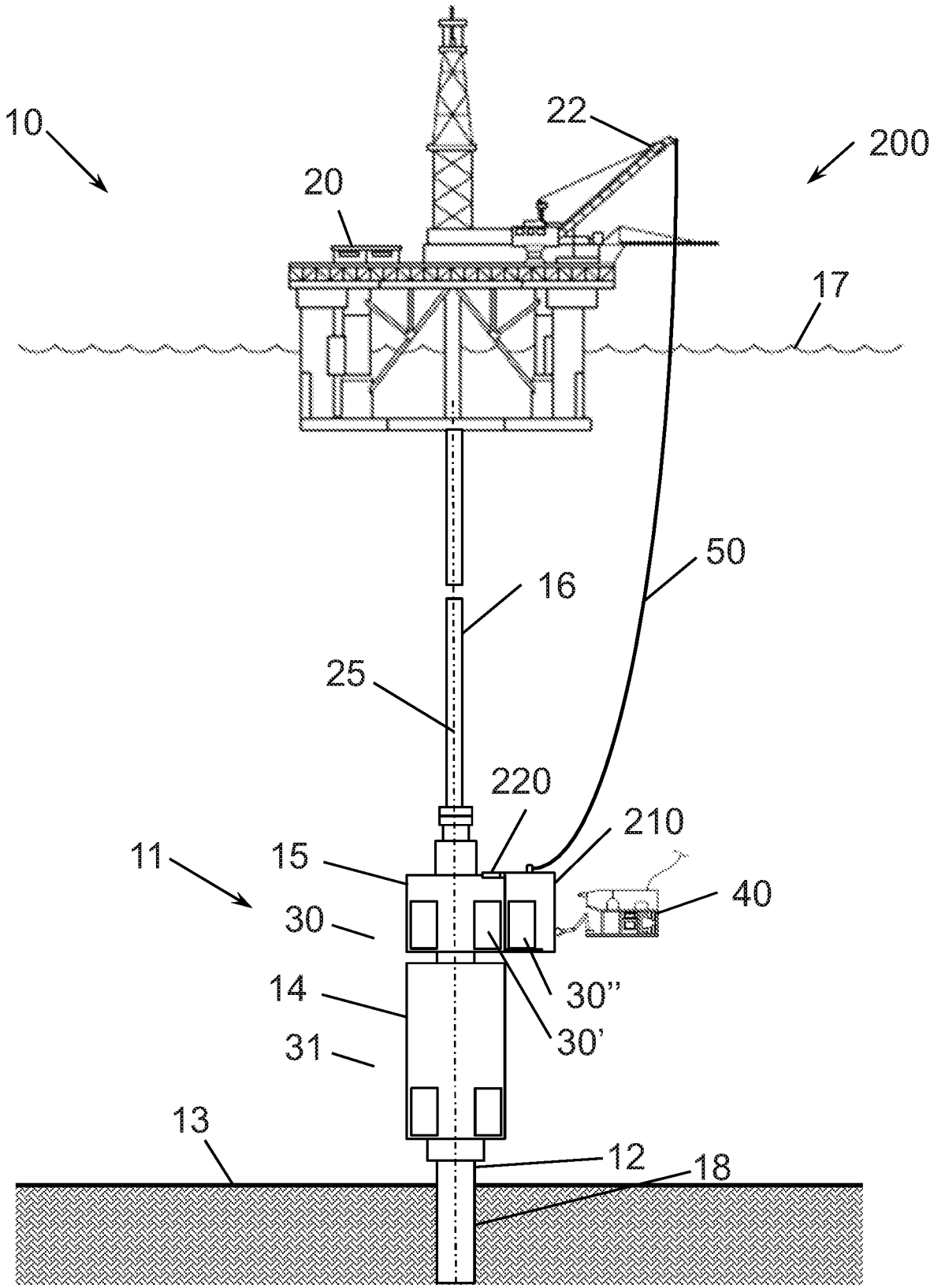
Figure 3D:
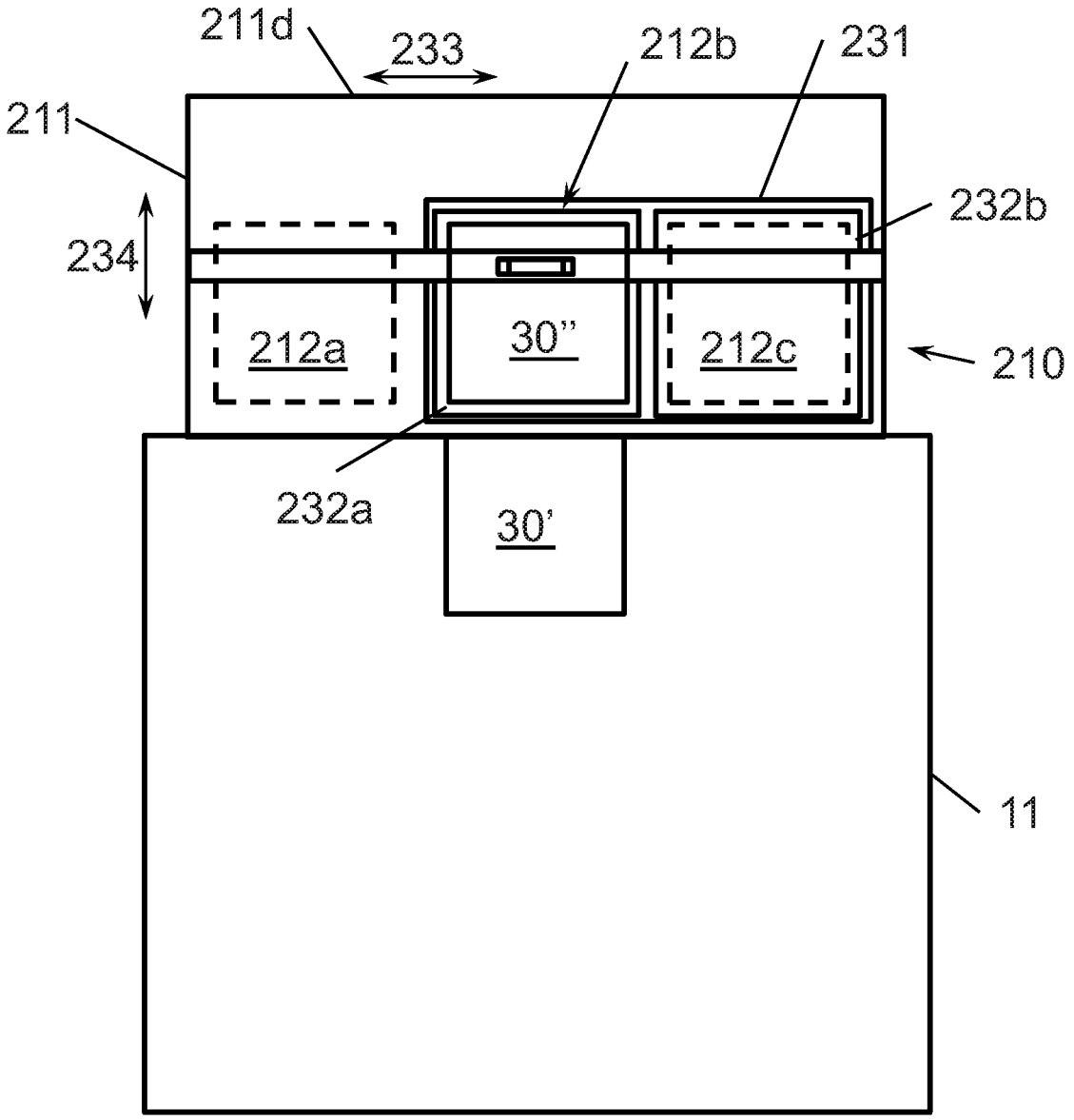
Figure 3E:
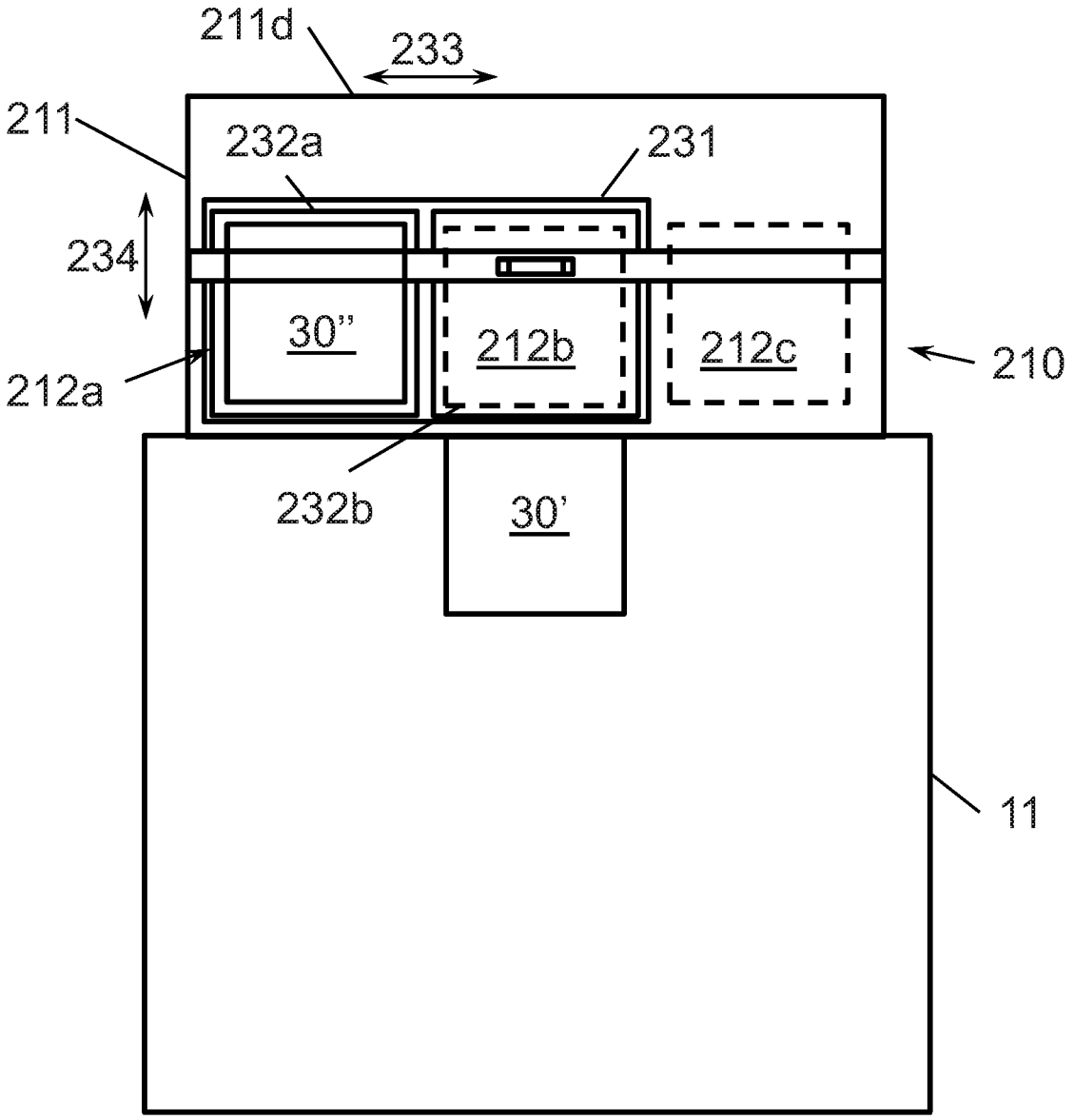
Figure 3F:
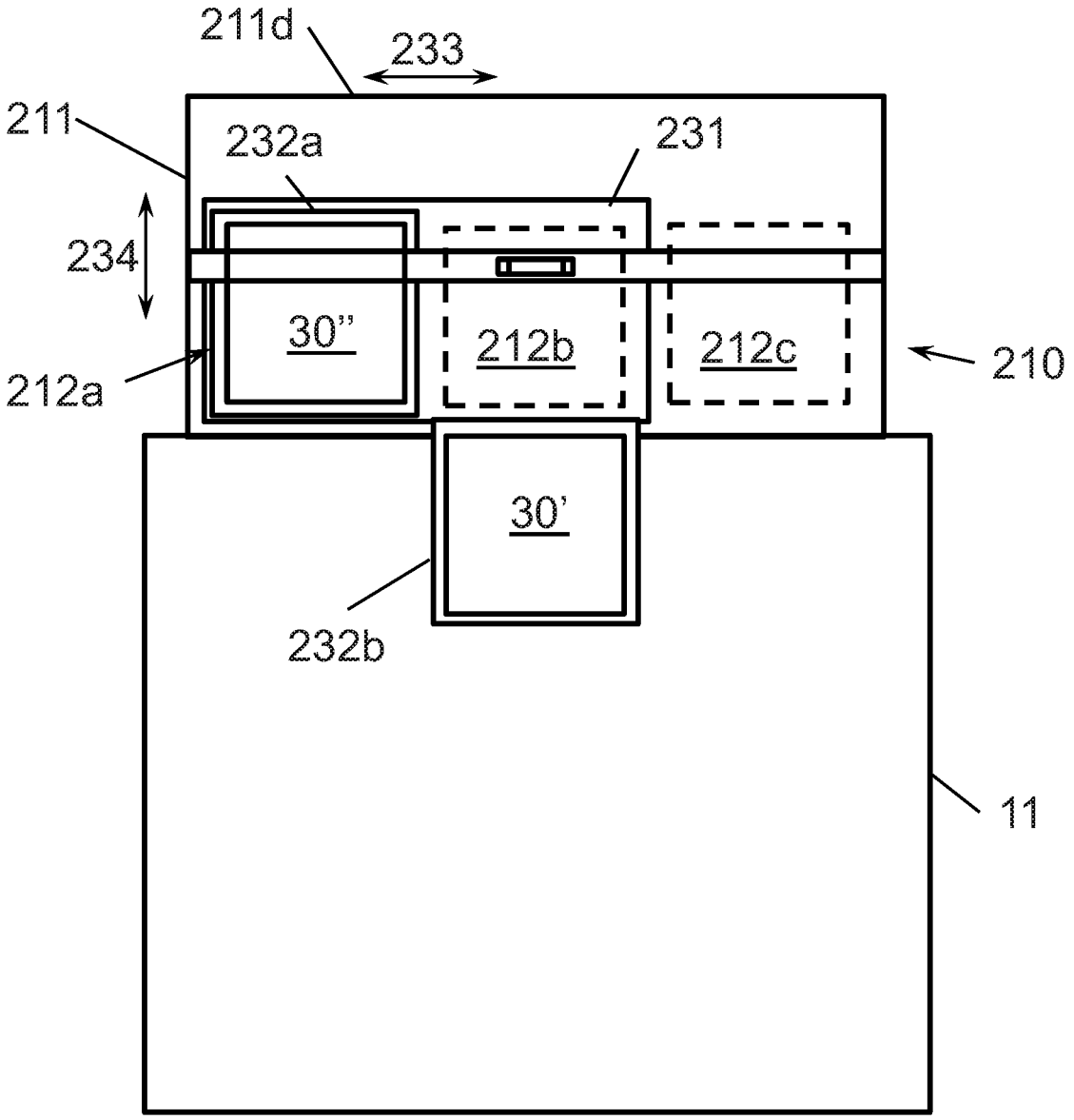
Figure 3G:
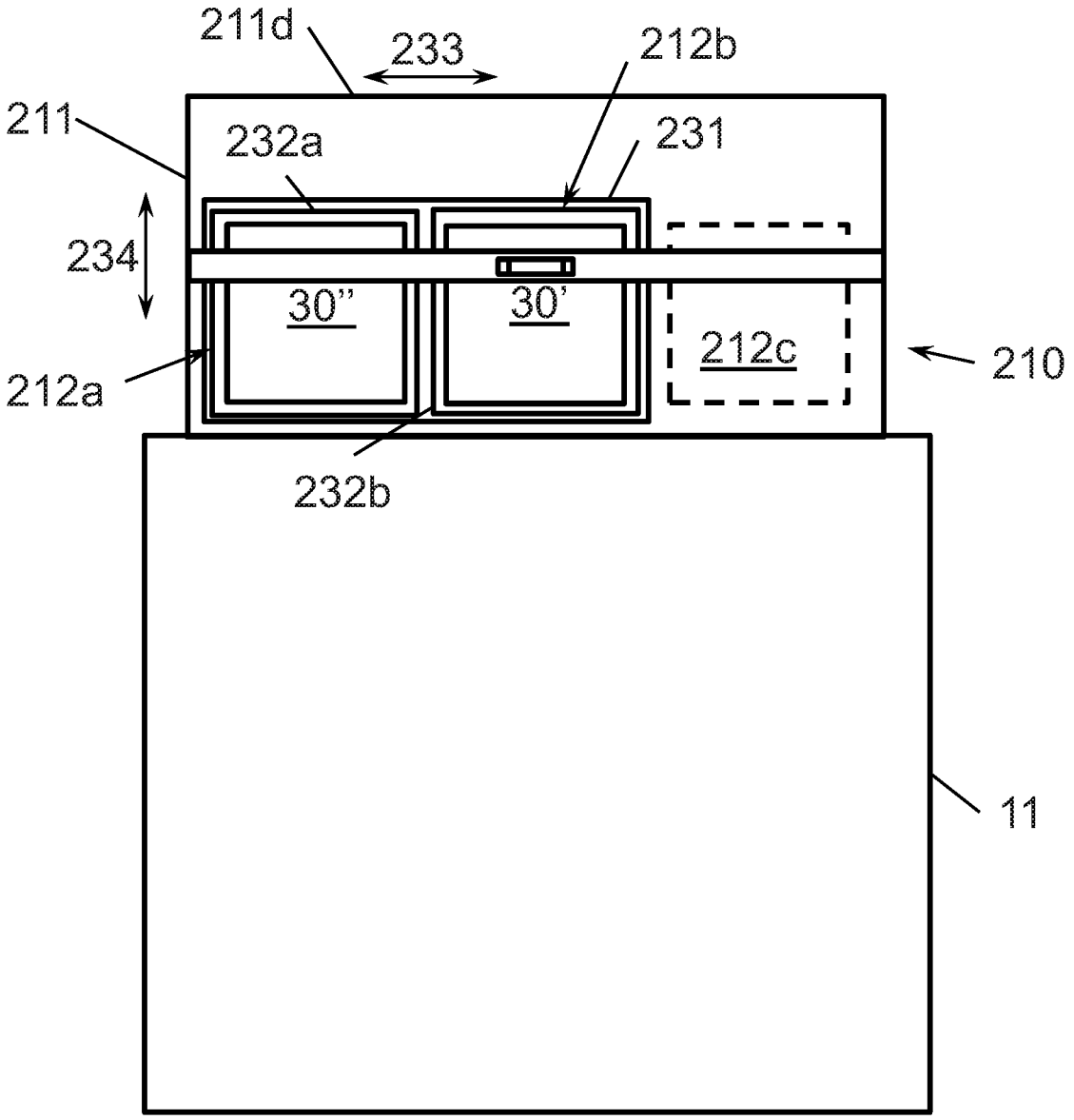
Figure 3H:
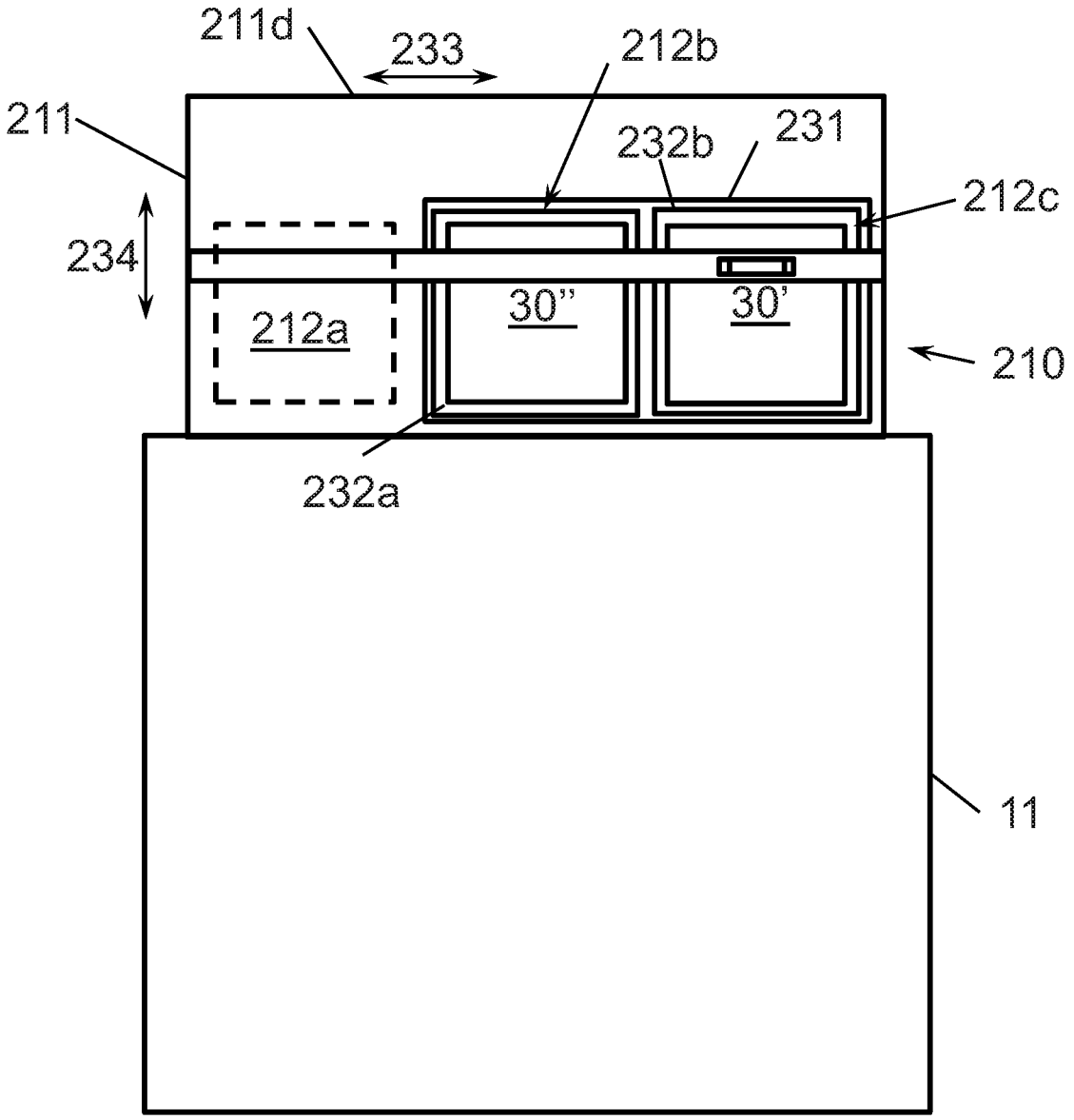
Figure 3I:
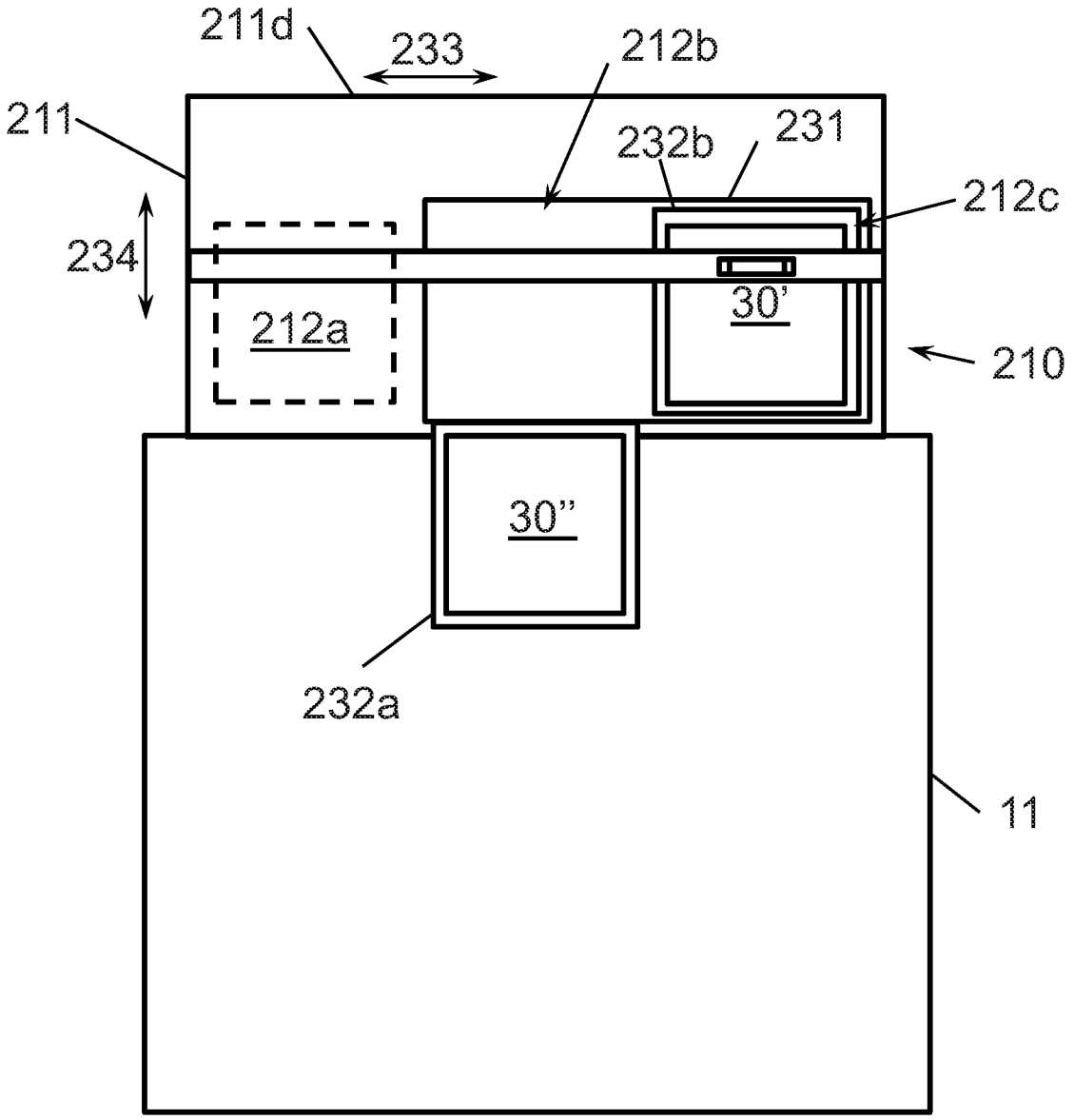
Figure 3J:
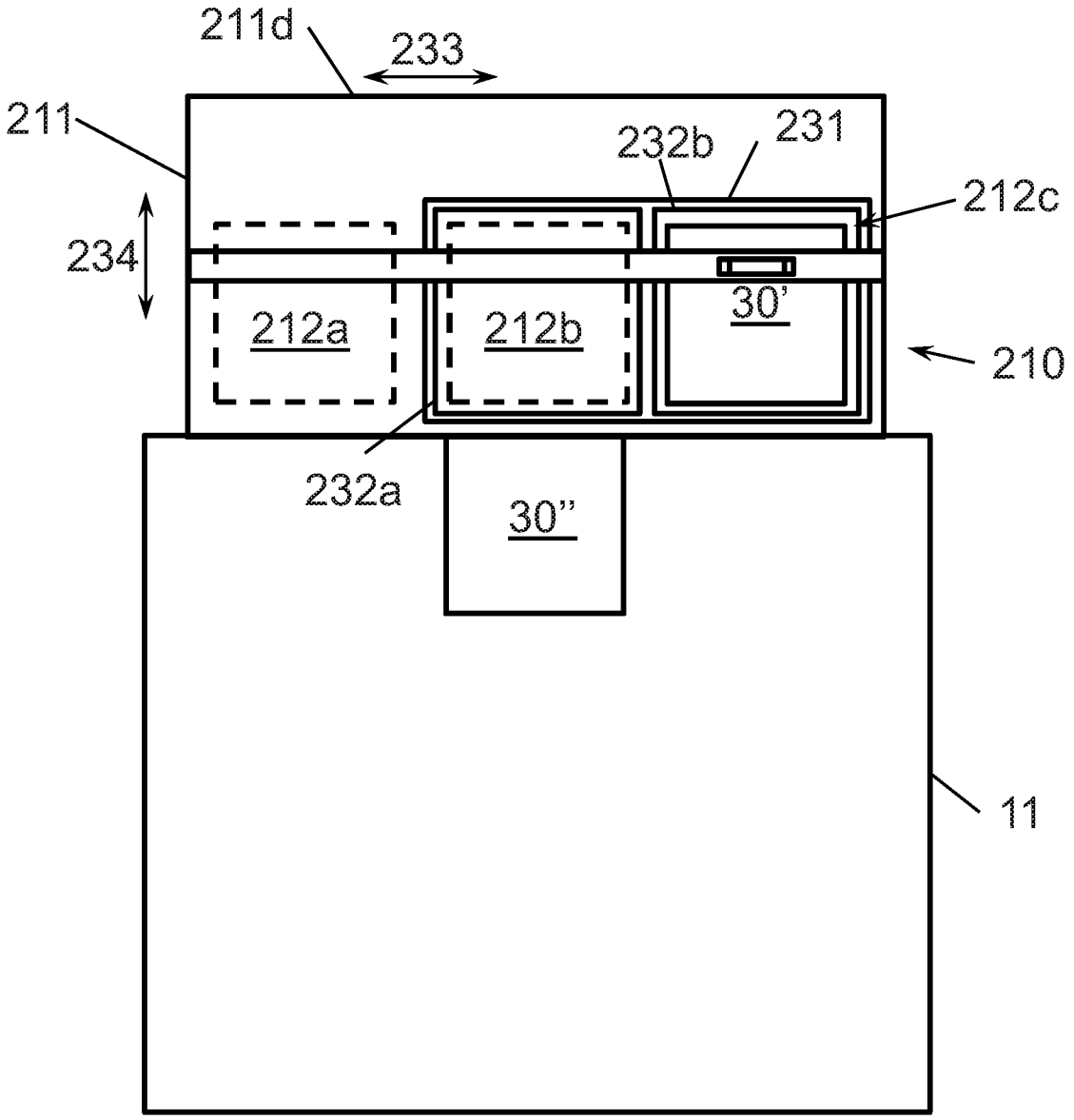
Figure 3K:
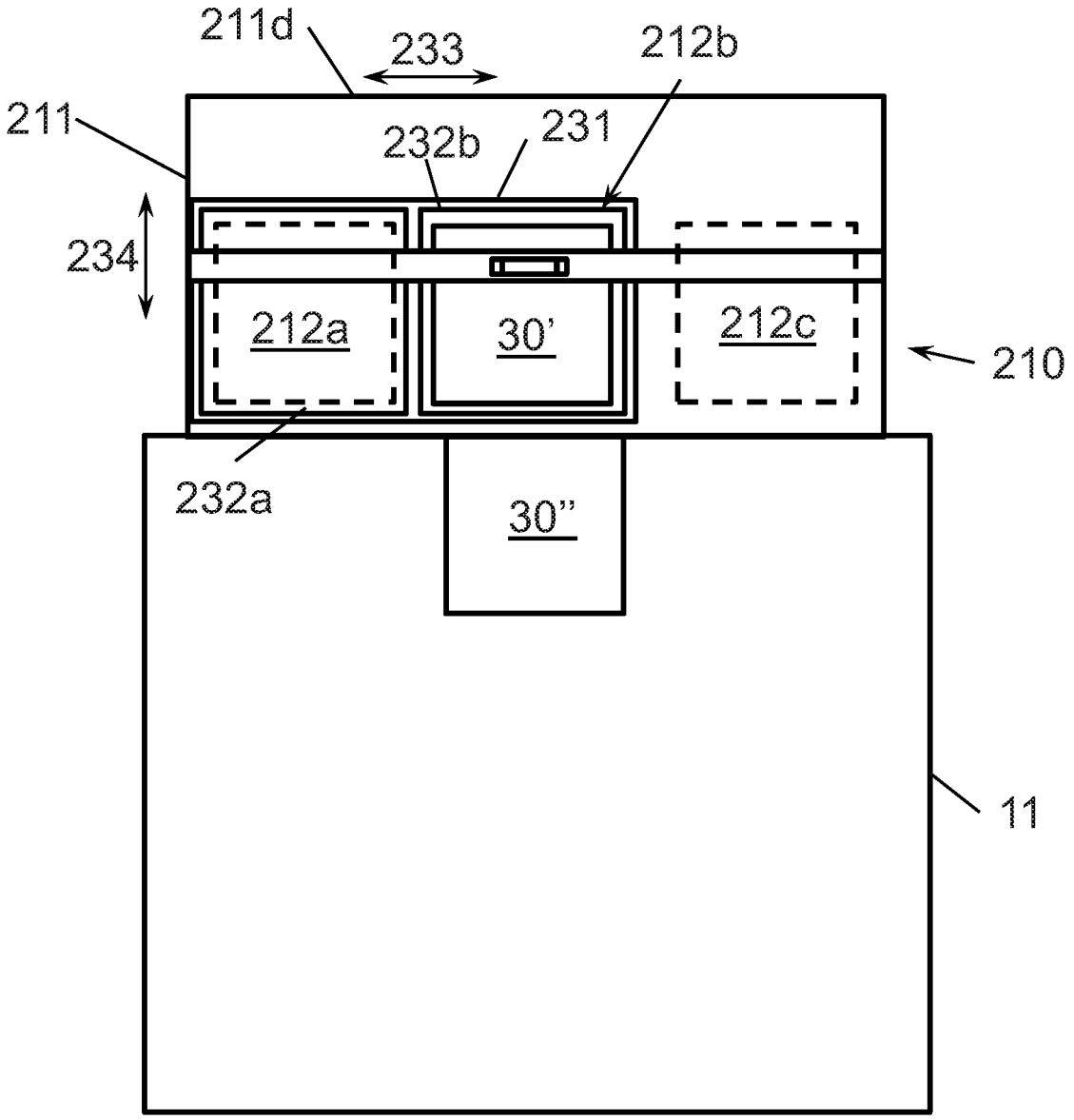
Figure 3L:
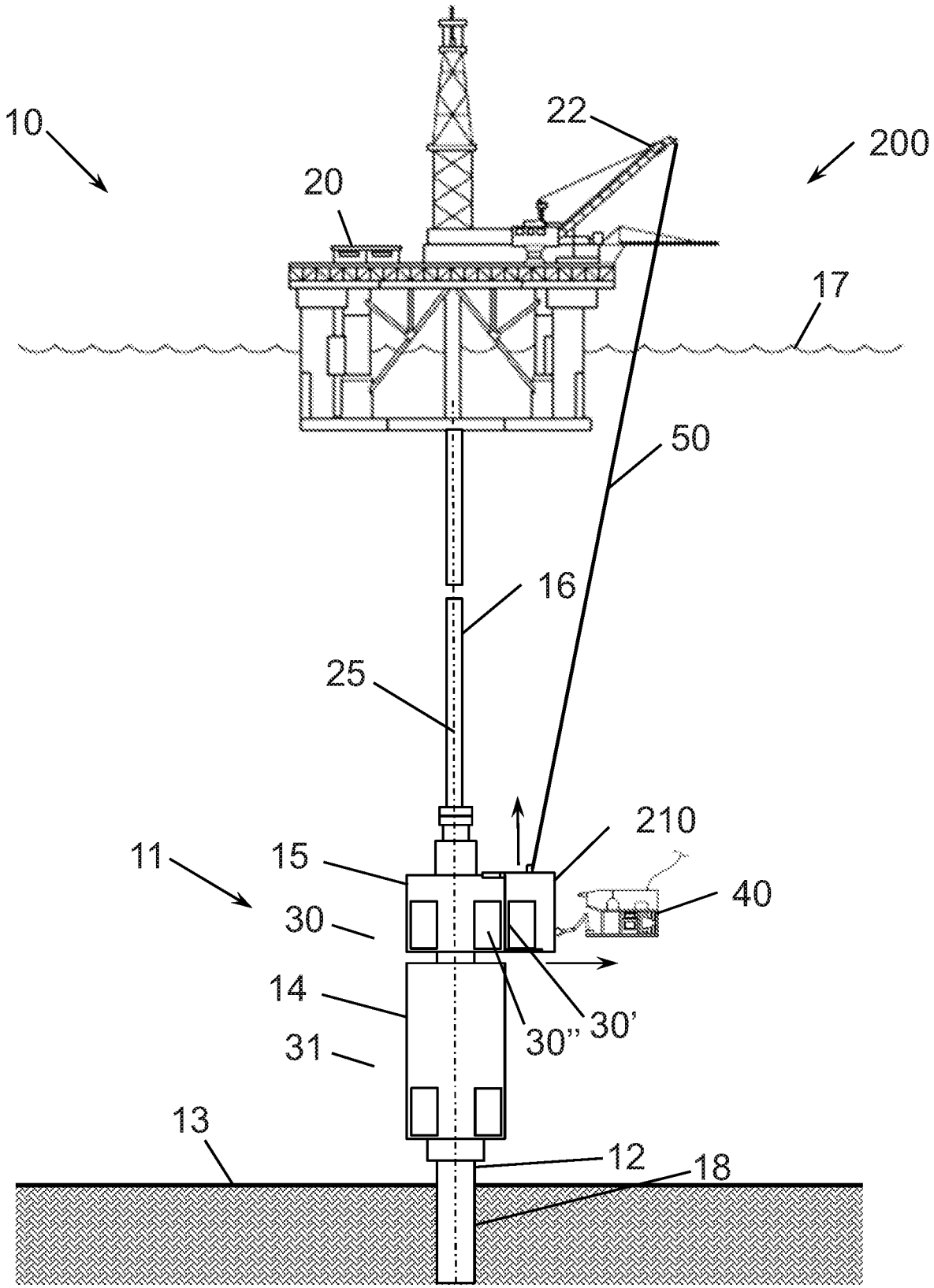
Figure 3M:
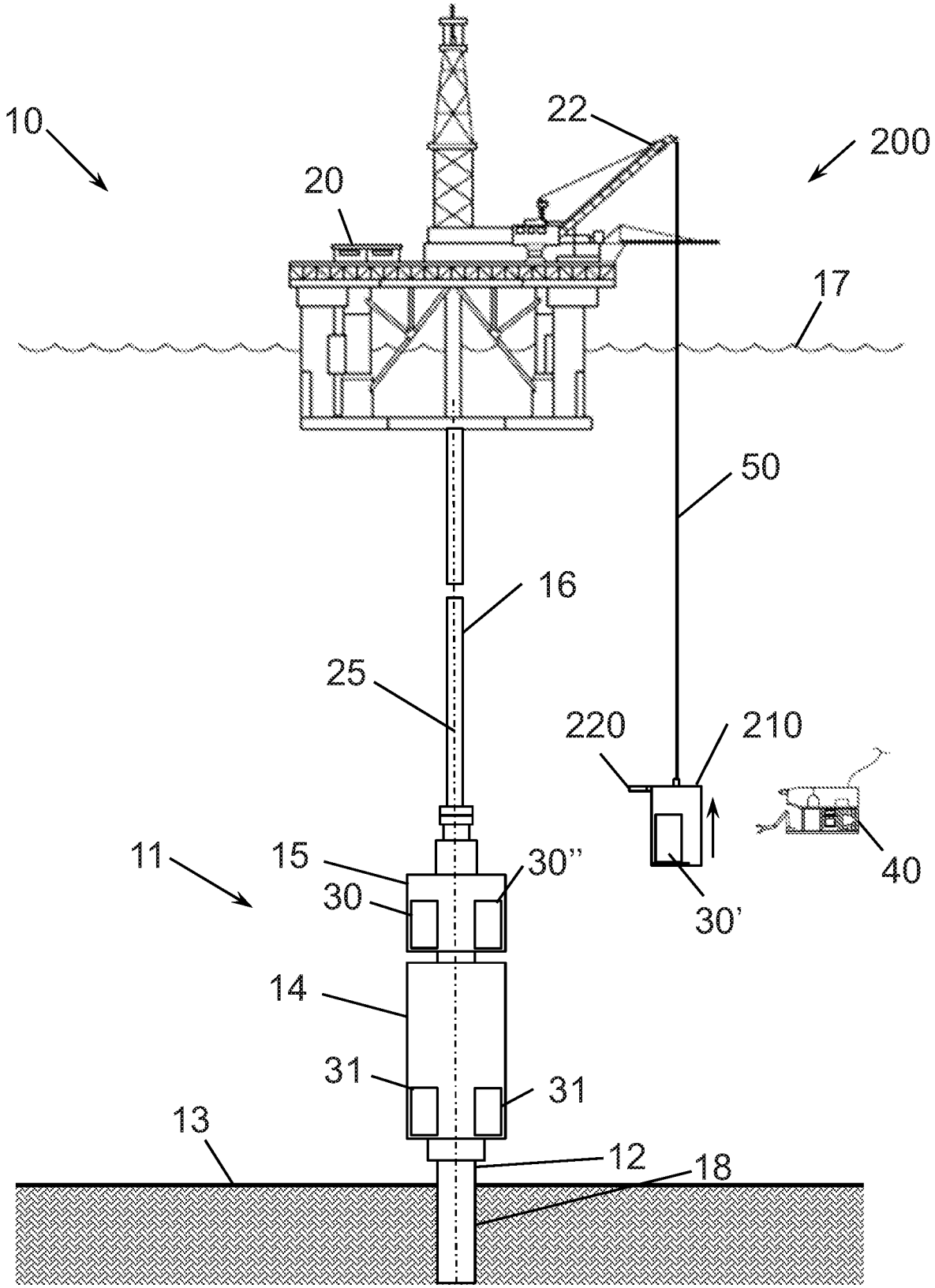
Figure 3N:
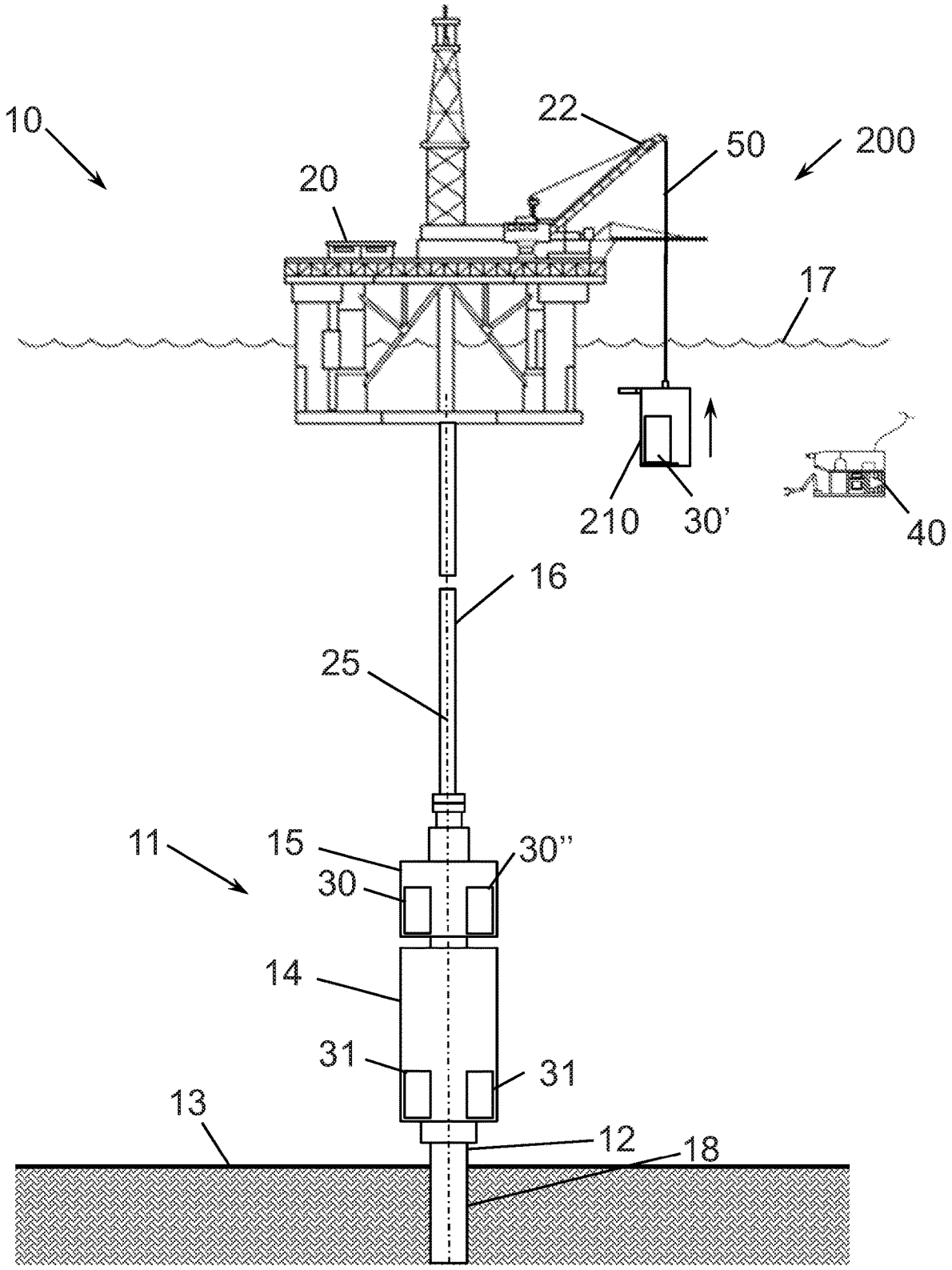

Referring now to FIGS. 3A-3N, an embodiment of a system 200 for retrieving a failed or faulty control pod 30', and replacing it with a replacement control pod 30" is schematically shown. More specifically, in FIGS. 3A-3C, system 200 is shown delivering replacement control pod 30" subsea to BOP stack 11; in FIGS. 3D-3K, system 200 is shown removing the failed or faulty control pod 30' from BOP stack 11 and replacing it with control pod 30"; and in FIGS. 3L-3N, system 200 is shown retrieving control pod 30' to vessel 20 at the surface 17.

In this embodiment, system 200 includes lifting device 22 mounted to surface vessel 20, rigging 50 coupled to lifting device 22, control pod exchange device 210, and BOP stack connection assembly 220 coupled to device 210. Lifting device 22 and rigging 50 are as previously described. Namely, lifting device 22 is a heavy lift crane disposed on vessel 20, and rigging 50 is rope that extends from lifting device 22 and can be paid in or paid out from lifting device 22 to raise or lower loads. In this embodiment, one or more ROV 40 as previously described is used to assist in the retrieval of pod 30' and deployment of pod 30". As will be described in more detail below, control pod exchange device 210 delivers replacement pod 30" to BOP stack 11, automates the exchange of pods 30', 30" (i.e., removes pod 30' from stack 11 and installs pod 30" in stack 11), and delivers pod 30' to the surface 17. Connection assembly 220 facilitates the alignment of device 210 relative to BOP stack 11 and coupling of device 210 to BOP stack 11 such that pods 30', 30" can be exchanged.

Figure 4A:
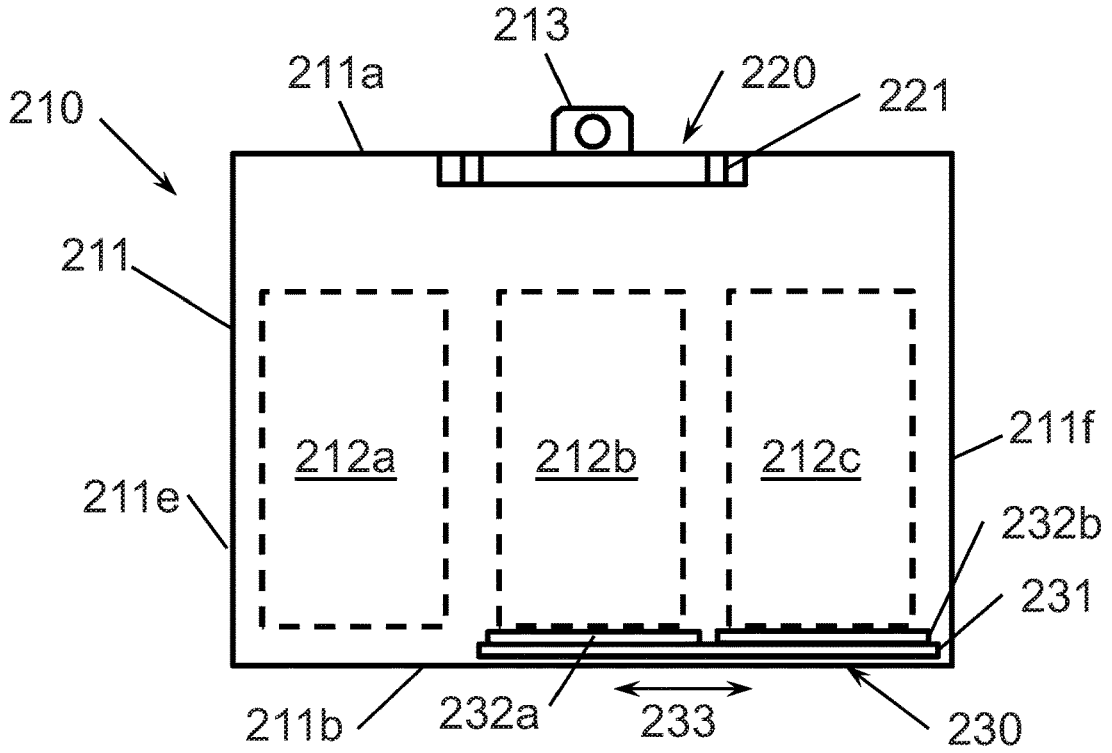
FIGS. 4A, 4B, and 4C are front, top, and side views, respectively, the control pod exchange apparatus of FIGS. 3A-3N.
Figure 4B:
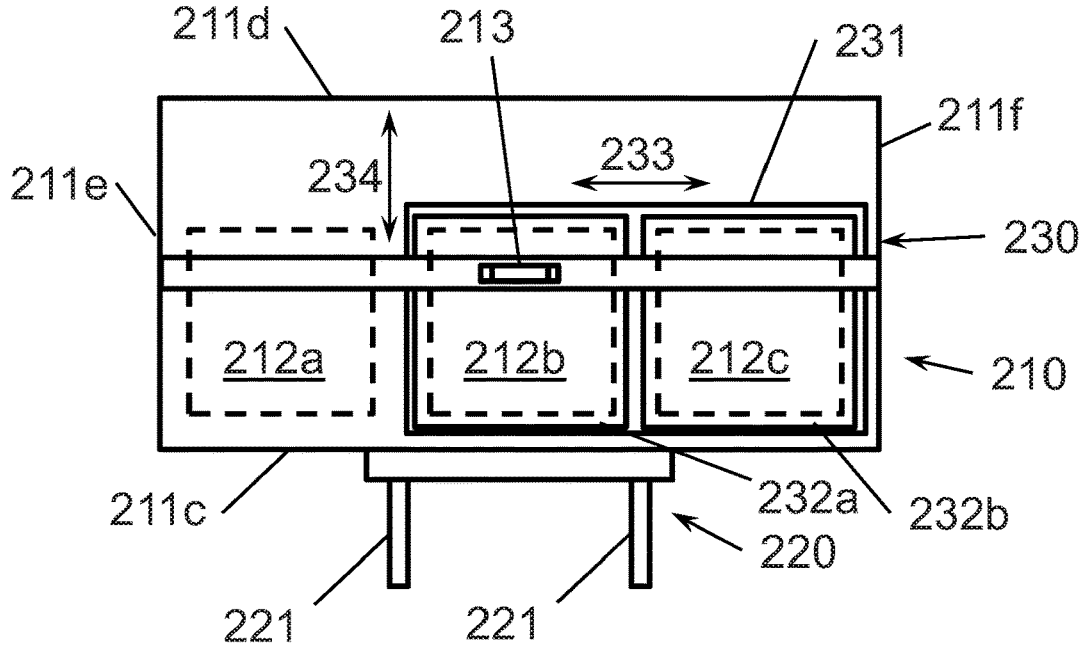
Figure 4C:
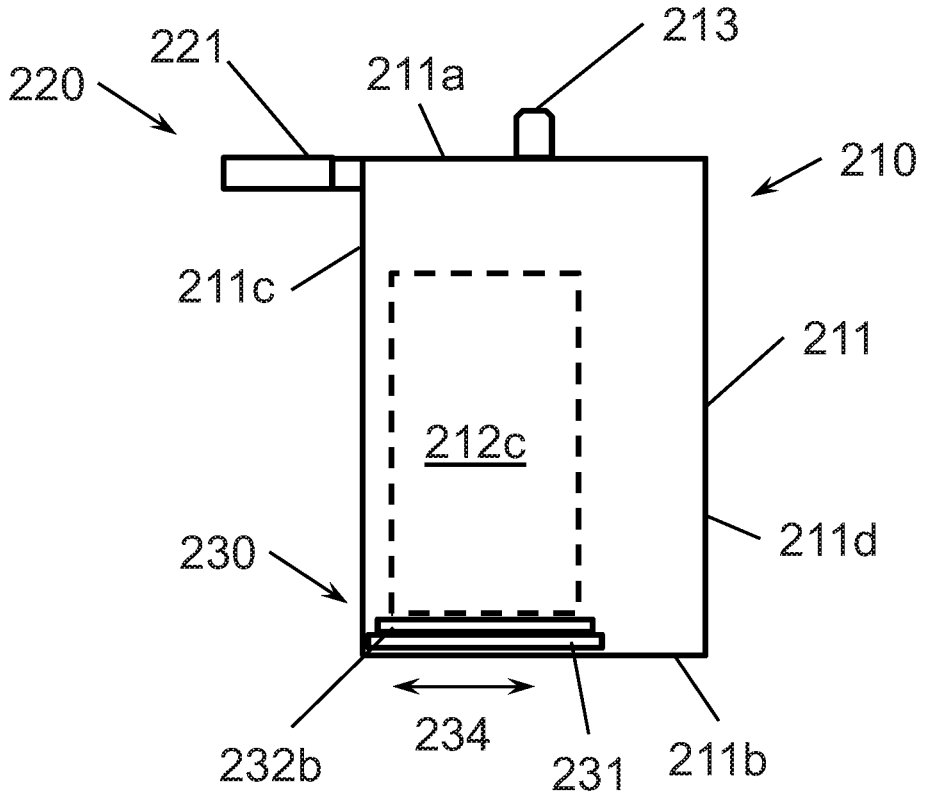

Referring briefly to FIGS. 4A-4C, control pod exchange device 210 and BOP stack connection assembly 220 coupled to device 210 are shown. In this embodiment, exchange device 210 includes an outer housing 211 and a control pod transfer assembly 230 moveably disposed in housing 211. In this embodiment, housing 211 is a rectangular frame having a top 211*a*, a bottom 211*b*, a front 211*c*, a back 211*d*, and lateral sides 211*e*, 211*f*. A connector 213 is provided on the top 211*a* of housing 211 for coupling housing 211 and device 210 to the free end 50*a* of rope 50. The front 211*c* of housing 211 is open to allow control pods 30, 31 to be transferred therethrough into and out of housing 211. As best shown in FIGS. 4A and 4B, the interior of housing 211 includes three areas or bays 212*a*, 212*b*, 212*c* (schematically shown with dashed lines) horizontally arranged side-by-side between lateral sides 211*e*, 211*f*. Each bay 212*a*, 212*b*, 212*c* is sized to accommodate one control pod 30, 31. In this embodiment, connection assembly 220 includes a pair of parallel arms 221 coupled to housing 211 proximal the top 211*a*. Arms 221 extend horizontally outward from the front 211*c* of housing 211. As shown in FIG. 3C, arms 221 are sized, shaped, and positioned to mate and engage with the BOP stack 11 (e.g., the outer frame of the BOP stack 11) with middle bay 212*b* aligned with and adjacent the control pod 30, 31 to be replaced.

Referring still to FIGS. 4A-4C, control pod transfer assembly 230 automates the transfer of control pod 30' from BOP stack 11 into housing 211 and the transfer of control pod 30" from housing 211 into BOP stack 11. In this embodiment, transfer assembly 230 includes a tray 231 moveably disposed in housing 211 proximal the bottom 211*b* and a pair of control pod supports 232*a*, 232*b* moveably coupled to tray 231. Supports 232*a*, 232*b* are arranged laterally side-by-side on tray 231—in FIGS. 4A and 4B, support 232*a* is positioned on the left side of tray 231 and support 232*b* is positioned on the right side of tray 231. Each support 232*a*, 232*b* is sized to support one control pod 30, 31 thereon.

Tray 231 is controllably moved laterally within housing 211 between sides 211*e*, 211*f* as represented by arrows 233, and supports 232*a*, 232*b* are controllably moved forward and backward relative to tray 231 as represented by arrows 234. Each support 232*a*, 232*b* can extend from tray 231 and housing 211 to retrieve pod 30' from BOP stack 11 and install pod 30" into BOP stack 11 when that particular support 232*a*, 232*b* is aligned with the middle bay 212*b* (i.e., disposed immediately below the middle bay 212*b*). In general, any suitable means or devices known in the art can be used to controllably move tray 231 laterally relative to housing 211 and move supports 232 forward and back relative to tray 231 including, without limitation, hydraulic cylinders, electric actuators, and the like.

As previously described, tray 231 can be moved laterally within housing 211 in the direction of arrows 233. In particular, tray 231 can be moved laterally between a first position (shown in FIGS. 4A and 4B) with tray 231 positioned adjacent side 211*f* and distal side 211*e* with support 232*a* aligned with middle bay 212*b* and support 232*b* aligned with bay 212*c* (the rightmost bay in FIGS. 4A and 4B); and a second position with tray 231 positioned adjacent side 211*e* and distal side 211*f* with support 232*a* aligned with bay 212*a* (the leftmost bay in FIGS. 4A and 4B) and support 232*b* aligned with bay 212*b*. Further, as previously described, each support 232*a*, 232*b* can be moved forward and backward relative to tray 231 in the direction of arrows 234 when the particular support 232*a*, 232*b* is aligned with middle bay 212*b*. Thus, when a given support 232*a*, 232*b* is aligned with middle bay 212*b*, that support 232*a*, 232*b* has a withdrawn position disposed within housing 211 and an extended position extending from tray 231 and the front 211*c* of housing 211.

Referring again to FIGS. 3A-3N, an embodiment of a method for replacing control pod 30' with control pod 30" using system 200 will be described. In FIGS. 3A-3C, control pod 30" is shown being deployed subsea to BOP stack 11; in FIGS. 3D-3G, control pod 30' is shown being removed from BOP stack 11 and transferred to exchange device 210; in FIGS. 3H-3J, control pod 30" is shown being transferred from exchange device 210 to BOP stack 11 and installed on BOP stack 11; and in FIGS. 3L-3N, control pod 30' is shown being retrieved to the surface 17 and vessel 20.

Referring first to FIGS. 3A-3C, control pod 30" is disposed within exchange device 210 on vessel 20, and the free end 50*a* of rope 50 is attached to connector 213 on vessel 20. Pod 30" is positioned on one of the supports 232*a*, 232*b* within housing 211. The support 232*a*, 232*b* on which pod 30" is disposed is preferably aligned with middle bay 212*b* to balance the weight of device 210 with pod 30" therein. In this embodiment, pod 30" is positioned on support 232*a*. Next, lifting device 22 lowers exchange device 210 (carrying pod 30") subsea. As shown in FIG. 3A, rope 50 is paid out from lifting device 22 until pod 30" is at a depth generally equal to the depth of control pod 30'. Moving now to FIGS. 3B and 3C, ROV 40 moves exchange device 210 to BOP stack 11 immediately adjacent control pod 30', and device 210 is mounted to BOP stack 11 with connection assembly 220. During this process, lifting device 22 is used to control and adjust the vertical position of device 210 relative to BOP stack 11 while ROV 40 generally provides the lateral force to move device 210 to BOP stack 11. It should be appreciated that rope 50 may need to be paid out to allow device 210 to be moved to BOP stack 11, however, rope 50 remains in tension, and thus, supports the weight of device 210 and pod 30" therein.

As previously described and best shown in FIG. 3C, arms 221 of connection assembly 220 are sized, shaped, and positioned to mate and engage with the BOP stack 11 (e.g., the outer frame of the BOP stack 11) with middle bay 212*b* aligned with and adjacent the control pod 30' to be replaced. With device 210 coupled to BOP stack 11, pods 30', 30" can be swapped. In particular, as shown in FIGS. 3D and 3E, tray 231 is translated laterally to move replacement control pod 30" out of middle bay 212*b* and align the empty support 232*a*, 232*b* with control pod 30'. In this embodiment, pod 30" is seated on support 232*a*, and thus, tray 231 is moved laterally to move pod 30" and support 232*a* from middle bay 212*b* to bay 212*a* while simultaneously moving empty support 232*b* from bay 212*c* to middle bay 212*b*. Next, as shown in FIGS. 3E and 3F, the empty support 232*b* is extended from tray 231 and the front 211*c* of housing 211 to pod 30'. In this embodiment, support 232*b* is sized and positioned to slide under pod 30'. With support 232*b* slidingly engaging the bottom of pod 30', and thus, positioned to support the weight of pod 30', ROV 40 can be used to decouple any connections between pod 30' and BOP stack 11 (e.g., mechanical and/or hydraulic connections between pod 30' to BOP stack 11). Then, with pod 30' sitting on support 232*b*, support 232*b* is withdrawn back into housing 211, thereby positioning pod 30' in middle bay 212*b*.

Referring now to FIGS. 3G-3K, once pod 30' is removed from BOP stack 11, pod 30" can be installed. First, as shown in FIGS. 3G and 3H, with both pods 30', 30" disposed in housing 211 on trays 232*b*, 232*a*, respectively, tray 231 is moved laterally to move control pod 30' out of middle bay 212*b* and move replacement control pod 30" into middle bay 212*b*. Next, support 232*a* is extended from tray 231 and the front 211*c* of housing 211 to install pod 30' on BOP stack 11. ROV 40 can be used to make up any connections between pod 30" and BOP stack 11 (e.g., mechanical and/or hydraulic connections between pod 30' to BOP stack 11). Moving now to FIG. 3J, with replacement control pod 30" installed on BOP stack 11, support 232*a* is withdrawn back into housing 211, thereby completing the exchange of pods 30', 30". To balance the weight of exchange device 210 following the installation of pod 30", tray 231 is preferably moved laterally to position pod 30' in middle bay 212*b* to balance the weight of device 210 with pod 30' therein.

Referring now to FIGS. 3L-3N, after swapping pods 30', 30", exchange device 210 is decoupled from BOP stack 11 by applying tension to rope 50 with lifting device 22 to lift exchange device 210 while ROV 40 pulls and/or guides exchange device 210 laterally away from BOP stack 11. Rope 50 remains in tension during this process, and thus, supports the weight of device 210 and pod 30" therein, while ROV 40 generally provides the lateral force to guide device 210 away from BOP stack 11.

Once exchange device 210 is removed from BOP stack 11, lifting device 22 lifts exchange device 210 (carrying pod 30') to vessel 20 at the surface 17 as shown in FIGS. 3M and 3N.

In the manner described and shown in FIGS. 3A-3M, system 200 can be used to deploy control pod 30", exchange or swap control pods 30', 30" at BOP stack 11, and retrieve control pod 30' to the surface 17 in a single subsea trip. During deployment of pod 30" and retrieval of pod 30', ROV 40 is used to laterally move and/or guide exchange device 210 to and from BOP stack 11, respectively. In addition, ROV 40 can be used to guide and/or monitor exchange device 210 (and pod 30', pod 30" disposed thereon) as it is lifted, lowered, or otherwise moved subsea. However, it should be appreciated that during deployment of pod 30", exchanging of pods 30', 30" at BOP stack 11, and retrieval of pod 30', the weight of exchange device 210 (and any pod 30', 30" thereon) is supported by rope 50 and/or BOP stack 11, thereby reducing the payload lifting requirements for ROV 40.

Referring now to FIGS. 5A-5J, an embodiment of a system 300 for retrieving a failed or faulty control pod 30', and replacing it with a replacement control pod 30" is schematically shown. More specifically, in FIGS. 5A-5E, system 300 is shown delivering replacement control pod 30" subsea to BOP stack 11; in FIGS. 5E and 5F, system 300 is shown removing the failed or faulty control pod 30' from BOP stack 11 and replacing it with control pod 30"; and in FIGS. 5G-5J, system 300 is shown retrieving control pod 30' to vessel 20 at the surface 17.

In this embodiment, system 300 is substantially the same as system 200 previously described except that BOP stack connection assembly 220 is replaced with BOP stack connection assembly 240. Thus, in this embodiment, system 300 includes lifting device 22 mounted to surface vessel 20, rigging 50 coupled to lifting device 22, control pod exchange device 210, and BOP stack connection assembly 240 coupled to device 210.

In this embodiment, BOP stack connection assembly 240 is a winch mounted to exchange device 210, and more specifically, fixably attached to the top 211*a* of housing 211 of exchange device 210. Accordingly, connection assembly 240 may also be referred to as winch 240. As will be described in more detail below, winch 240 can pay in and pay out a rope 51. In this embodiment, one or more ROV 40 as previously described is used to assist in the retrieval of pod 30' and deployment of pod 30".

In the same manner as previously described with respect to system 200, control pod exchange device 210 delivers replacement pod 30" to BOP stack 11, automates the exchange of pods 30', 30" (i.e., removes pod 30' from stack 11 and installs pod 30" in stack 11), and delivers pod 30' to the surface 17. However, in this embodiment, winch 240 facilitates the alignment of device 210 relative to BOP stack 11, the coupling of device 210 to BOP stack 11 such that pods 30', 30" can be exchanged, and the movement of device 210 to and away from BOP stack 11.

Figure 5A:
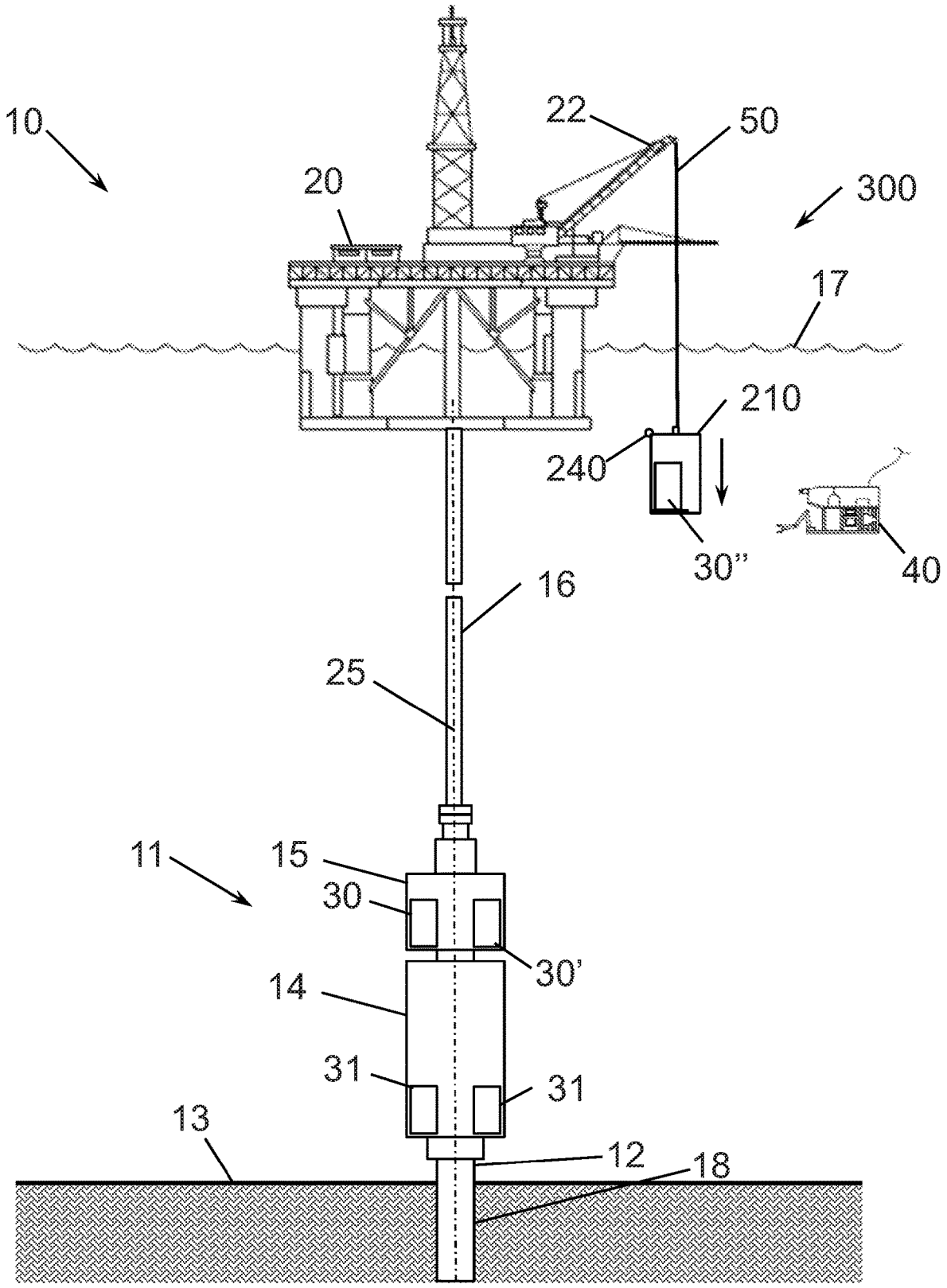
FIGS. 5A-5J are schematic views of an embodiment of a system and associated method in accordance with the principles described herein for replacing a control pod of the offshore system of FIG. 1.
Figure 5B:
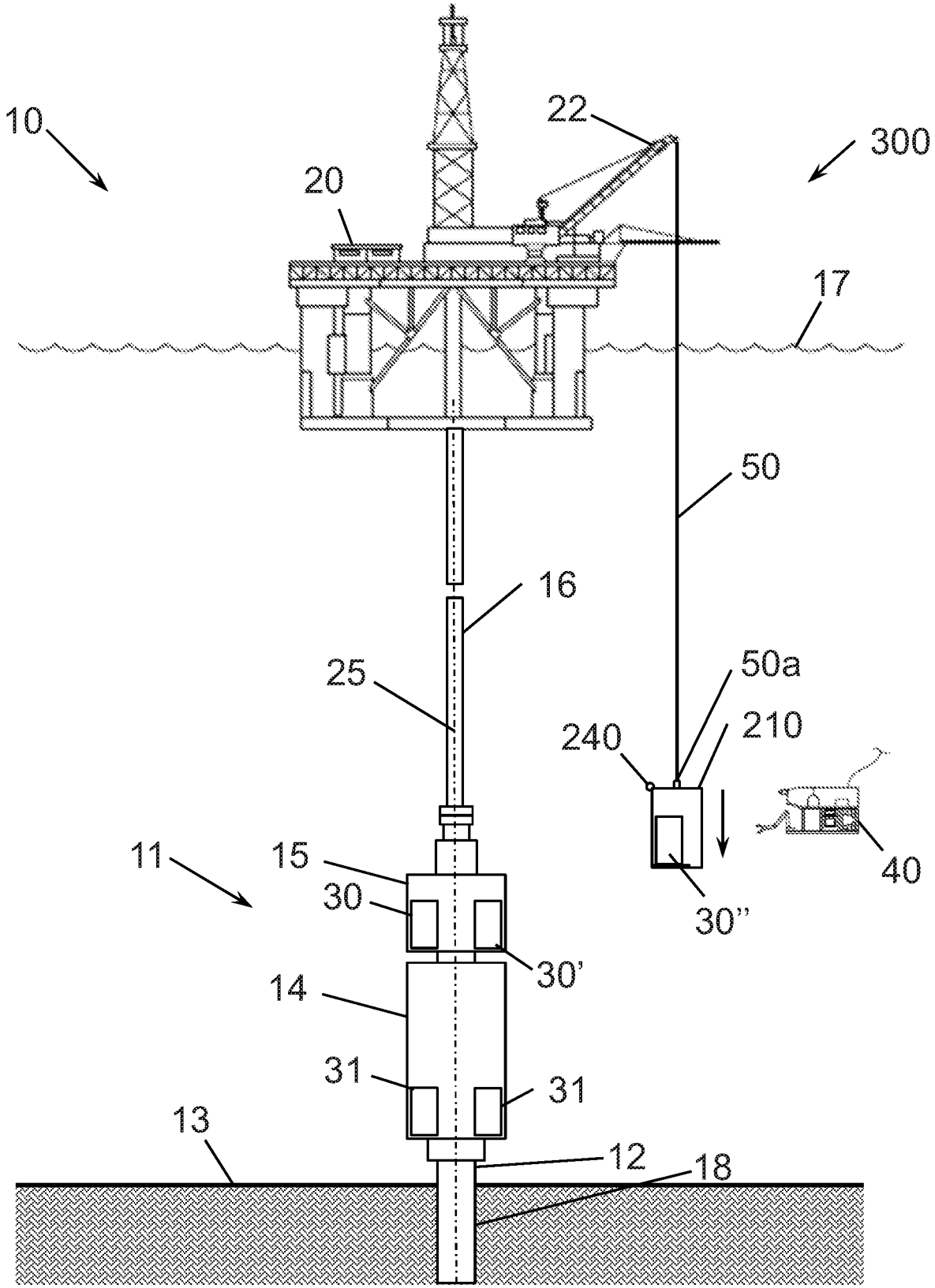

Referring still to FIGS. 5A-5J, an embodiment of a method for replacing control pod 30' with control pod 30" using system 300 will be described. In FIGS. 5A and 5B, control pod 30" is shown being deployed subsea; in FIGS. 5C-5E, control pod 30" is shown being moved to BOP stack 11; in FIGS. 5E and 5F, control pod 30' is shown being removed from BOP stack 11 and transferred to exchange device 210 while control pod 30" is transferred from exchange device 210 to BOP stack 11 and installed on BOP stack 11; and in FIGS. 5G-5J, control pod 30' is shown being retrieved to the surface 17 and vessel 20.

Referring first to FIGS. 5A and 5B, control pod 30" is disposed within exchange device 210 on vessel 20, and the free end 50*a* of rope 50 is attached to connector 213 on vessel 20. Pod 30" is positioned on one of the supports 232*a*, 232*b* within housing 211. The support 232*a*, 232*b* on which pod 30" is disposed is preferably aligned with middle bay 212*b* to balance the weight of device 210 with pod 30" therein. Next, lifting device 22 lowers exchange device 210 (carrying pod 30") subsea. As shown in FIG. 5B, rope 50 is paid out from lifting device 22 until pod 30" is at a depth less than the depth of control pod 30'.

Figure 5C:
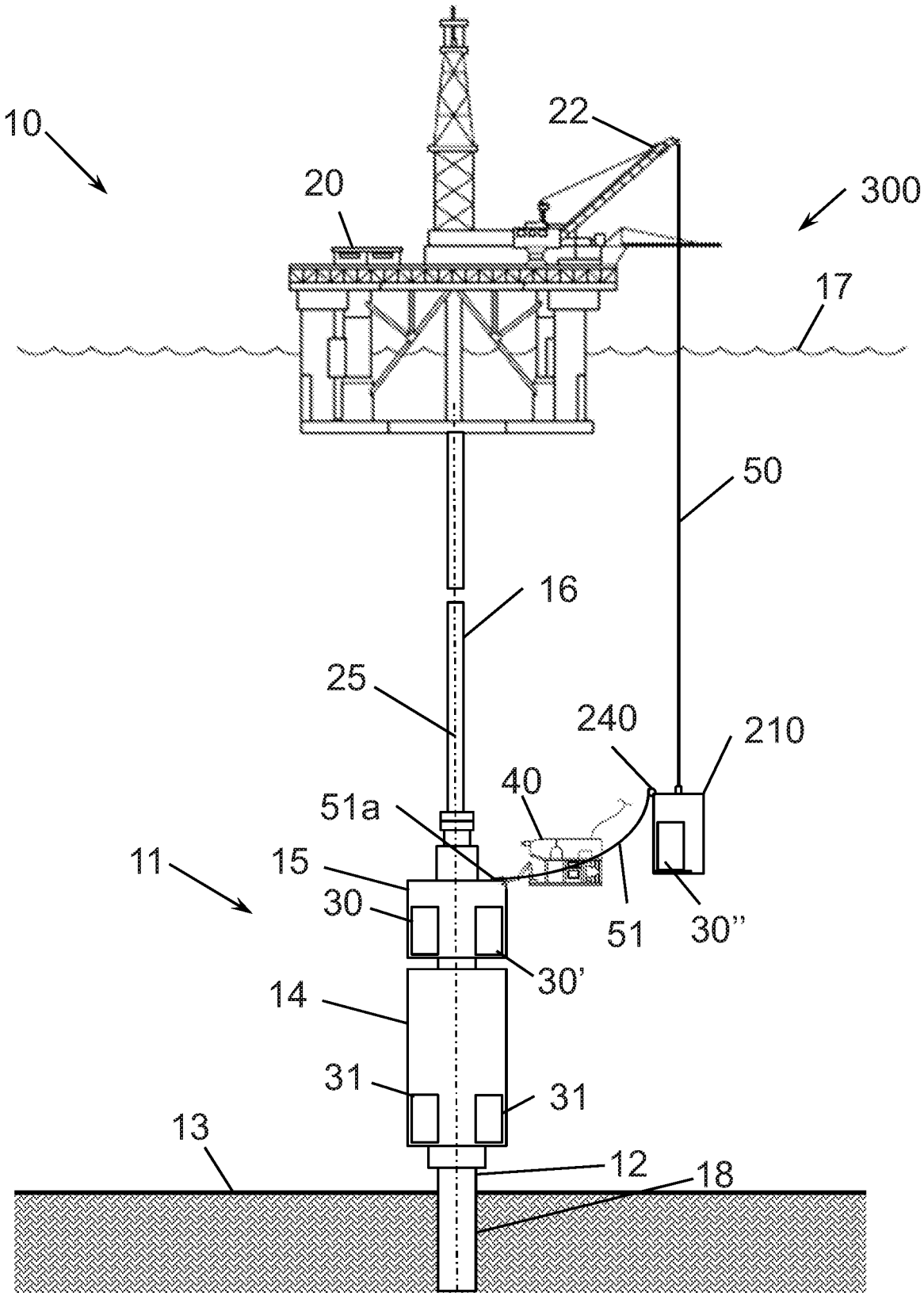
Figure 5D:
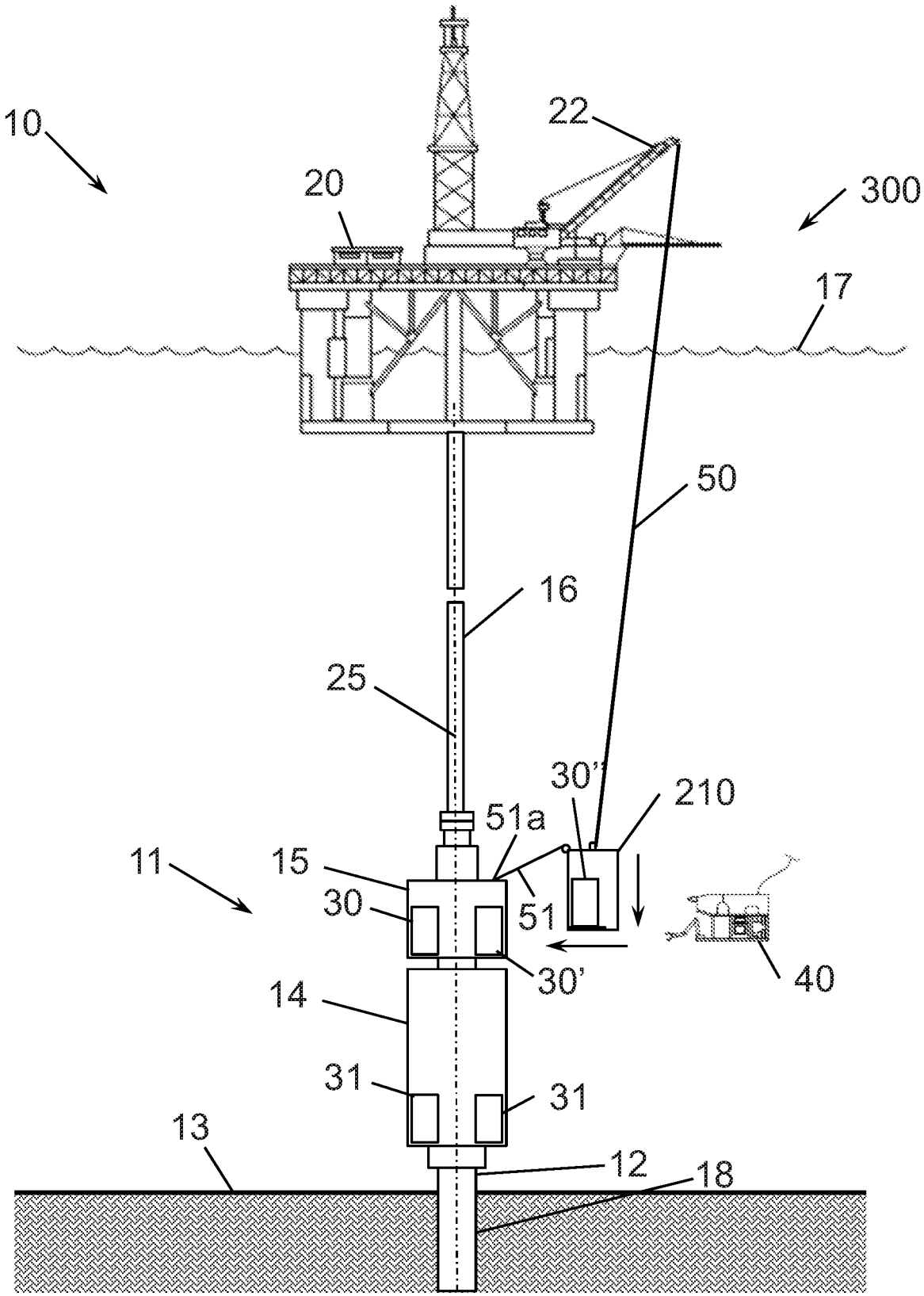
Figure 5E:
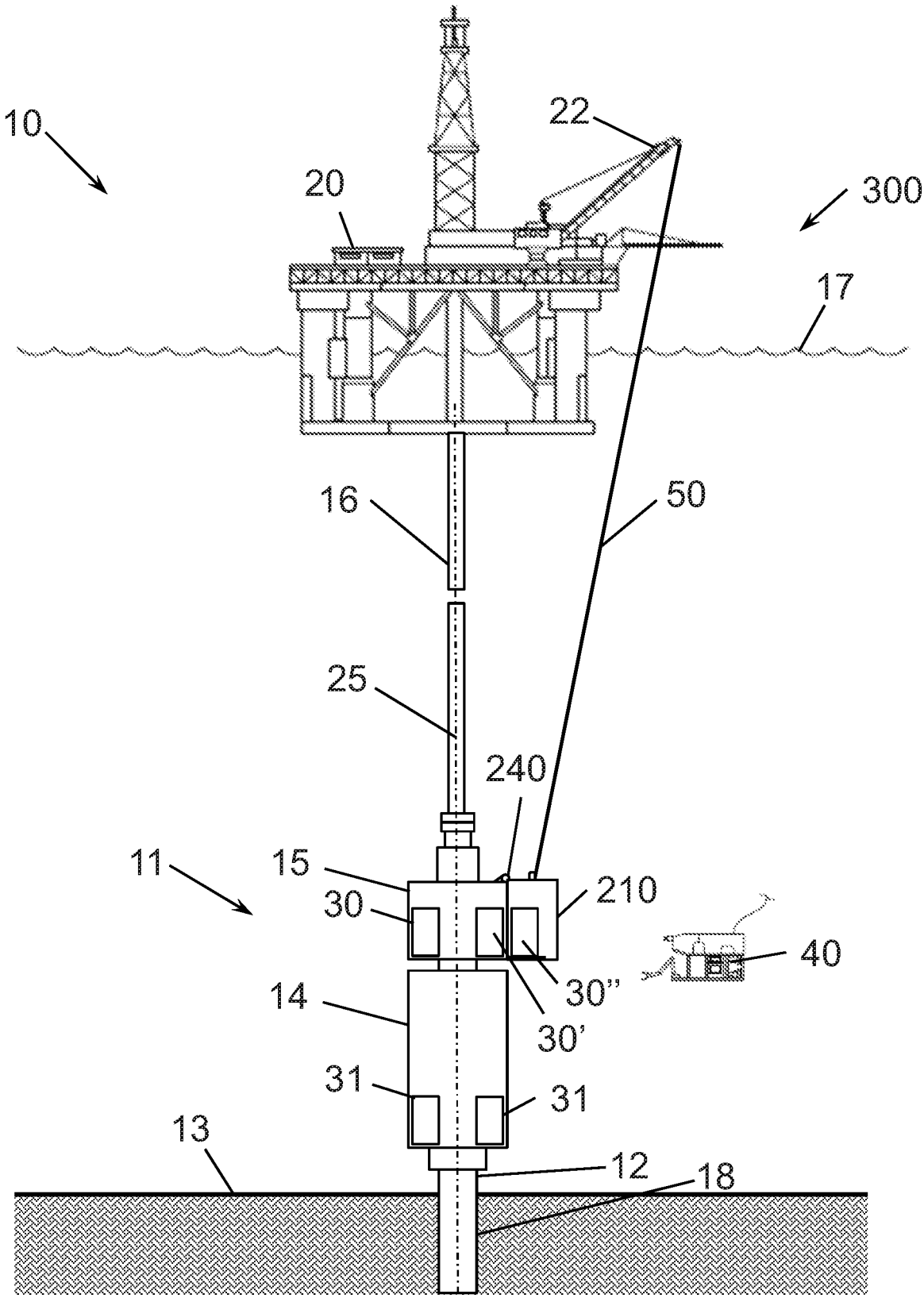

Moving now to FIG. 5C, rope 51 is paid out from winch 240, and with sufficient slack in rope 51, ROV 40 grabs the free end 51*a* of rope 51 with its claw 42, moves end 51*a* to BOP stack 11, and secures end 51*a* to BOP stack 11, thereby coupling exchange device 210 with BOP stack 11. Free end 51*a* is attached to BOP stack 11 at a particular position that allows winch 240 to pull exchange device 210 to BOP stack 11 with middle bay 212*b* aligned with and immediately adjacent control pod 30'. Next, as shown in FIGS. 5D and 5E, winch 240 is operated to pay in rope 51, thereby applying tension to rope 51 and pulling exchange device 210 to BOP stack 11. Due to the attachment point of end 50*a* on BOP stack 11, bay 212*b* is aligned with and adjacent to control pod 30' when exchange device 210 is pulled to BOP stack 11 with winch 240. Although rope 50 may need to be paid out to allow device 210 to be pulled to BOP stack 11 with winch 240, rope 50 remains in tension, and thus, supports the weight of device 210 and pod 30" therein. Thus, lifting device 22 primarily supports the weight of exchange device 210 and pod 30' therein, while winch 240 provides the lateral force to move device 210 to BOP stack 11.

Figure 5F:
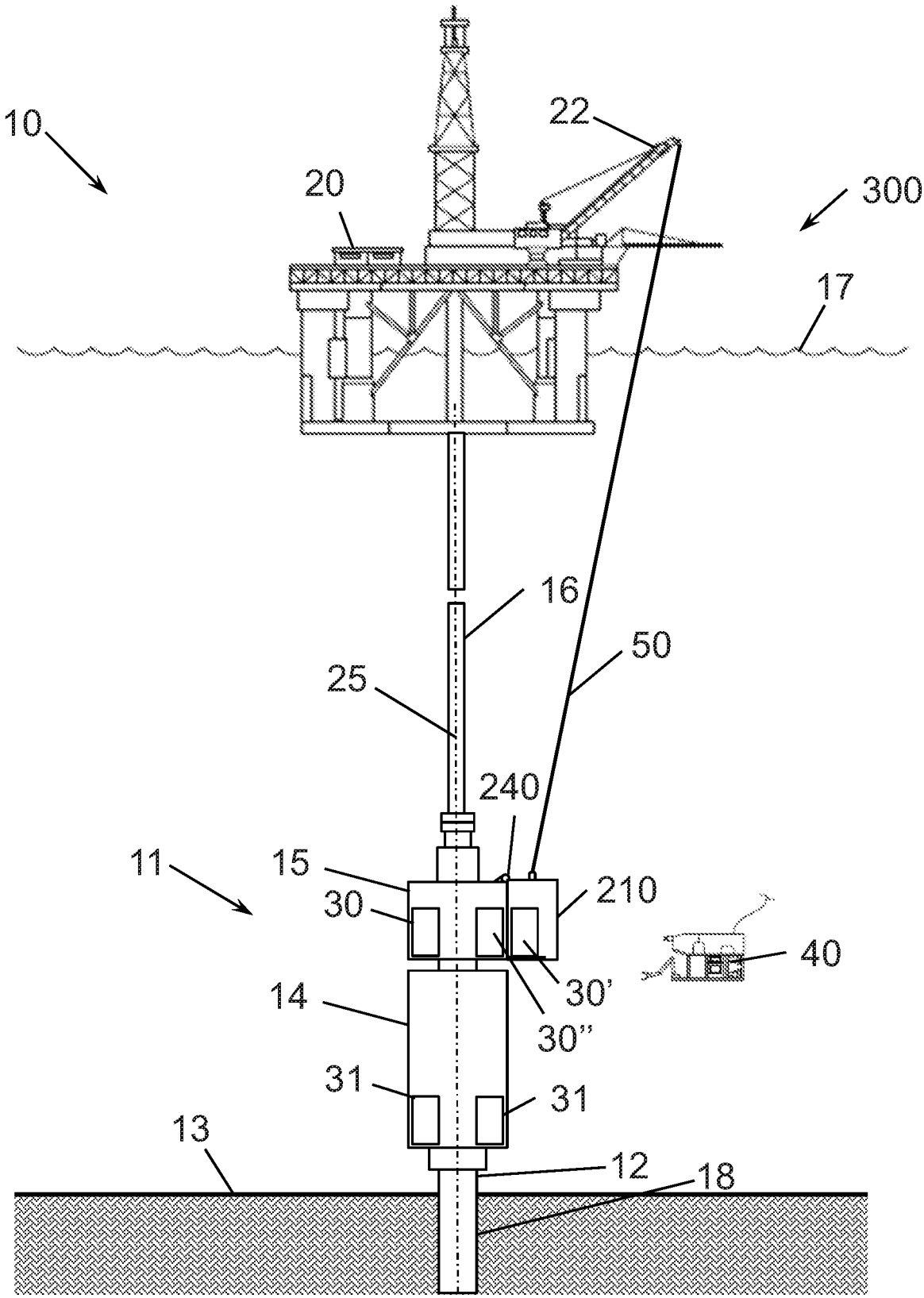

As shown in FIGS. 5E and 5F, with device 210 coupled to BOP stack 11 with middle bay 212*b* aligned with and adjacent the control pod 30', pod 30' is removed from BOP stack 11 and then pod 30" is installed in BOP stack 11 (i.e., pod 30' is replaced with pod 30"). In this embodiment, exchange device 210 replaces pod 30' with pod 30" in the same manner as previously described and shown in FIGS. 3D-3K.

Figure 5G:
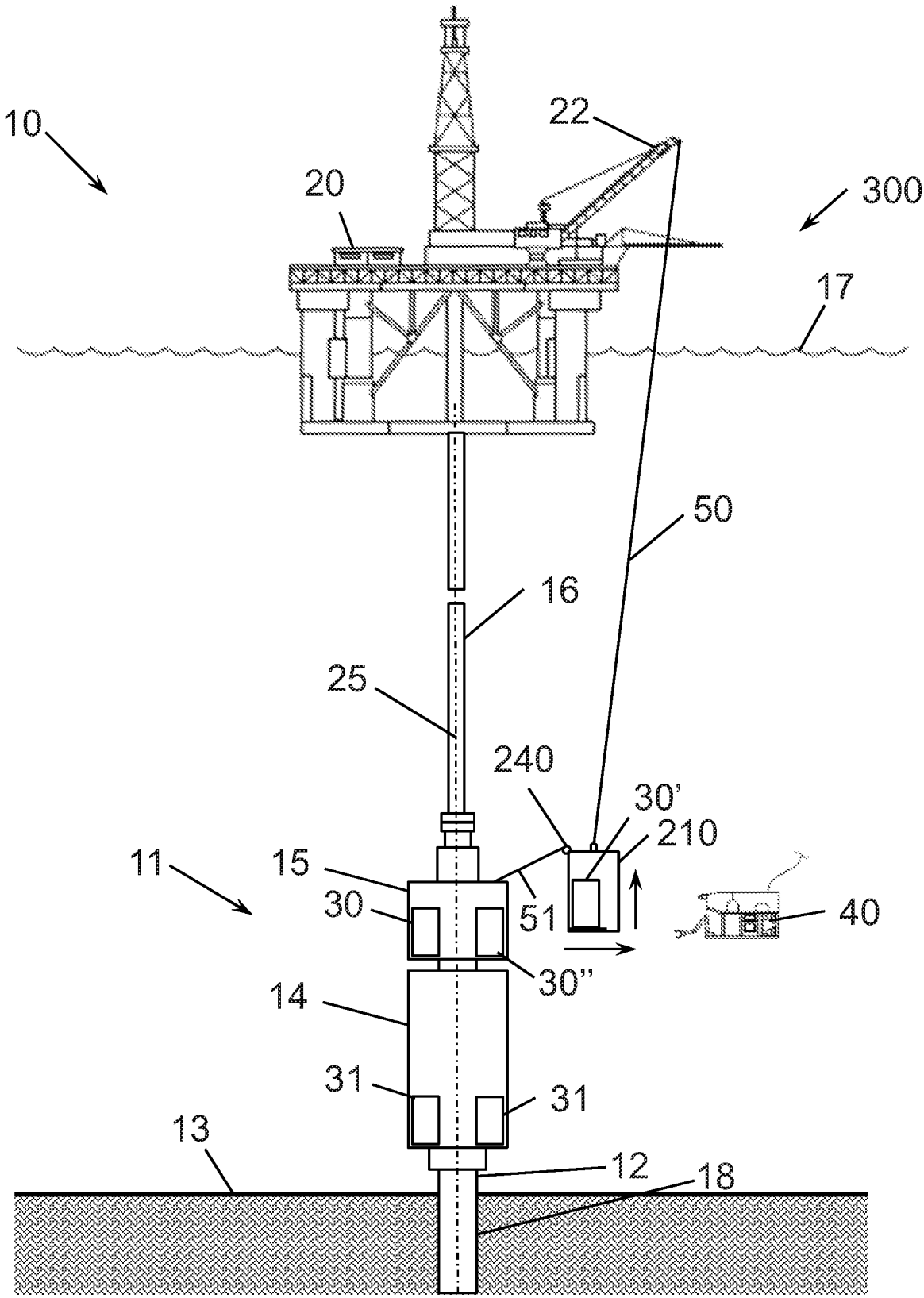
Figure 5H:
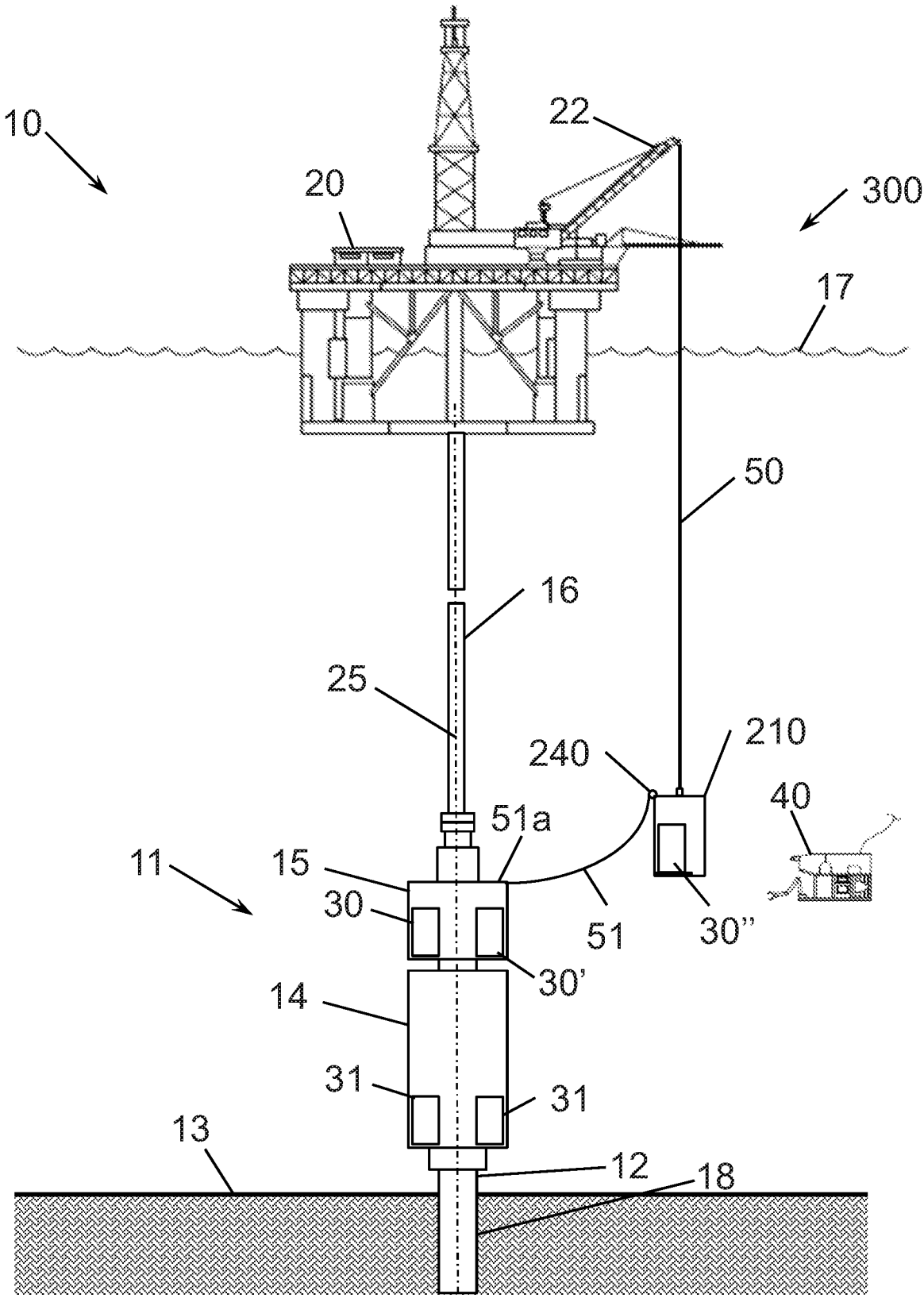
Figure 5L:
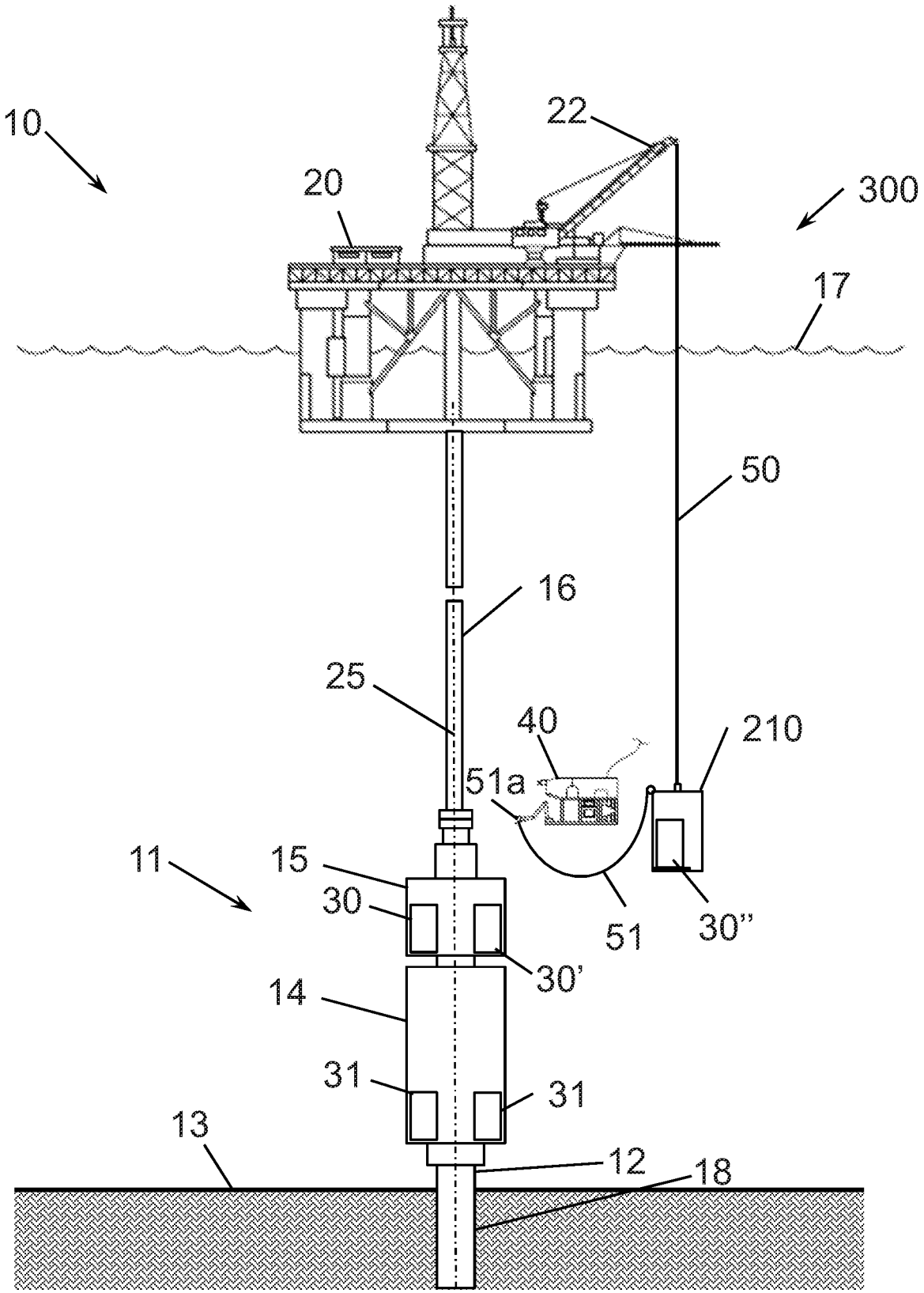
Figure 5J:
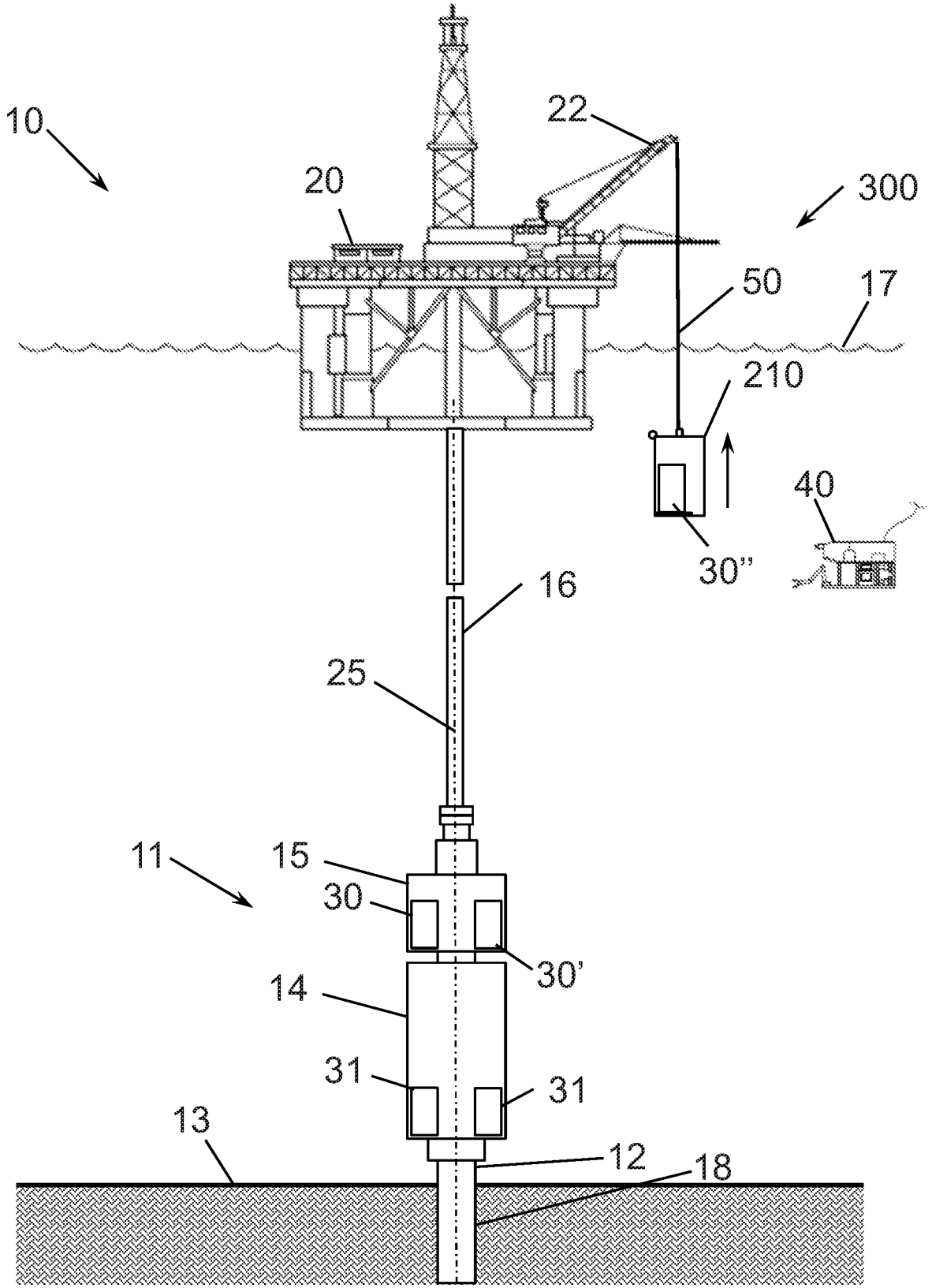

Referring now to FIGS. 5F-5I, after swapping pods 30', 30", exchange device 210 is decoupled from BOP stack 11. In particular, the tension in rope 50 is increased with lifting device 22 to pull exchange device 210 away from BOP stack 11 while winch 240 pays out rope 51 as shown in FIGS. 5F and 5G. ROV 40 can be employed to assist in guiding exchange device 210 away from BOP stack 11. Next, slack is provided in rope 51, and then ROV 40 decouples end 51*a* of rope 51 from BOP stack 11 as shown in FIGS. 5H and 5I. Moving now to FIG. 5J, once exchange device 210 is decoupled from BOP stack 11, lifting device 22 lifts exchange device 210 (carrying pod 30') to vessel 20 at the surface 17.

In the manner described and shown in FIGS. 5A-5J, system 300 can be used to deploy control pod 30", exchange or swap control pods 30', 30" at BOP stack 11, and retrieve control pod 30' to the surface 17 in a single subsea trip. During deployment of pod 30" and retrieval of pod 30', winch 240 and associated rope 51 are used to laterally move exchange device 210 to and from BOP stack 11. In addition, ROV 40 can be used to guide and/or monitor exchange device 210 (and pod 30', pod 30" disposed thereon) as it is lifted, lowered, or otherwise moved subsea. However, it should be appreciated that during deployment of pod 30", exchanging of pods 30', 30" at BOP stack 11, and retrieval of pod 30', the weight of exchange device 210 (and any pod 30', 30" thereon) is supported by rope 50, thereby reducing the payload lifting requirements for ROV 40.

Referring now to FIGS. 6A-6E, an embodiment of a system 400 for retrieving a failed or faulty control pod 30', and replacing it with a replacement control pod 30" is schematically shown. More specifically, in FIGS. 6A-6C, system 400 is shown delivering replacement control pod 30" subsea to BOP stack 11; in FIGS. 6C and 6D, system 400 is shown removing the failed or faulty control pod 30' from BOP stack 11 and replacing it with control pod 30"; and in FIG. 6E, system 400 is shown retrieving control pod 30' to vessel 20 at the surface 17.

In this embodiment, system 400 is substantially the same as system 200 previously described except that BOP stack connection assembly 220 is replaced with BOP stack connection assembly 250. Thus, in this embodiment, system 400 includes lifting device 22 mounted to surface vessel 20, rigging 50 coupled to lifting device 22, control pod exchange device 210, and BOP stack connection assembly 250 coupled to device 210.

In this embodiment, BOP stack connection assembly 250 includes a pulley or sheave 251 rotatably coupled to the lower end 50*a* of rope 50, a guide member 252 mounted to exchange device 210, and a rope 52. In this embodiment, assembly 250 is made up or constructed prior to deploying exchange device 210 and control pod 30" subsea. In particular, rope 52 is passed over sheave 251 and through a guide passage 253 in guide member 252. One free end 52*a* of rope 52 is coupled to connector 213 of exchange device 210, and the other free end 52*b* of rope 52 is coupled to BOP stack 11 with ROV 40. In this embodiment, the lower portion of passage 253 defines a guide or funnel and a stabbing spear 255 is provided at the end 52*b* of rope 52. ROV 40 couples spear 255 to BOP stack 11, and rope 52 extends from spear 255 through passage 253 and over sheave 251 to exchange device 210. As will be described in more detail below, the lower portion of passage 253 is configured to slidingly receive spear 255 as exchange device 210 approaches BOP stack 11 to guide and align exchange device 210 to the desired position and orientation relative to BOP stack 11.

In the same manner as previously described with respect to system 200, control pod exchange device 210 delivers replacement pod 30" to BOP stack 11, automates the exchange of pods 30', 30" (i.e., removes pod 30' from stack 11 and installs pod 30" in stack 11), and delivers pod 30' to the surface 17. However, in this embodiment, assembly 250 facilitates the alignment of device 210 relative to BOP stack 11, the coupling of device 210 to BOP stack 11 such that pods 30', 30" can be exchanged, and the movement of device 210 to and away from BOP stack 11.

Figure 6A:
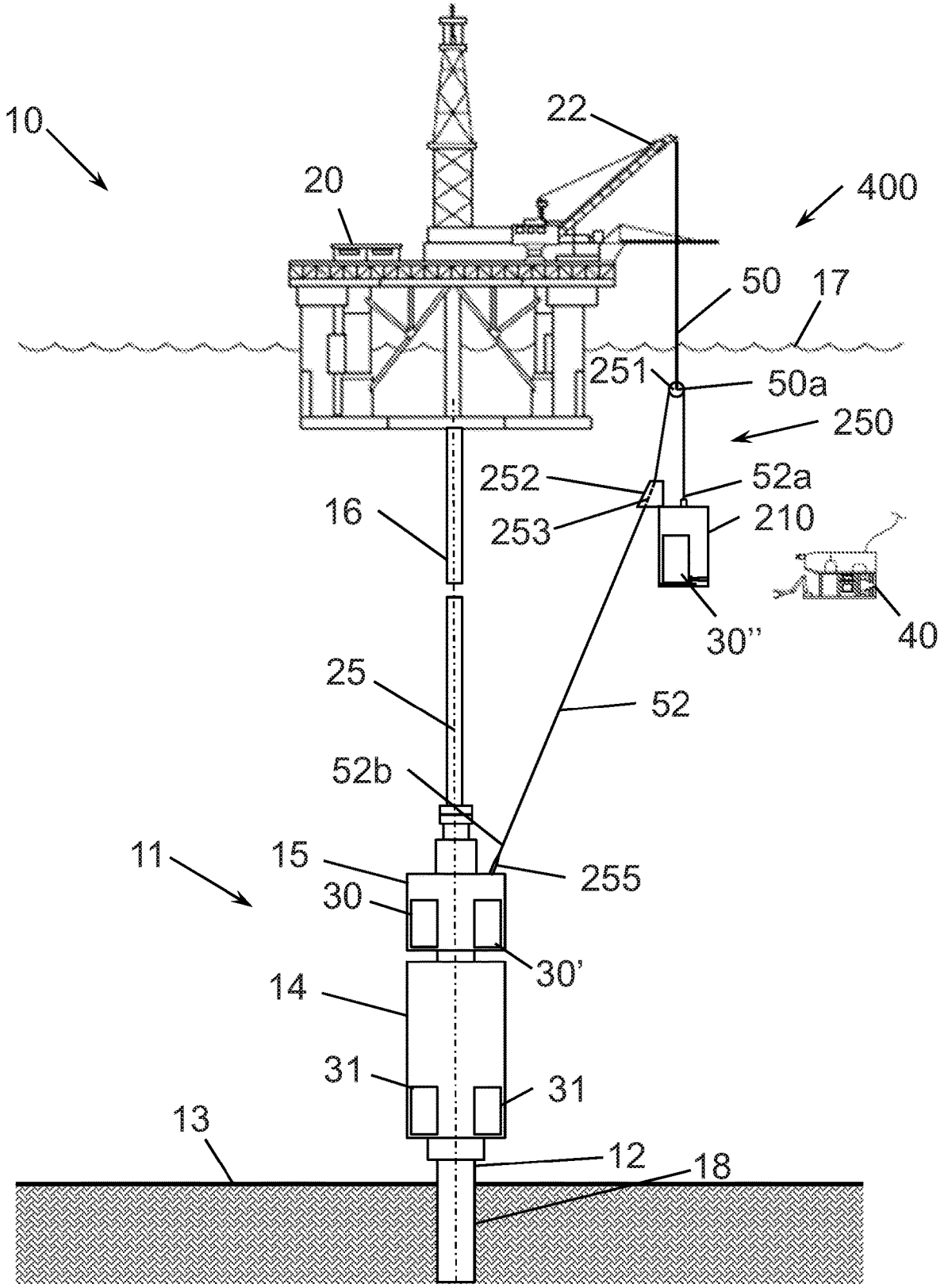
FIGS. 6A-6E are schematic views of an embodiment of a system and associated method in accordance with the principles described herein for replacing a control pod of the offshore system of FIG. 1.
Figure 6B:
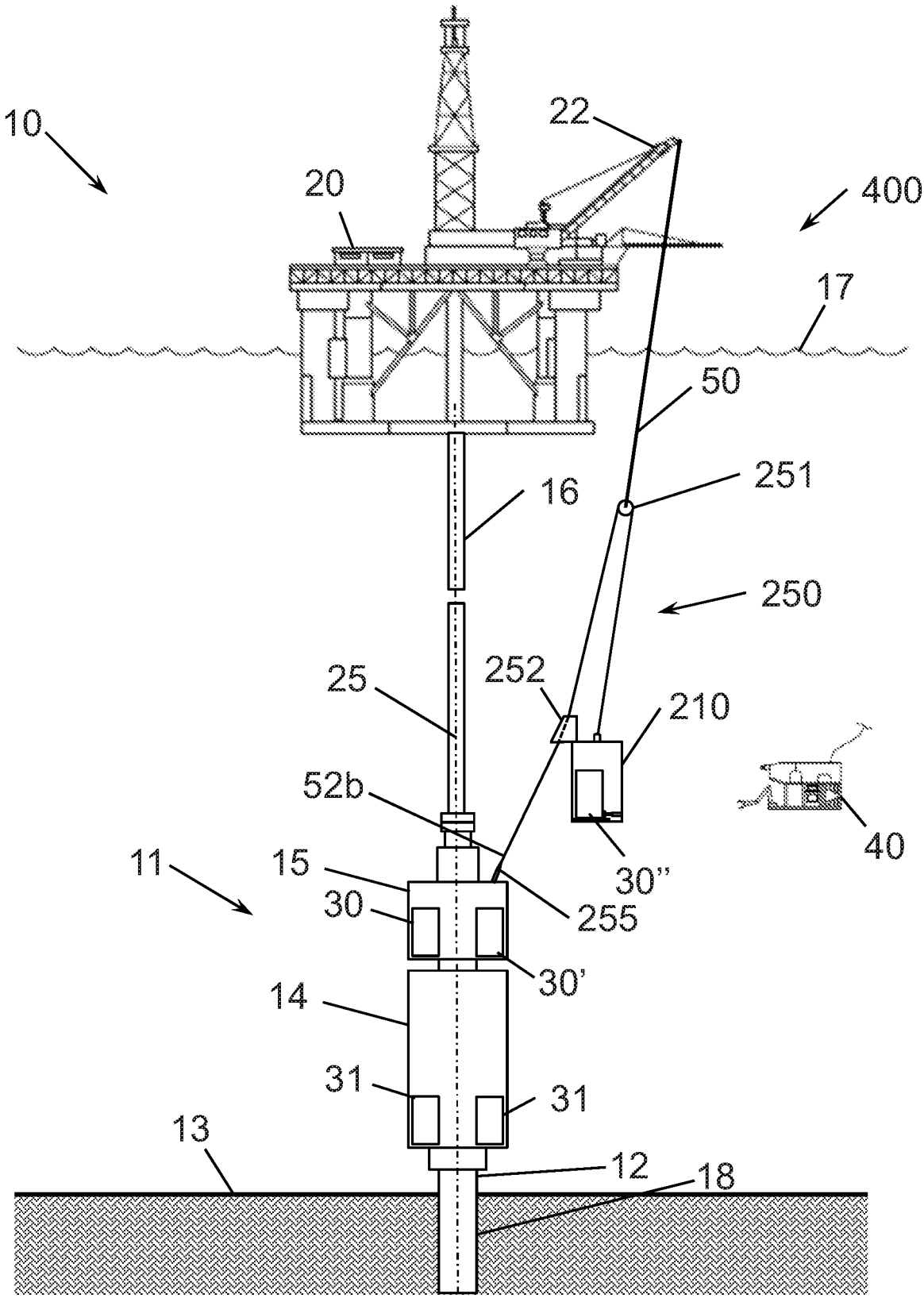
Figure 6C:
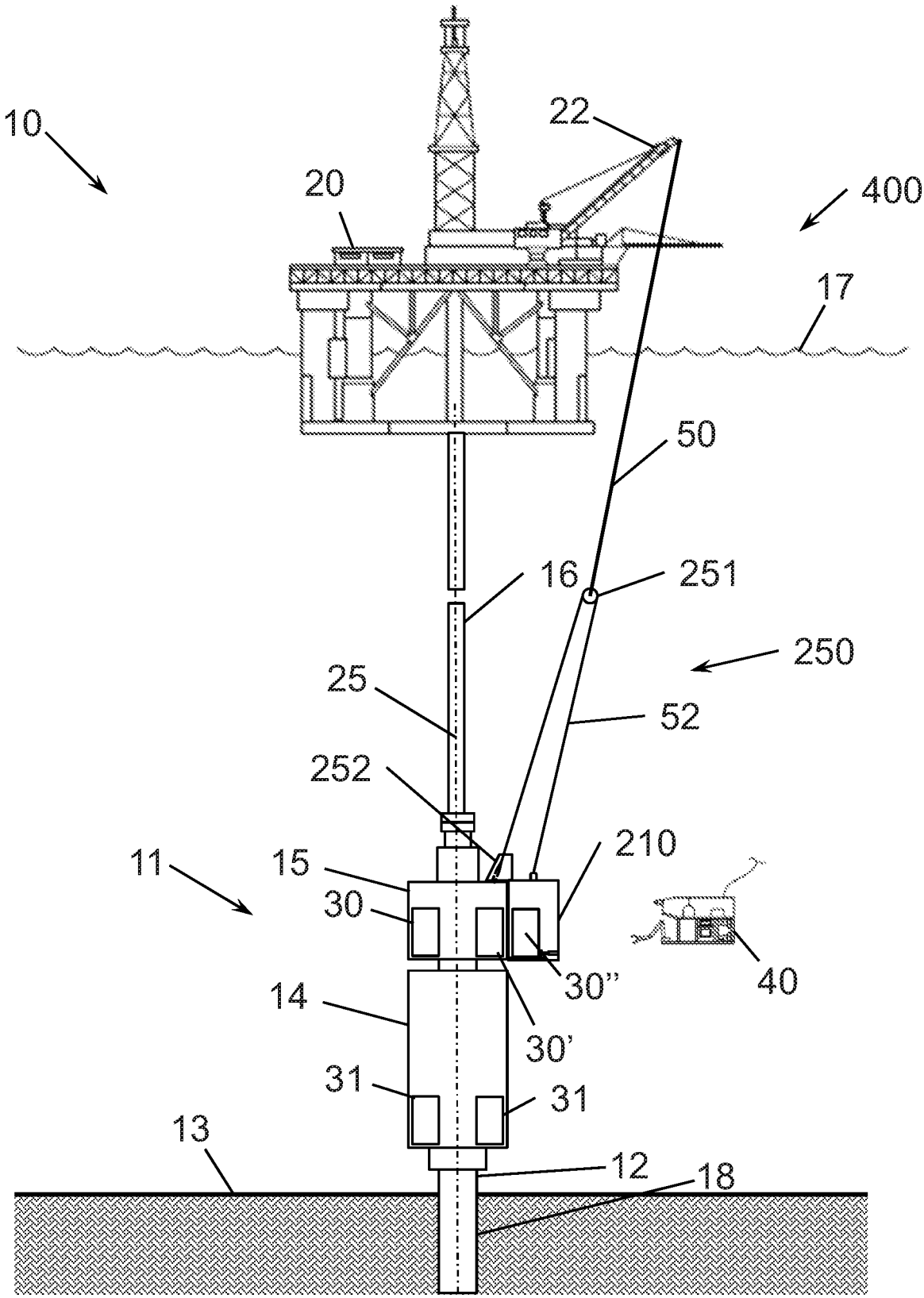

Referring still to FIGS. 6A-6E, an embodiment of a method for replacing control pod 30' with control pod 30" using system 400 will be described. In FIGS. 6A-6C, control pod 30" is shown being deployed subsea and moved to BOP stack 11; in FIGS. 6C and 6D, control pod 30' is shown being removed from BOP stack 11 and transferred to exchange device 210 while control pod 30" is transferred from exchange device 210 to BOP stack 11 and installed on BOP stack 11; and in FIG. 6E, control pod 30' is shown being retrieved to the surface 17 and vessel 20.

Referring first to FIGS. 6A and 6B, control pod 30" is disposed within exchange device 210 on vessel 20. In particular, pod 30" is positioned on one of the supports 232*a*, 232*b* within housing 211. The support 232*a*, 232*b* on which pod 30" is disposed is preferably aligned with middle bay 212*b* to balance the weight of device 210 with pod 30" therein. Next, lifting device 22 raises sheave 251 to lift device 210 from vessel 20, and then lowers sheave 251 to lower device 210 (carrying pod 30") subsea. Rope 52 extends over sheave 251 with end 52*b* attached to the tip of spear 55, which in turn is coupled to BOP stack 11, and the other end 52*a* attached to exchange device 210. Consequently, rope 52 remains in tension as sheave 251 is lowered subsea with lifting device 22 (the weight of exchange device 210 continuously pulls on rope 52). As shown in FIG. 6B, lifting device 22 continues to lower sheave 251 to lower exchange device 210 towards BOP stack 11. In essence, as sheave 251 is lowered by lifting device 22, exchange device 210 is controllably lowered under its own weight. Rope 52 passes through guide passage 253, and thus, as exchange device 210 is lowered, guide member 252 slides along rope 52 toward end 52*a*. Guide member 252 is attached to exchange device 210, and thus, as guide member 252 moves along rope 52, exchange device 210 also moves toward BOP stack 11. As best shown in FIG. 6C, spear 55 is attached to BOP stack 11 at a particular position that enables alignment of exchange device 210 and BOP stack 11. As exchange device 210 is lowered to BOP stack 11, the lower portion of passage 253 slidingly receives spear 255, thereby guiding exchange device 210 to the desired positions relative to BOP stack 11. Thus, the funnel at the lower portion of passage 253 and spear 255 enable alignment of exchange device 210 relative to BOP stack 11, thereby allowing guide member 252 to mate and engage with the BOP stack 11 (e.g., the outer frame of the BOP stack 11) with middle bay 212*b* aligned with and adjacent to the control pod 30' to be replaced.

Figure 6D:
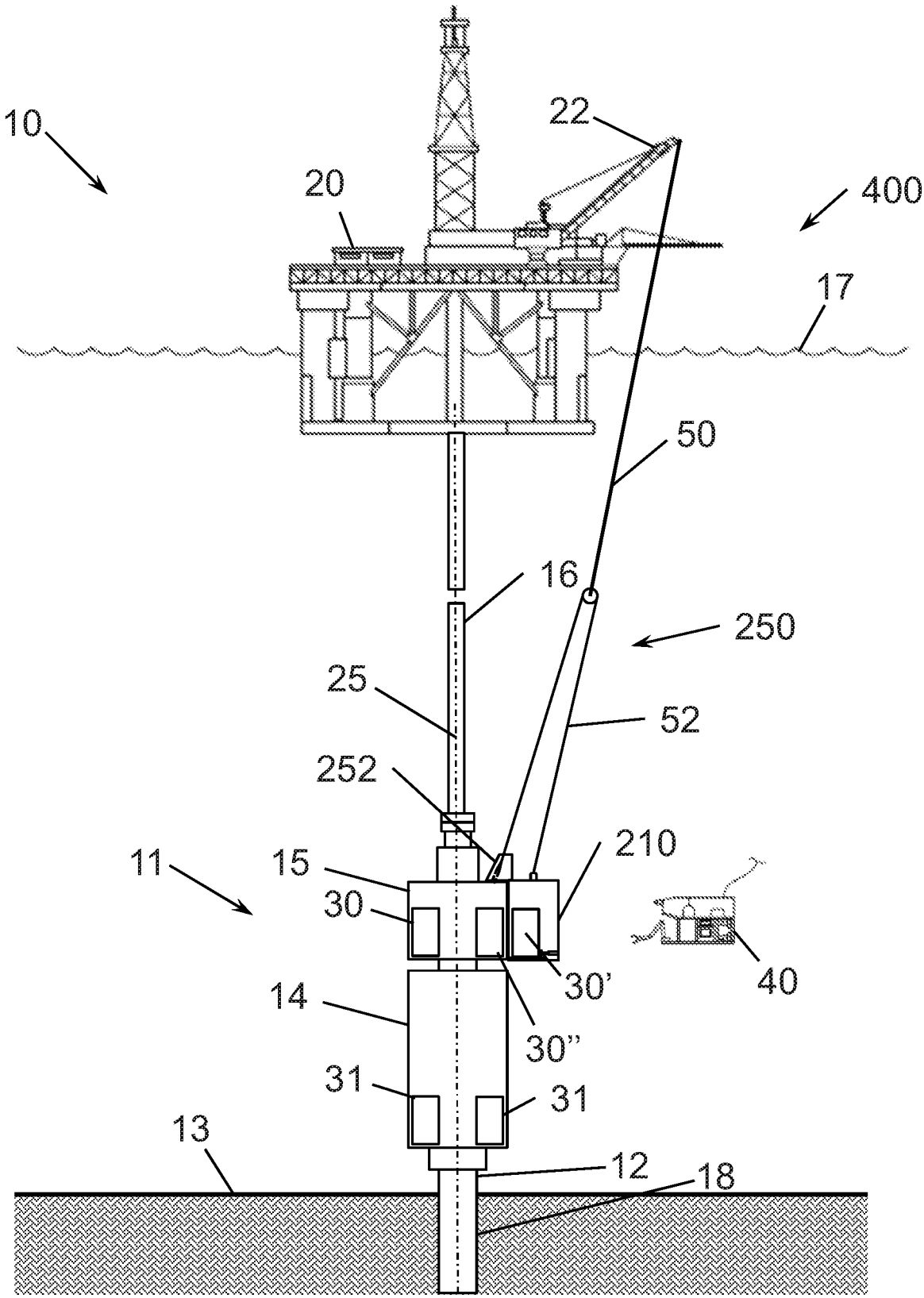

As shown in FIGS. 6C and 6D, with device 210 coupled to BOP stack 11 with middle bay 212*b* aligned with and adjacent the control pod 30', pod 30' is removed from BOP stack 11 and then pod 30" is installed in BOP stack 11 (i.e., pod 30' is replaced with pod 30"). In this embodiment, exchange device 210 replaces pod 30' with pod 30" in the same manner as previously described and shown in FIGS. 3D-3K. Since guide member 252 mates and engages BOP stack 11 in this embodiment, slack can be provided in rope 52 as BOP stack 11 supports and maintains the position of guide member 252 and exchange device 210 attached thereto.

Figure 6E:
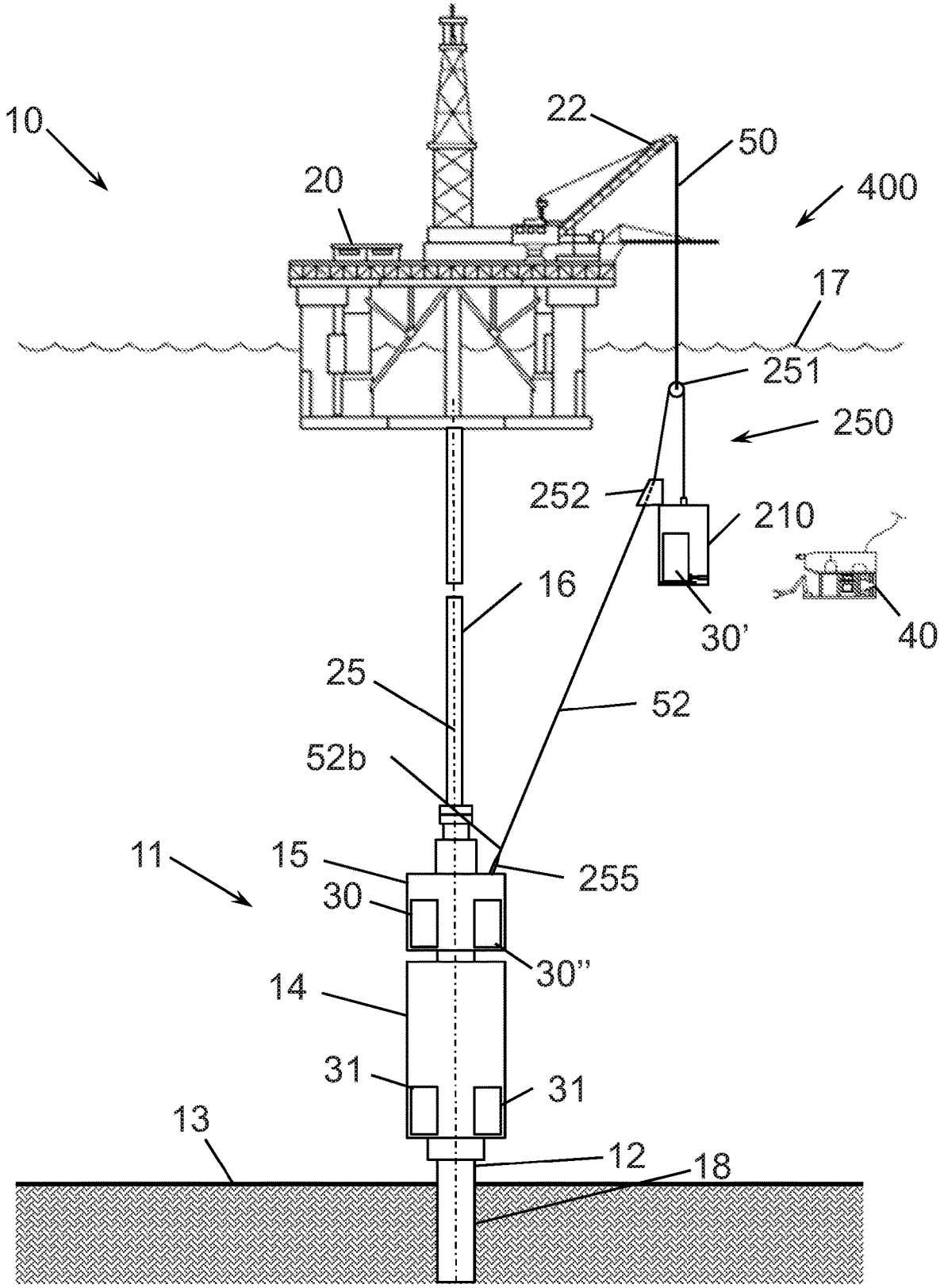

Moving now to FIGS. 6D and 6E, after swapping pods 30', 30", sheave 251 is raised with lifting device 22 to apply and/or increase tension in rope 52, and lift guide member 252 and exchange device 210 from BOP stack 11. Sheave 251 is raised by lifting device 22 to lift exchange device 210 and pod 30" to the surface 17 and vessel 20. Once exchange device 210 (carrying pod 30") is disposed on vessel 20, end 52*b* of rope 52 can be decoupled from BOP stack 11 with ROV 40.

In the manner described and shown in FIGS. 6A-6E, system 400 can be used to deploy control pod 30", exchange or swap control pods 30', 30" at BOP stack 11, and retrieve control pod 30' to the surface 17 in a single subsea trip. During deployment of pod 30" and retrieval of pod 30', lifting device 22 is used to lower and raise exchange device 210, respectively, while guide member 252 simultaneously slides along rope 52 to move exchange device laterally to and from BOP stack 11. In addition, ROV 40 can be used to guide and/or monitor exchange device 210 (and pod 30', pod 30" disposed thereon) as it is lifted, lowered, or otherwise moved subsea. However, it should be appreciated that during deployment of pod 30", exchanging of pods 30', 30" at BOP stack 11, and retrieval of pod 30', the weight of exchange device 210 (and any pod 30', 30" thereon) is supported by rope 50 and rope 52, thereby reducing the payload lifting requirements for ROV 40.

Referring now to FIGS. 7A-7J, an embodiment of a system 500 for retrieving a failed or faulty control pod 30', and replacing it with a replacement control pod 30" is schematically shown. More specifically, in FIGS. 7A-7E, system 500 is shown delivering replacement control pod 30" subsea to BOP stack 11; in FIGS. 7E and 7F, system 500 is shown removing the failed or faulty control pod 30' from BOP stack 11 and replacing it with control pod 30"; and in FIGS. 7G-7J, system 500 is shown retrieving control pod 30' to vessel 20 at the surface 17.

In this embodiment, system 500 includes lifting device 22 mounted to surface vessel 20, rigging 50 coupled to lifting device 22, control pod exchange device 210, and a BOP stack connection assembly 260 coupled to device 210. Lifting device 22, rigging 50, and exchange device 210 are each as previously described, however, BOP stack connection assembly 260 is different than connection assemblies 220, 230, 240, 250 previously described.

Figure 8A:
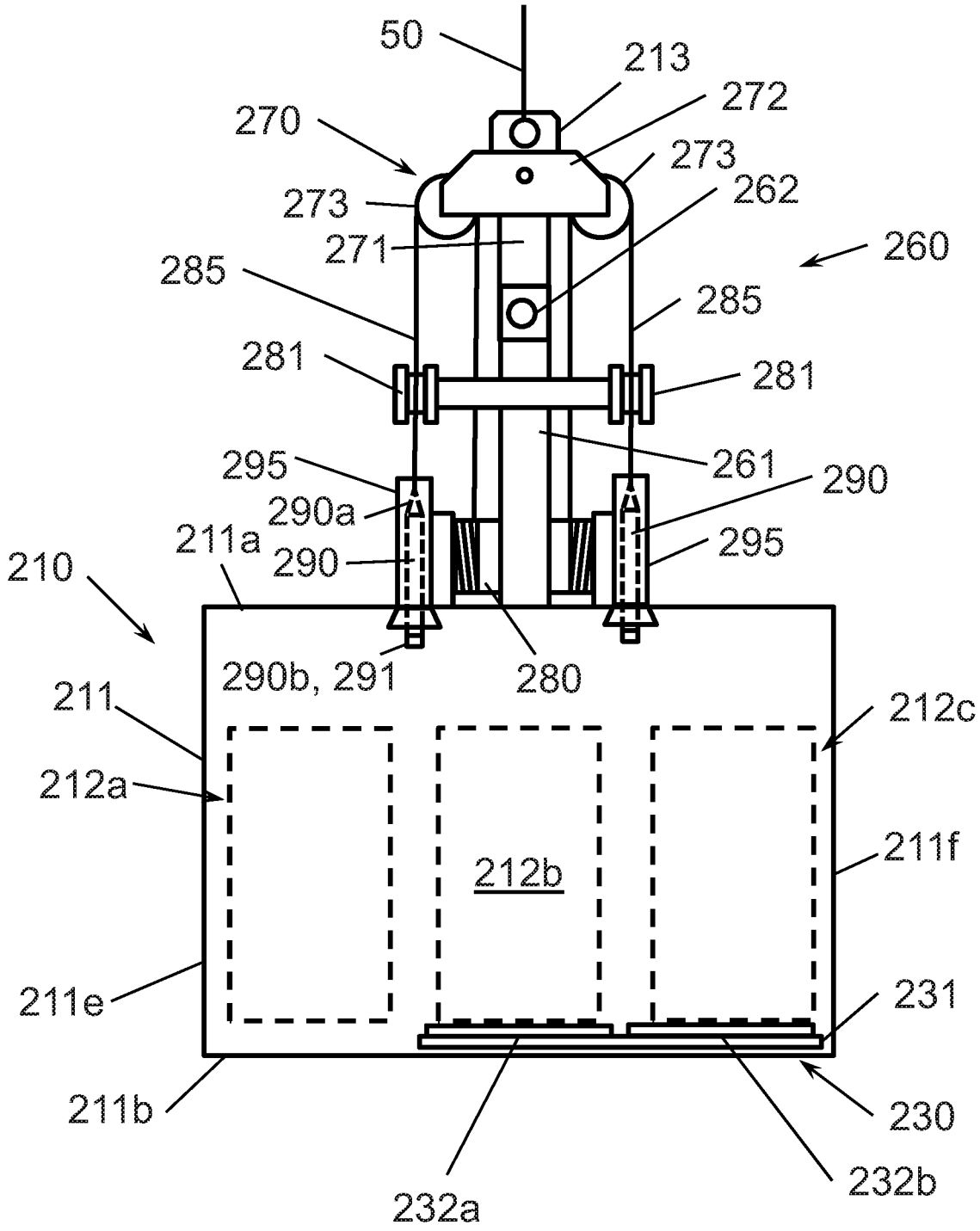
FIGS. 8A and 8B are schematic front and side views, respectively, of the BOP stack connection assembly of FIGS. 7A-7J.
Figure 8B:
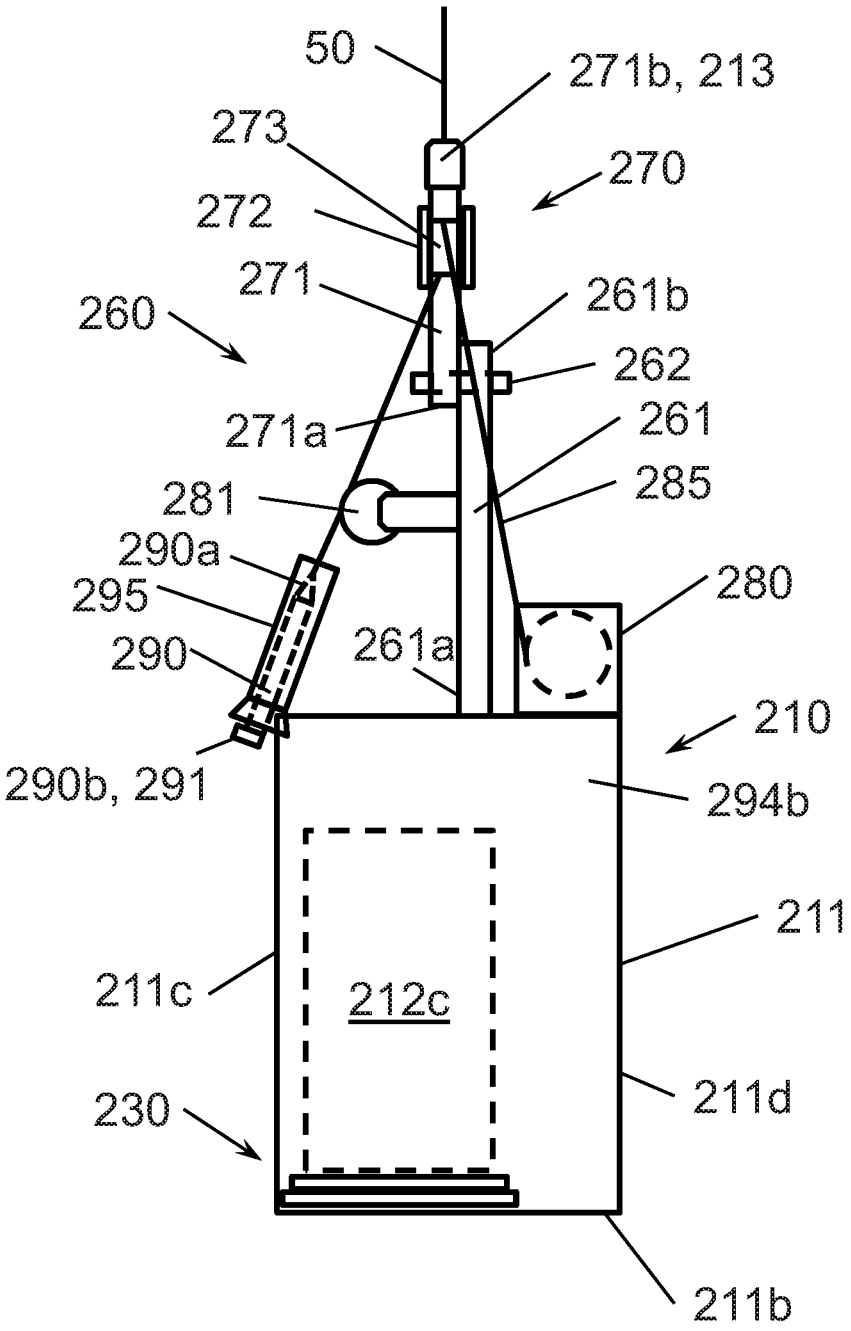

Referring briefly to FIGS. 8A and 8B, BOP stack connection assembly 260 releasably couples control pod exchange device 210 to BOP stack 11, controllably lowers and raises control pod exchange device 210 to and from BOP stack 11, and guides control pod exchange device 210 as it moves to and from BOP stack 11. In this embodiment, BOP stack connection assembly 260 includes a housing connector 261 coupled to the top 211*a* of housing 211, a connection assembly 270 releasably connected to housing connector 261, a winch 280 coupled to the top 211*a* of housing 211, a first pair of sheaves 281 rotatably coupled to housing 211 and connector 261, a second pair of sheaves 282 rotatably coupled to housing 211 and connector 261, a pair of BOP stack connection members 290, a pair of tubular guides 295 coupled to housing 211, and a pair of ropes 285 extending from winch 280 to stack connection members 290. Guides 295 are positioned proximal the top 211*a* and the front 211*c* of housing 211. As will be described in more detail below, the forward lower ends of guides 295 comprise funnels that function to slidingly receive and guide connection members 290 into guides 295. In this embodiment, connection assembly 270 is releasably coupled to housing connector 261, and hence housing 211, with a pin 262. However, in other embodiments, the connection assembly (e.g., assembly 270) can be releasably coupled to housing connector (e.g., housing connector 261) and housing (e.g., housing 211) by other mechanisms or devices such as a ratcheting mechanism.

Housing connector 261 is a rigid structure extending vertically upward from the top 211*a* of housing 211. In particular, housing connector 261 has a lower end 261*a* fixably secured to housing 211 and an upper end 261*b* distal housing 211. Upper end 261*b* includes a through bore that slidingly receives pin 262.

Referring still to FIGS. 8A and 8B, connection assembly 270 releasably couples housing connector 261 and exchange device 210 to rigging 50. In this embodiment, connection assembly 270 includes a base member 271, a sheave support 272 pivotally coupled to base member 271, and a pair of laterally spaced sheaves 273 rotatably coupled to support 272 on opposite lateral sides of base member 271 in front view (FIG. 8A). Base member 271 is a rigid structure having a lower end 271*a* pivotally coupled to housing connector 261 with pin 262 and an upper end 271*b* comprising a connector 213. Lower end 271*a* includes a through bore that slidingly receives pin 262, thereby pivotally and releasably coupling base member 271 to housing connector 261. Connector 213 couples connection assembly 270, housing connector 261, and exchange device 210 to rigging 50. As will be described in more detail below, each rope 285 extends from winch 280 over one sheave 273, over one sheave 281, and through one guide 295 to the corresponding connection member 290.

Referring still to FIGS. 8A and 8B, BOP stack connection members 290 releasably couples connection assembly 270 and exchange device 210 to BOP stack 11, and guide exchange device 210 such that bay 212*b* is aligned with and adjacent to control pod 30'. In this embodiment, each connection member 290 is an elongate stabbing spear having a first or upper end 290*a* and a second or lower end 290*b*. Lower end 290*b* is provided with a foot 291 sized and shaped to releasably engage a mating profile on BOP stack 11. One end of each rope 285 is mounted to winch 280 and the opposite end of each rope 285 is attached to upper end 290*a* of one connection member 290*g*.

Connection members 290 are movably coupled to exchange device 210 with ropes 285 and winch 280. More specifically, when connection members 290 are disposed in guides 295, ropes 285 can be paid out from winch 280 to allow connection members 290 to slide downward out of guides 295, thereby enabling BOP stack connection members 290 to be controllably lowered from exchange device 210; and when connection members 290 are spaced apart from exchange device 210, ropes 285 can be paid in to winch 280 to pull connection members 290 upward toward exchange device 210 and into guides 295

In the same manner as previously described with respect to system 200, control pod exchange device 210 delivers replacement pod 30" to BOP stack 11, automates the exchange of pods 30', 30" (i.e., removes pod 30' from stack 11 and installs pod 30" in stack 11), and delivers pod 30' to the surface 17. However, in this embodiment, assembly 260 facilitates the alignment of device 210 relative to BOP stack 11, the coupling of device 210 to BOP stack 11 such that pods 30', 30" can be exchanged, and the movement of device 210 to and away from BOP stack 11.

Referring again to FIGS. 7A-7J, an embodiment of a method for replacing control pod 30' with control pod 30" using system 500 will be described. In FIGS. 7A-7D, control pod 30" is shown being deployed subsea and moved to BOP stack 11; in FIGS. 7E and 7F, control pod 30' is shown being removed from BOP stack 11 and transferred to exchange device 210 while control pod 30" is transferred from exchange device 210 to BOP stack 11 and installed on BOP stack 11; and in FIG. 7G-7J, control pod 30' is shown being retrieved to the surface 17 and vessel 20.

Figure 7A:
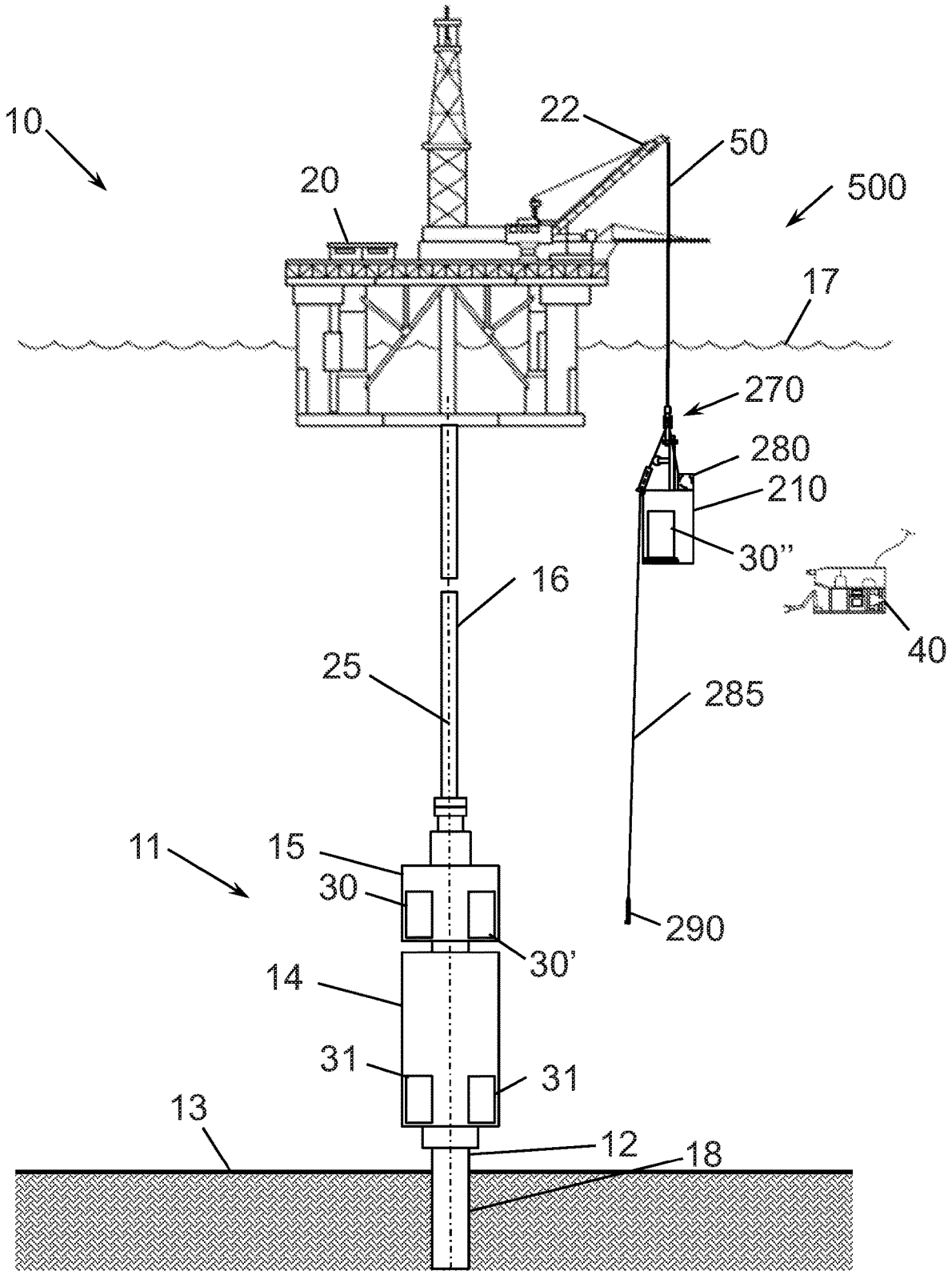
FIGS. 7A-7J are schematic views of an embodiment of a system and associated method in accordance with the principles described herein for replacing a control pod of the offshore system of FIG. 1.

Referring first to FIG. 7A, control pod 30" is disposed within exchange device 210 on vessel 20. In particular, pod 30" is positioned on one of the supports 232*a*, 232*b* within housing 211, and the free end 50*a* of rope 50 is attached to connector 213 on vessel 20. The support 232*a*, 232*b* on which pod 30" is disposed is preferably aligned with middle bay 212*b* to balance the weight of device 210 with pod 30" therein. In addition, connection assembly 270 is pivotally coupled to housing connector 261, and hence exchange device 210, with pin 262. Next, lifting device 22 lowers exchange device 210 (carrying pod 30") subsea via rope 50 and connection assembly 270. As shown in FIG. 7A, ropes 285 are paid out from winch 280 at the surface 17 such that stack connection members 290 hang from exchange device 210.

Figure 7B:
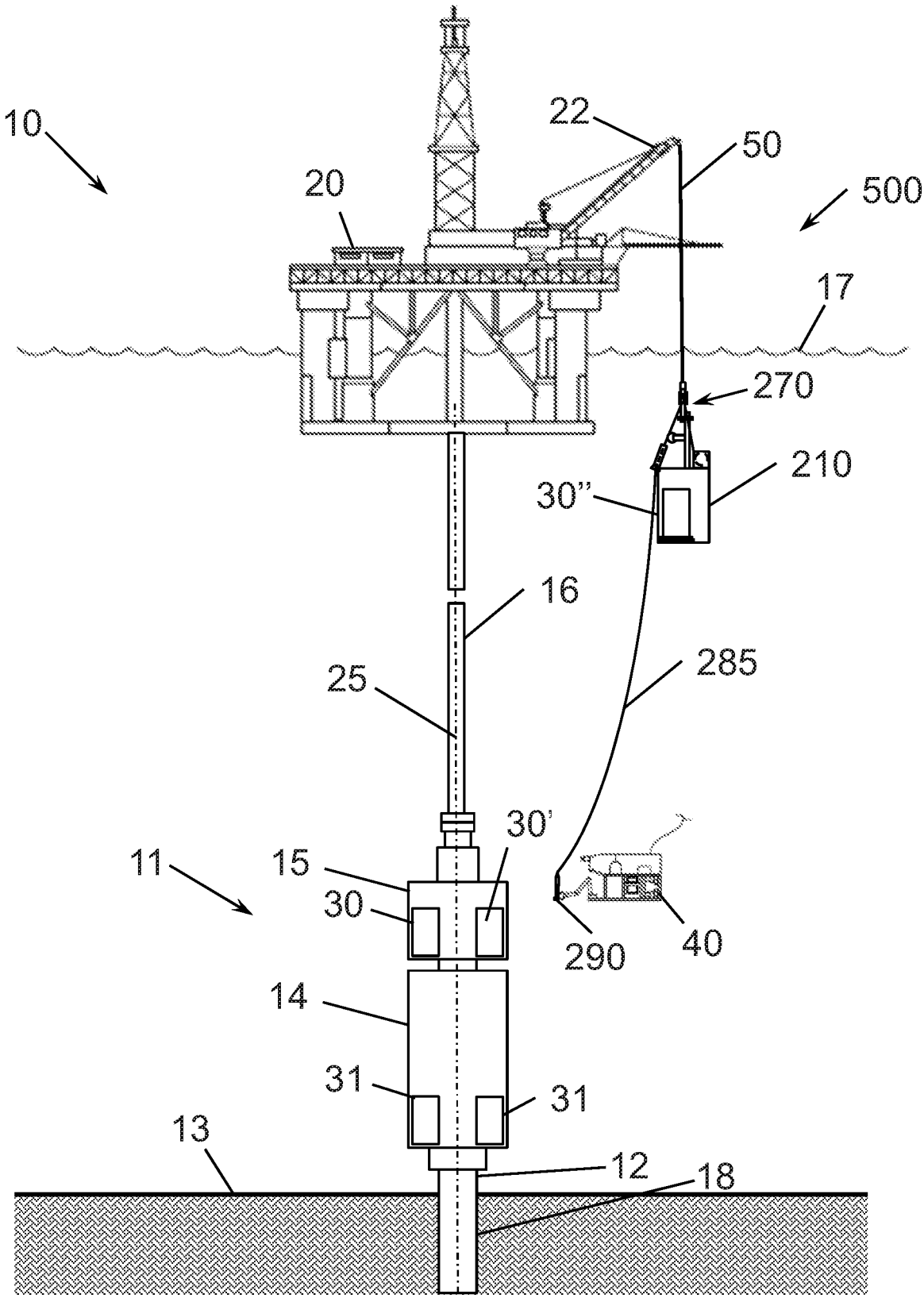

Moving now to FIG. 7B, ropes 285 are paid out from winch 280 at the surface 17 such that connection members 290 are lowered to a depth equal to or greater than the depth of control pod 30' as exchange device 210 is lowered subsea with lifting device 22. Next, stack connection members 290 are attached to BOP stack 11 with ROV 40. Feet 291 are sized, shaped, and positioned to mate and engage with BOP stack 11, while simultaneously aligning bay 212*b* with pod 30' when received by guides 295 upon arrival of exchange device 210.

Figure 7C:
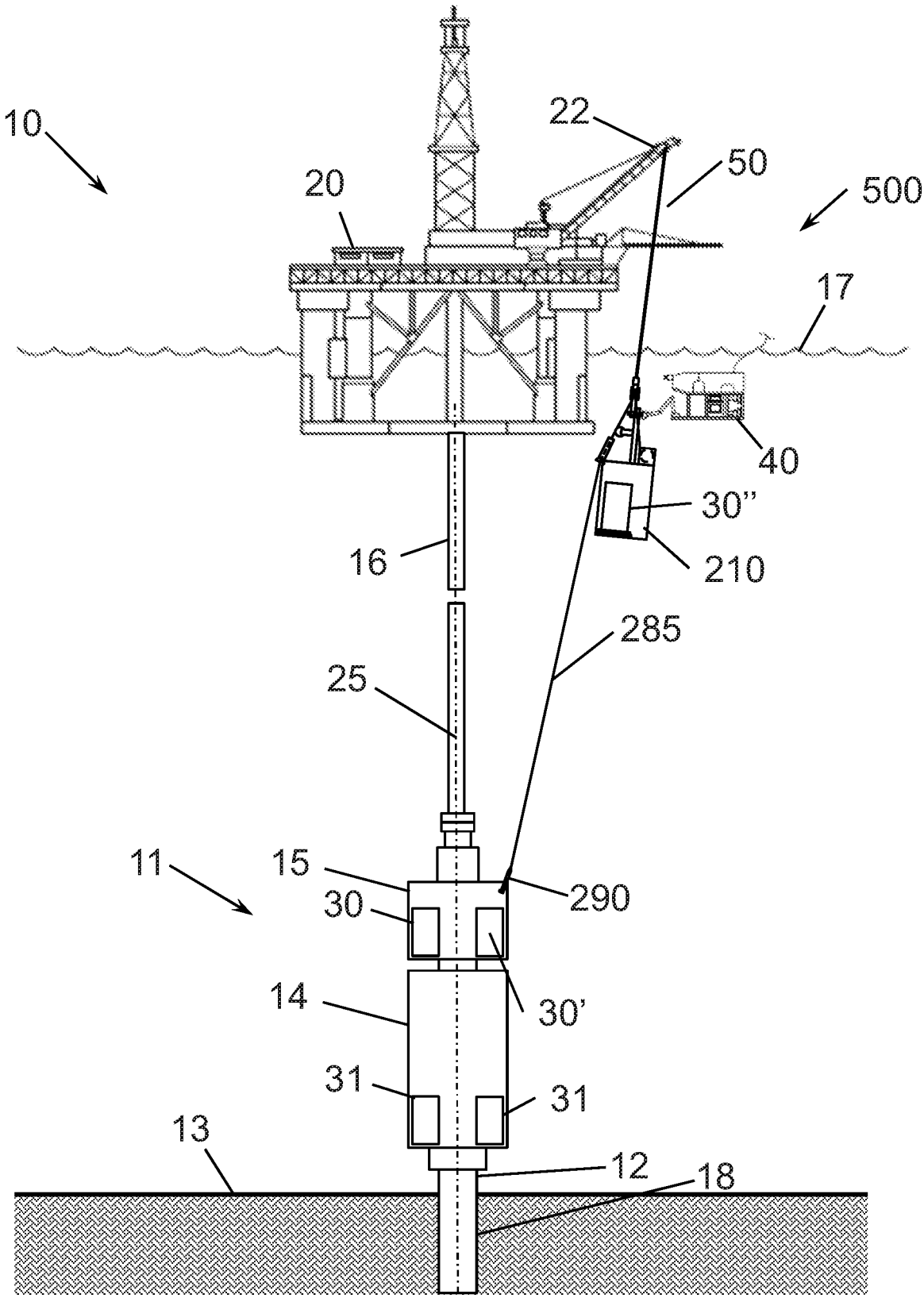

Referring now to FIG. 7C, once stack connection members 290 are secured to BOP stack 11, lifting device 22 pays in rope 50 to pull any slack from ropes 285 and place ropes 285 in tension. Next, ROV 40 pulls pin 262 from base member 271 and housing connector 261, thereby decoupling exchange device 210 from connection assembly 270 so that exchange device 210 can be lowered to BOP stack 11. To enable ROV 40 to easily remove pin 262 from the throughbores in member 271 and connector 261, the shear loads acting on pin 262 by member 271 and connector 261 are preferably eliminated.

Figure 8C:
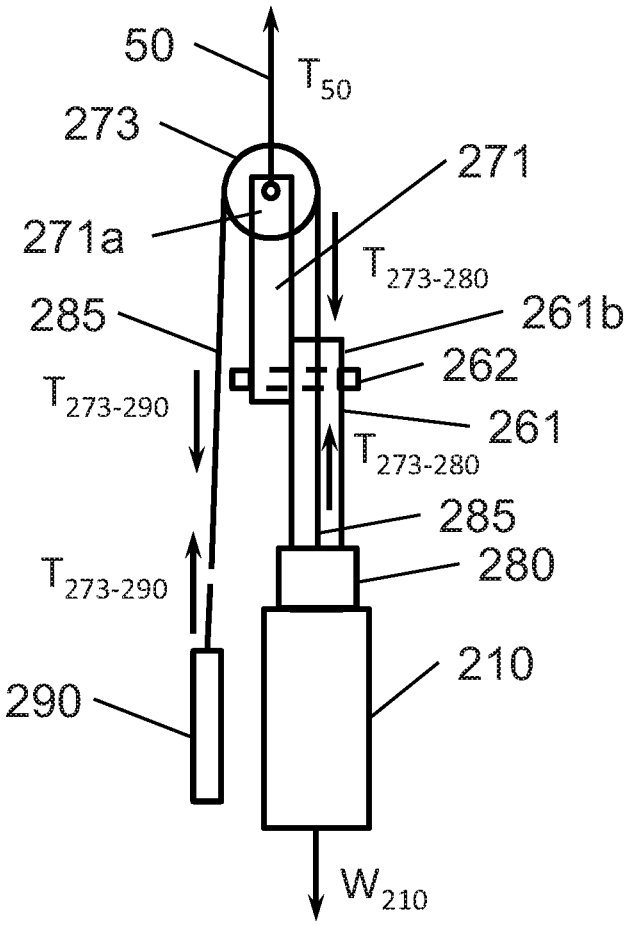
FIG. 8C is a schematic view of the forces applied to the pin of FIGS. 8A and 8B under static conditions.

Referring briefly to FIG. 8C, a schematic free body diagram of the forces acting on pin 262 under static conditions are shown. For purposes of clarity and simplicity, sheaves 273, ropes 285, and connection members 290 are represented by a single sheave 273, a single rope 285, and a single connection member 290, respectively, in FIG. 7C. The weight of exchange device 210 (including any pod 30 disposed thereon) is represented with reference numeral "$W_{210}$," the tension in rope 50 is represented with reference numeral "$T_{50}$," the tension in the portion of rope 285 extending between sheave 273 and stack connection member 290 is represented with reference numeral "$T_{273\text{-}290}$," and the tension in the portion of rope 285 extending between sheave 273 and winch 280 is represented with reference numeral "$T_{273\text{-}280}$."

Under static conditions, when there is no tension in rope 285 (i.e., $T_{273\text{-}280}=0$ and $T_{273\text{-}290}=0$), the forces applied to pin 262 include the weight $W_{210}$ acting through connector 261 and the tension $T_{50}$ acting through member 271. In such case, the downward force acting on pin 262 through connector 261 due to the weight $W_{210}$ is laterally spaced from and opposed by the upward force acting on pin 262 through member 271 due to tension $T_{50}$, thereby resulting in shear loads being applied to pin 262. However, with stack connection members 290 secured to BOP stack 11 and ropes 285 and rope 50 in tension, when the tension $T_{50}$ applied to rope 50 is equal to twice the weight $W_{210}$, the downward force acting on pin 262 due to weight $W_{210}$ goes to zero (the weight $W_{210}$ is offset and balanced by tension $T_{273\text{-}280}$) and the upward force acting on pin 262 due to tension $T_{50}$ goes to zero (the tension $T_{50}$ is offset and balanced by tensions $T_{273\text{-}280}$, $T_{273\text{-}290}$). When tension is applied to rope 285 and assuming static conditions, $T_{50}=T_{273\text{-}290}+W_{210}$, and thus, when $T_{273\text{-}290}=W_{210}$, tension $T_{50}=2*W_{210}$. Thus, when lifting device 22 increases the tension in rope 285 (i.e., tension $T_{273\text{-}290}$, which equals tension $T_{273\text{-}290}$) to the weight $W_{210}$, pin 262 is no longer in shear and can be pull with ROV 40, and the tension in rope 50 (i.e., tension $T_{50}$) will be twice the weight $W_{210}$.

Referring still to FIG. 7C, the foregoing relationships between the tension in rope 50, the tension in ropes 285, and the weight of exchange device 210 can be utilized to control and time the removal of pin 262 with ROV 40. Namely, once stack connection members 290 is secured to BOP stack 11, lifting device 22 is operated to pay in rope 50 until the tension in rope 50 (measured at lifting device 22) is twice the weight of exchange device 210, at which point—pin 262 is no longer in shear and ROV 40 can remove pin 262.

Figure 7D:
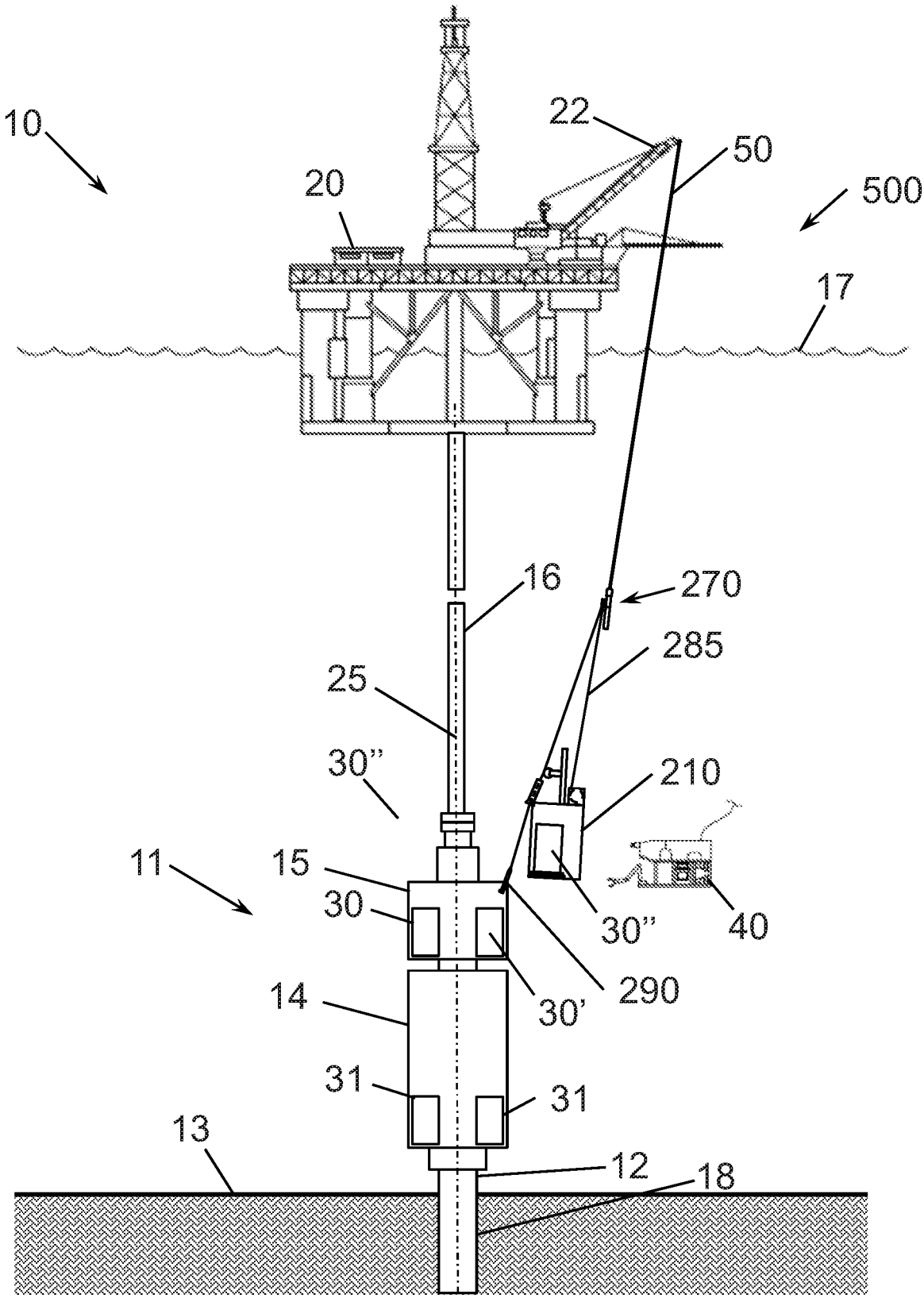
Figure 7E:
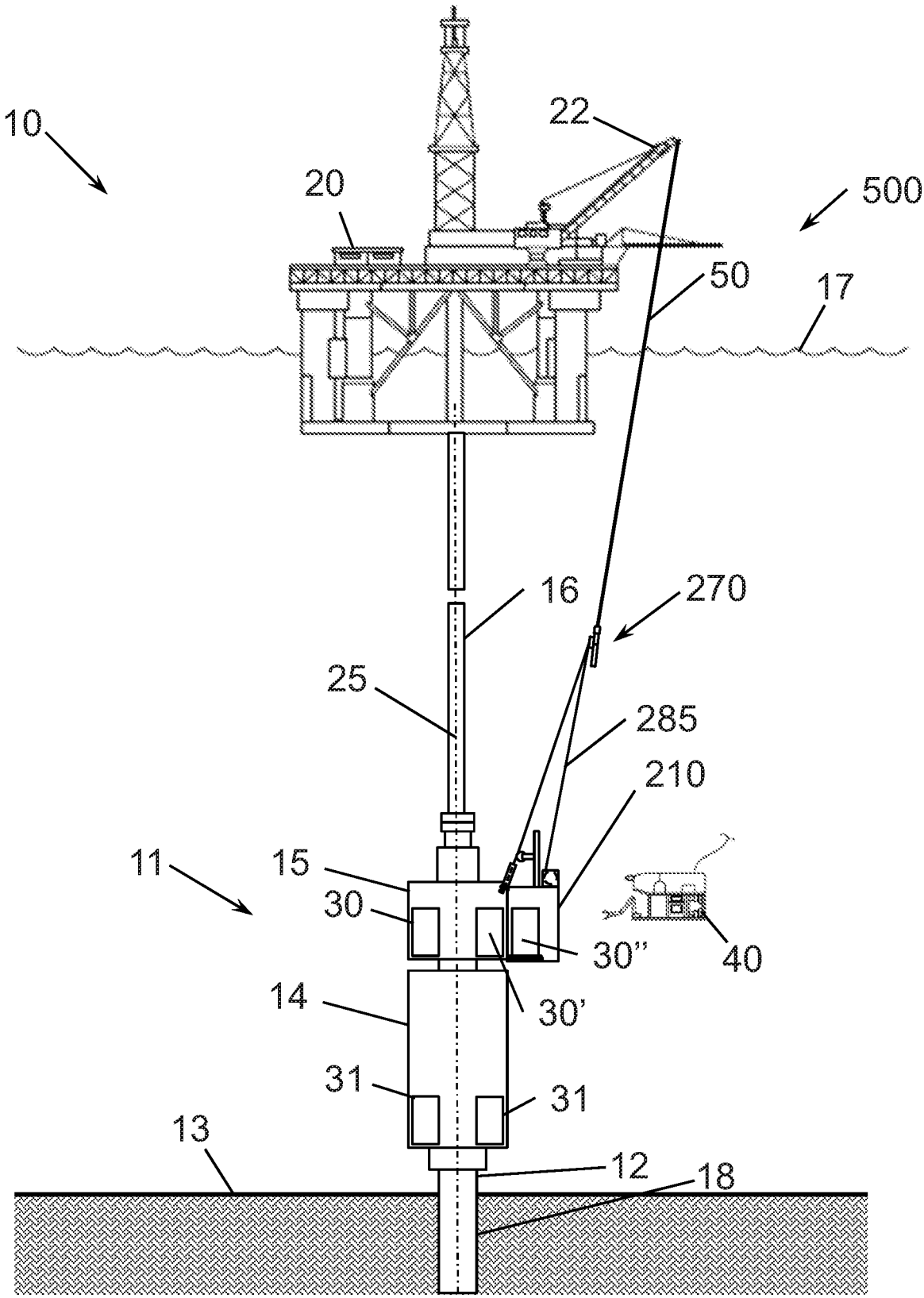

Moving now to FIGS. 7D and 7E, upon removal of pin 262, exchange device 210 is decoupled from connection assembly 270 and is lowered by paying out rope 50 from lifting device 22. As rope 50 is paid out, ropes 285 move around sheaves 273 as exchange device 210 slides along ropes 285 extending through guides 295 towards connection members 290 and BOP stack 11. As exchange device 210 approaches BOP stack 11, connection members 290 are slidingly received into guides 295, thereby aligning exchange device 210 in the desired position relative to BOP stack 11 (i.e., with bay 212*b* aligned with and adjacent to control pod 30').

As previously described, in this embodiment, pin 262 is removed by ROV 40 once the shear loads acting on pin 262 are sufficiently reduced and/or eliminated. However, in other embodiments, the pin (e.g., pin 262) may be biased out of the corresponding throughbores (e.g., spring loaded) such that the pin automatically moves out of the aligned throughbores once the the shear loads acting on pin 262 are sufficiently reduced and/or eliminated.

Figure 7F:
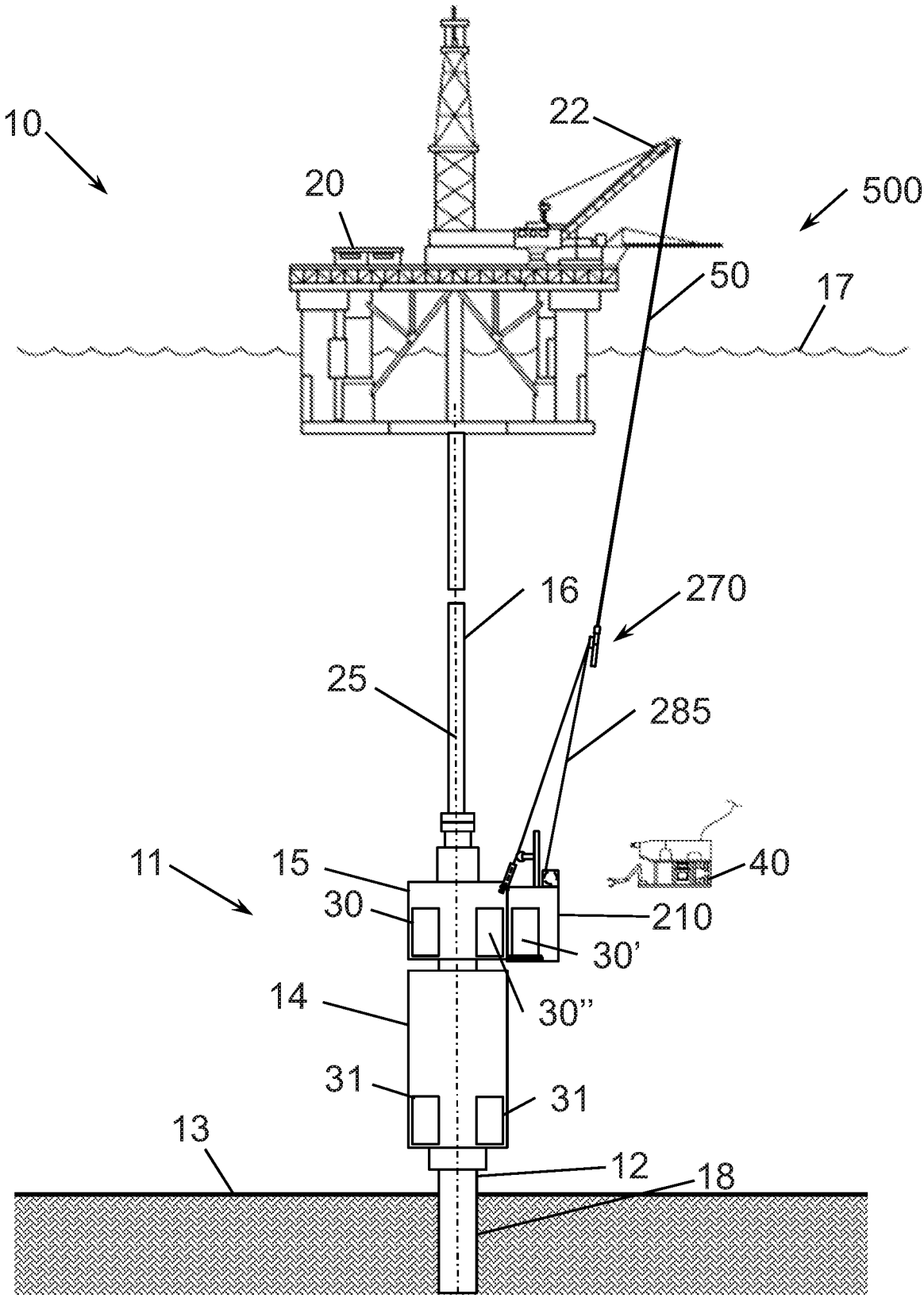

As shown in FIGS. 7E and 7F, with device 210 coupled to BOP stack 11 with middle bay 212*b* aligned with and adjacent the control pod 30', pod 30' is removed from BOP stack 11 and then pod 30" is installed in BOP stack 11 (i.e., pod 30' is replaced with pod 30"). In this embodiment, exchange device 210 replaces pod 30' with pod 30" in the same manner as previously described and shown in FIGS. 3D-3K.

Figure 7G:
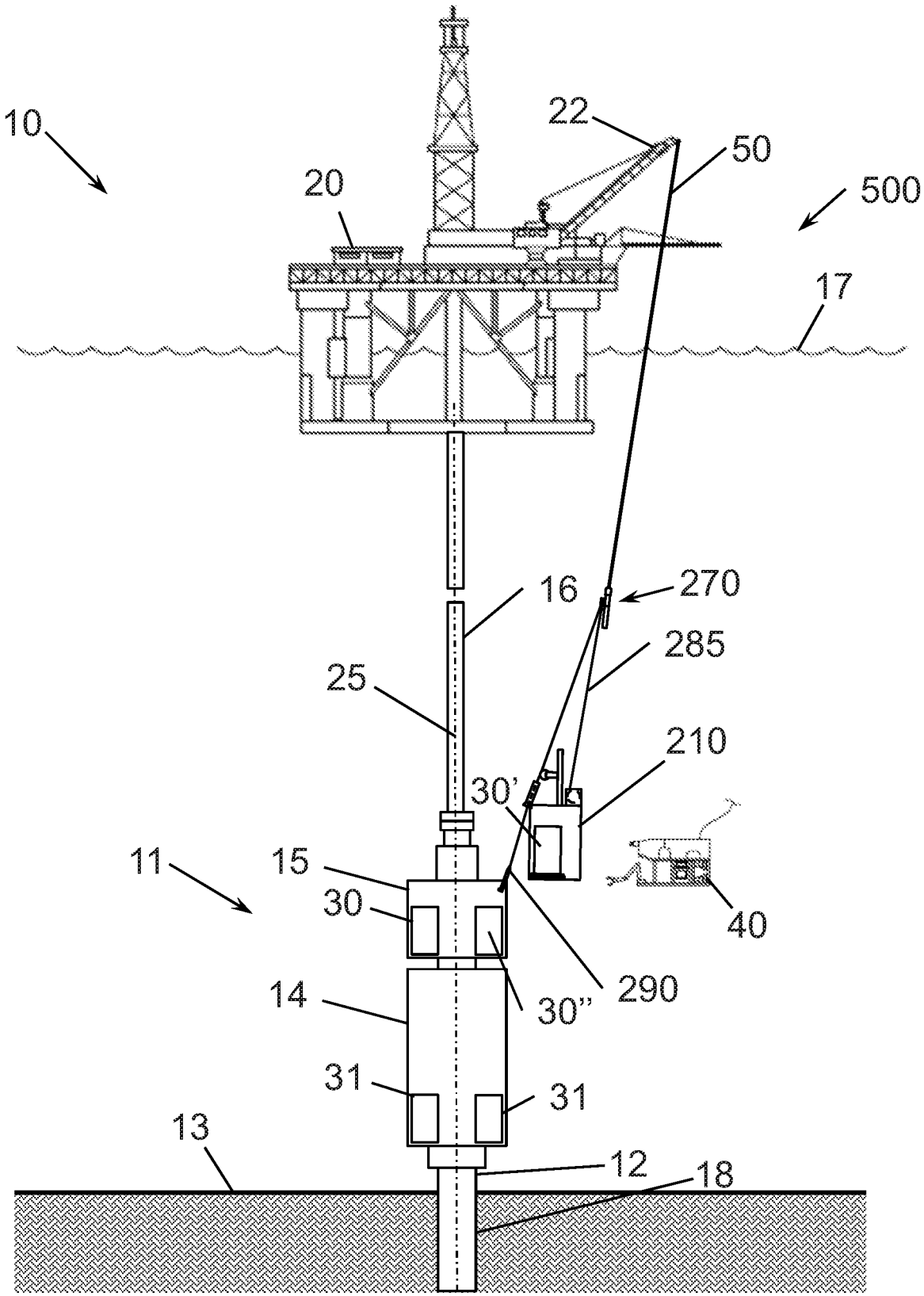
Figure 7H:
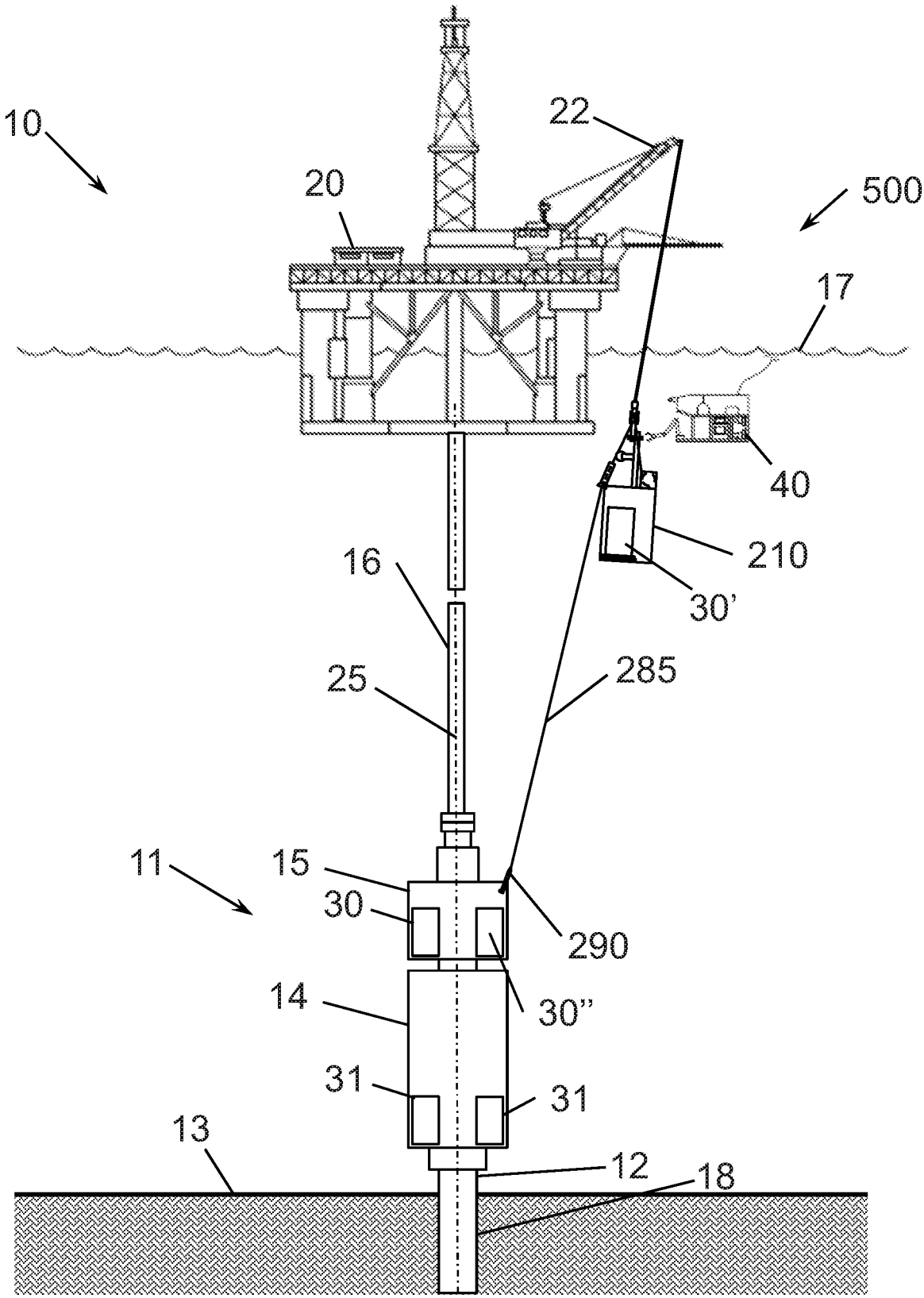

Referring now to FIGS. 7F-7H, after swapping pods 30', 30", exchange device 210 is lifted from BOP stack 11. In particular, lifting device 22 is operated to pay in rope 50, thereby pulling exchange device 210 upward toward the surface 17 and connection assembly 270. As rope 50 is paid in, ropes 285 move around sheaves 273 as exchange device 210 slides along ropes 285 extending through guides 295 away from stack connection members 290 and BOP stack 11. As shown in FIG. 7H, upon arrival at connection assembly 270, the throughbores in member 271 and connector 261 are aligned and ROV 40 inserts pin 262 therethrough, thereby pivotally coupling exchange device 210 and connection assembly 270.

Figure 7I:
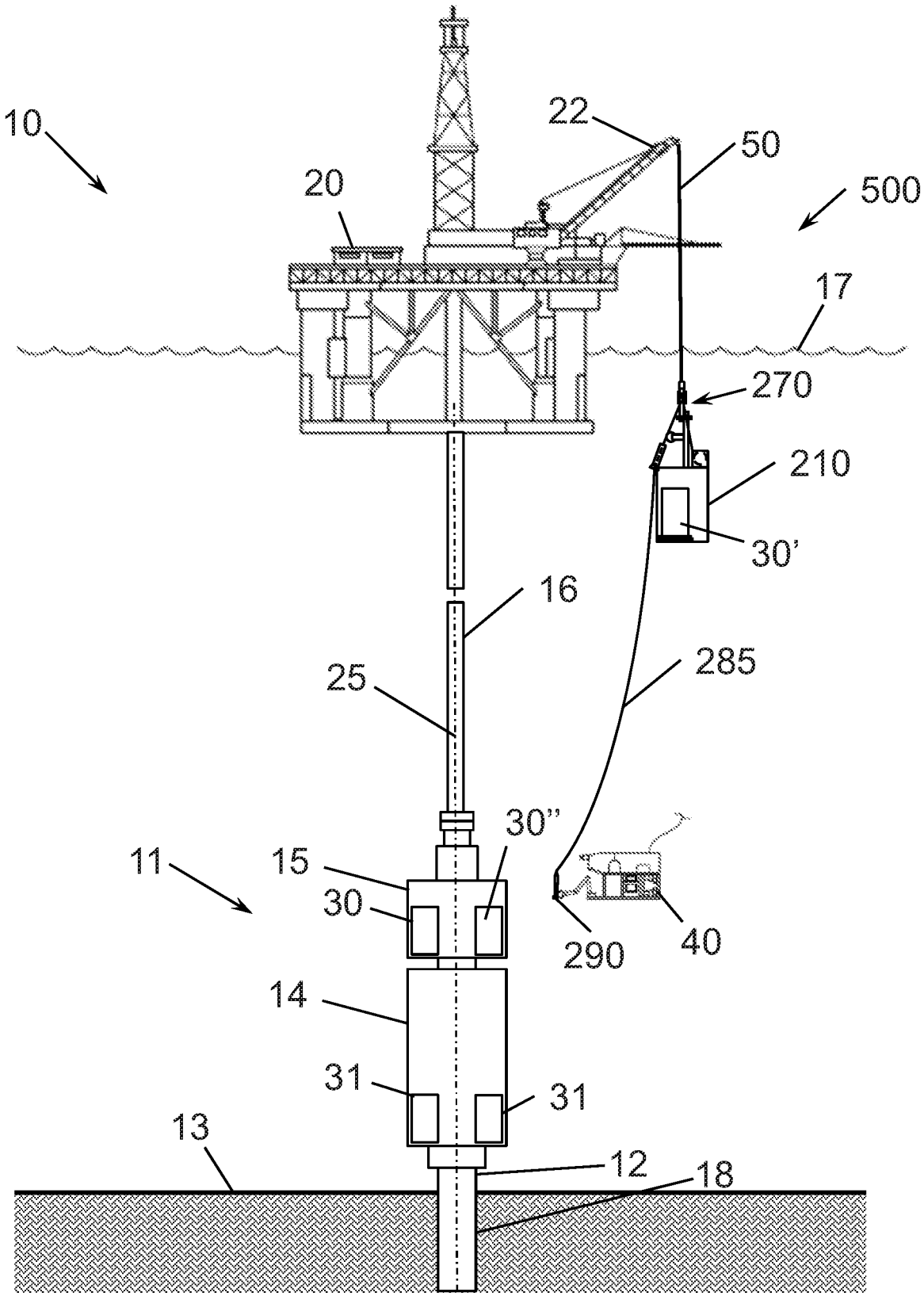
Figure 7J:
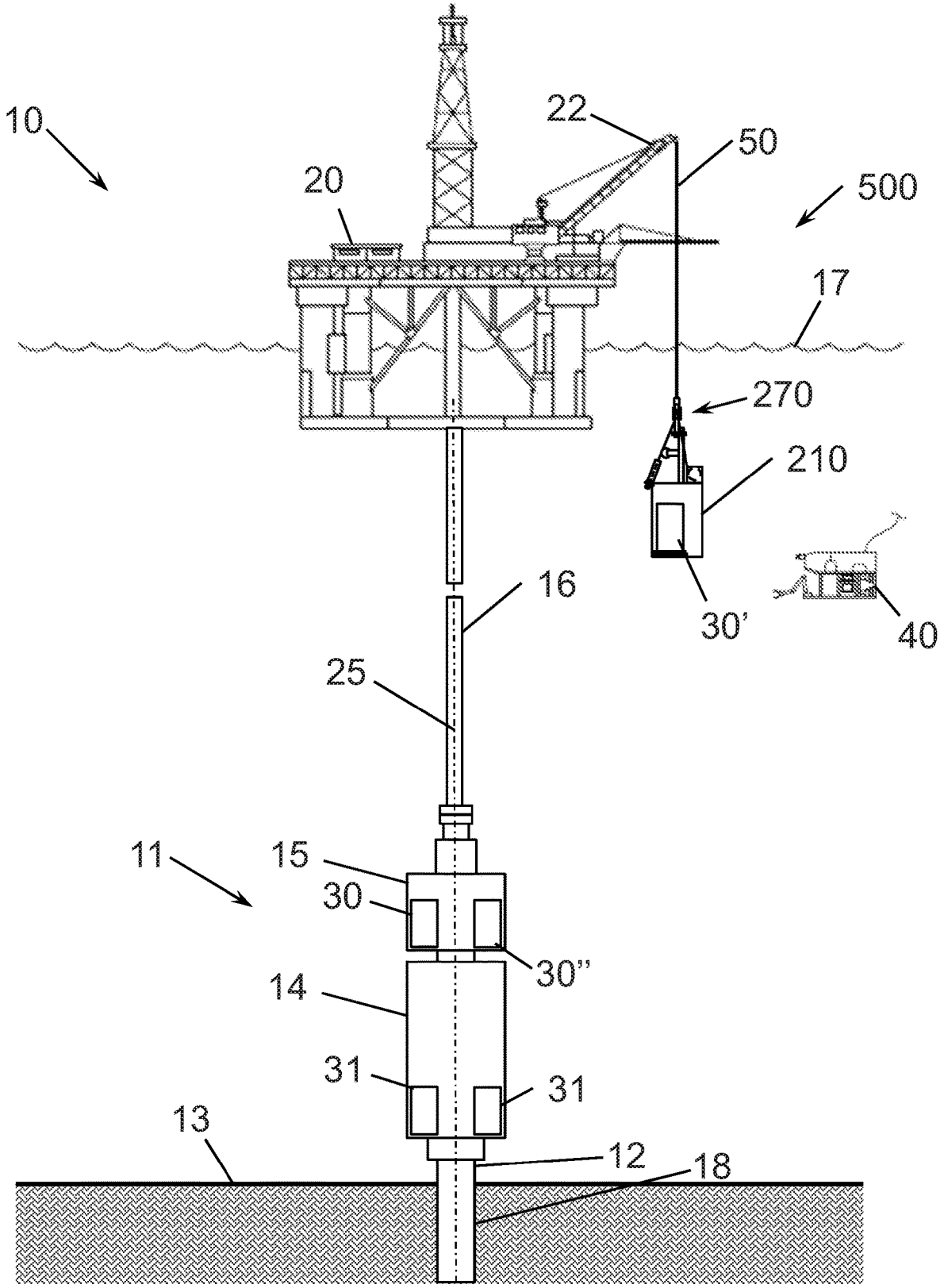

Moving now to FIGS. 7I and 7J, after coupling exchange device 210 and connection assembly 270, the weight of exchange device 210 is supported by rope 50 while lifting device 22 is operated to pay out rope 50, thereby removing any tension in ropes 285. Next, ROV 40 decouples stack connection members 290 from BOP stack 11. At this point, winch 280 can be operated to pay in ropes 285 and pull stack connection members 290 upward to exchange device 210, or alternatively, ropes 285 can be left hanging while exchange device 210. Lifting device 22 can then be used to lift exchange device 210 (carrying pod 30') to vessel 20 via rope 50 and connection assembly 270.

In the manner described and shown in FIGS. 7A-7I, system 500 can be used to deploy control pod 30", exchange or swap control pods 30', 30" at BOP stack 11, and retrieve control pod 30' to the surface 17 in a single subsea trip. During deployment of pod 30" and retrieval of pod 30', lifting device 22 pays out and pays in rope 50 to move exchange device 210 to and from BOP stack 11. Thus, in this embodiment, control over the deployment and retrieval of exchange device 210 is primarily controlled from the surface with lifting device 22. For example, winch 280 need not be operated to lower and raise exchange device 210 to and from, respectively, BOP stack 11. In addition, ROV 40 can be used to guide and/or monitor exchange device 210 (and pod 30', pod 30" disposed thereon) as it is lifted, lowered, or otherwise moved subsea. However, it should be appreciated that during deployment of pod 30", exchanging of pods 30', 30" at BOP stack 11, and retrieval of pod 30', the weight of exchange device 210 (and any pod 30', 30" thereon) is supported by rope 50 and/or ropes 285, thereby reducing the payload lifting requirements for ROV 40.

Referring now to FIGS. 9A-9J, an embodiment of a system 600 for retrieving a failed or faulty control pod 30', and replacing it with a replacement control pod 30" is schematically shown. More specifically, in FIGS. 9A-9E, system 600 is shown delivering replacement control pod 30" subsea to BOP stack 11; in FIGS. 9E and 9F, system 600 is shown removing the failed or faulty control pod 30' from BOP stack 11 and replacing it with control pod 30"; and in FIGS. 9G-9J, system 600 is shown retrieving control pod 30' to vessel 20 at the surface 17.

System 600 is similar to system 500 previously described with the exception that system 600 relies on a different lifting device mounted to surface vessel 20 to deploy and retrieve control pod exchange device 210. In this embodiment, the lifting device is an offset derrick 21' mounted to surface vessel 20 instead of lifting device 22 (e.g., a crane), and further, a pipe string 150 (e.g., a drill string) suspended from derrick 21' is used instead of rigging 50. Thus, in this embodiment, system 600 includes offset derrick 21' mounted to surface vessel 20, pipe string 150 suspended from derrick 21', control pod exchange device 210, and BOP stack connection assembly 260 coupled to device 210. Control pod exchange device 210 and BOP stack connection assembly 260 are each as previously described. Connector 213 of connection assembly 270 is releasably attached to the lower end of pipe string 150 (instead of the lower end of rigging 50). Thus, in this embodiment of system 600, using offset derrick 21' and pipe string 150, control pod exchange device 210 delivers replacement pod 30" to BOP stack 11, automates the exchange of pods 30', 30" (i.e., removes pod 30' from stack 11 and installs pod 30" in stack 11), and delivers pod 30' to the surface 17. Connection members 290, guides 295, and ropes 290 facilitate the alignment of device 210 relative to BOP stack 11, the coupling of device 210 to BOP stack 11 such that pods 30', 30" can be exchanged, and the movement of device 210 to and away from BOP stack 11. One or more subsea remotely operated vehicles 40 as previously described are used, to varying degrees, to assist in the retrieval of pod 30' and deployment of pod 30".

Referring still to FIGS. 9A-9J, an embodiment of a method for replacing control pod 30' with control pod 30" using system 600 will be described. In FIGS. 9A-9D, control pod 30" is shown being deployed subsea and moved to BOP stack 11; in FIGS. 9E and 9F, control pod 30' is shown being removed from BOP stack 11 and transferred to exchange device 210 while control pod 30" is transferred from exchange device 210 to BOP stack 11 and installed on BOP stack 11; and in FIGS. 9G-9J, control pod 30' is shown being retrieved to the surface 17 and vessel 20.

Figure 9A:
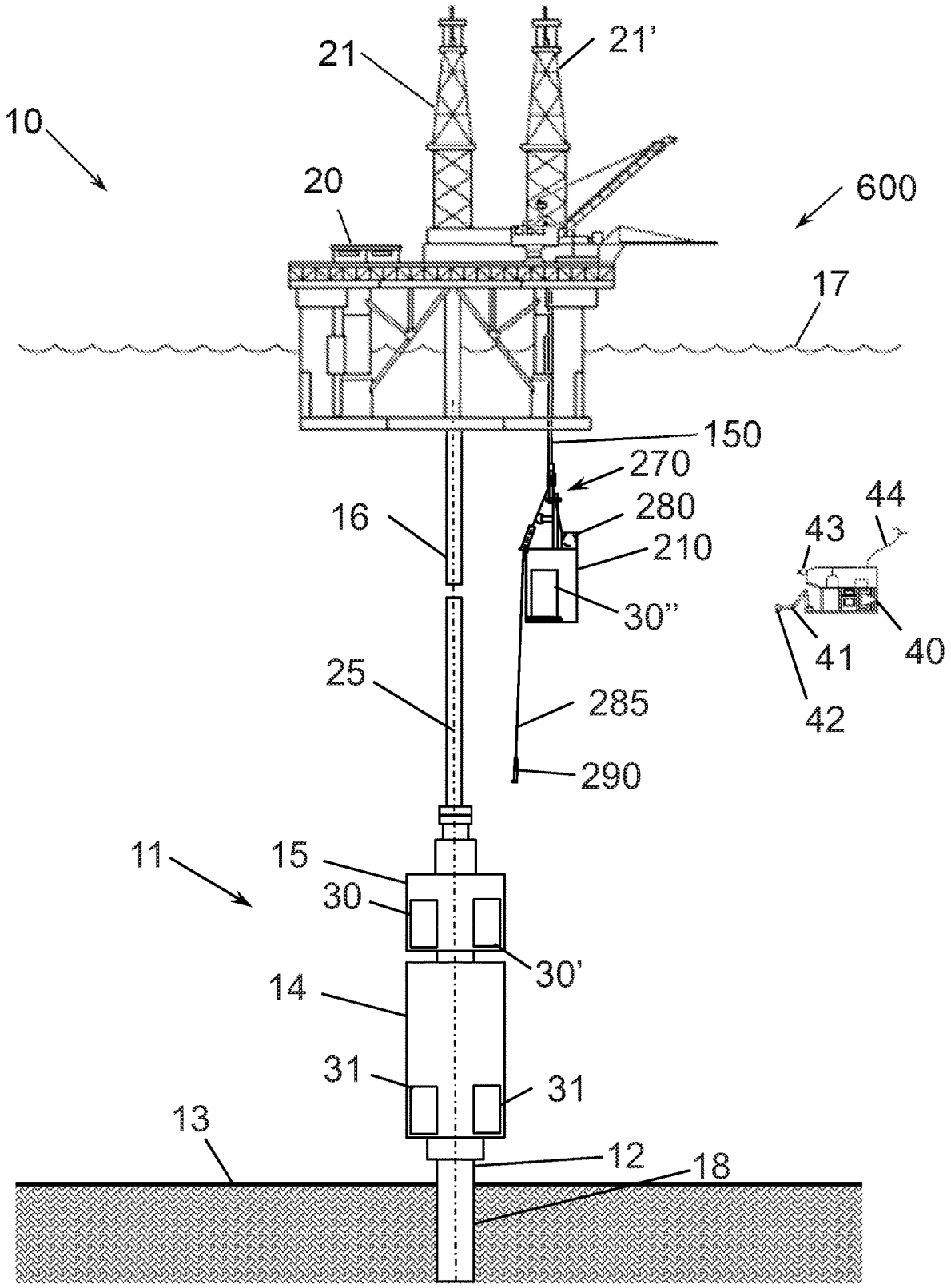
FIGS. 9A-9J are schematic views of an embodiment of a system and associated method in accordance with the principles described herein for replacing a control pod of the offshore system of FIG. 1.

Referring first to FIG. 9A, control pod 30" is disposed within exchange device 210 on vessel 20. In particular, pod 30" is positioned on one of the supports 232*a*, 232*b* within housing 211, and the lower end of pipe string 150 is coupled to connector 213 on vessel 20. The support 232*a*, 232*b* on which pod 30" is disposed is preferably aligned with middle bay 212*b* to balance the weight of device 210 with pod 30" therein. In addition, connection assembly 270 is pivotally coupled to housing connector 261, and hence exchange device 210, with pin 262. Next, derrick 21' lowers exchange device 210 (carrying pod 30") subsea via pipe string 150 and connection assembly 270. As shown in FIG. 9A, ropes 285 are paid out from winch 280 at the surface 17 such that stack connection members 290 hang from exchange device 210.

Figure 9B:
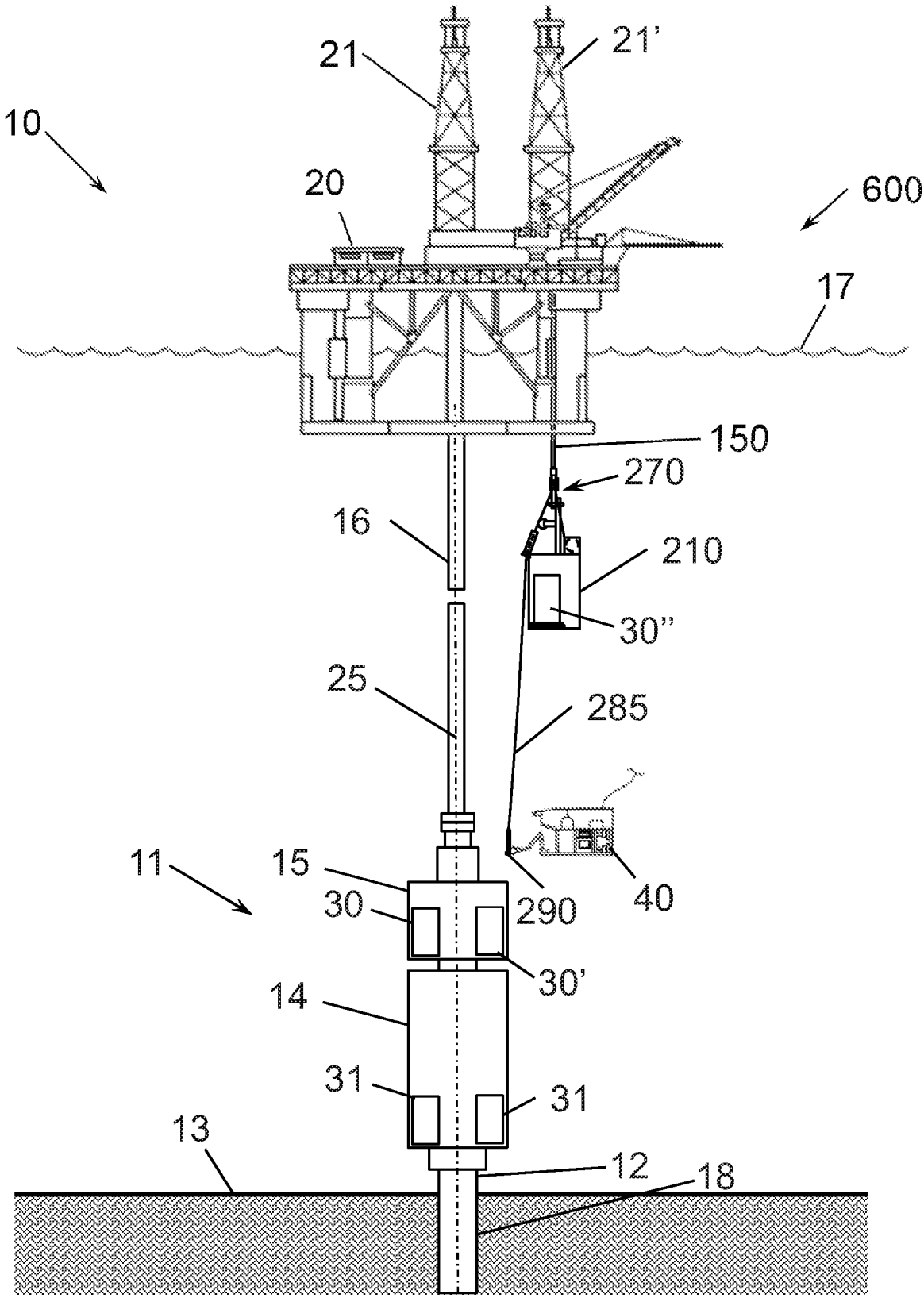

Moving now to FIG. 9B, ropes 285 are paid out from winch 280 at the surface 17 such that connection members 290 are lowered to a depth equal to or greater than the depth of control pod 30' as exchange device 210 is lowered subsea with derrick 21' and pipe string 150. Next, stack connection members 290 are attached to BOP stack 11 with ROV 40. Feet 291 are sized, shaped, and positioned to mate and engage with BOP stack 11, while simultaneously aligning bay 212*b* with pod 30' when received by guides 295 upon arrival of exchange device 210.

Figure 9C:
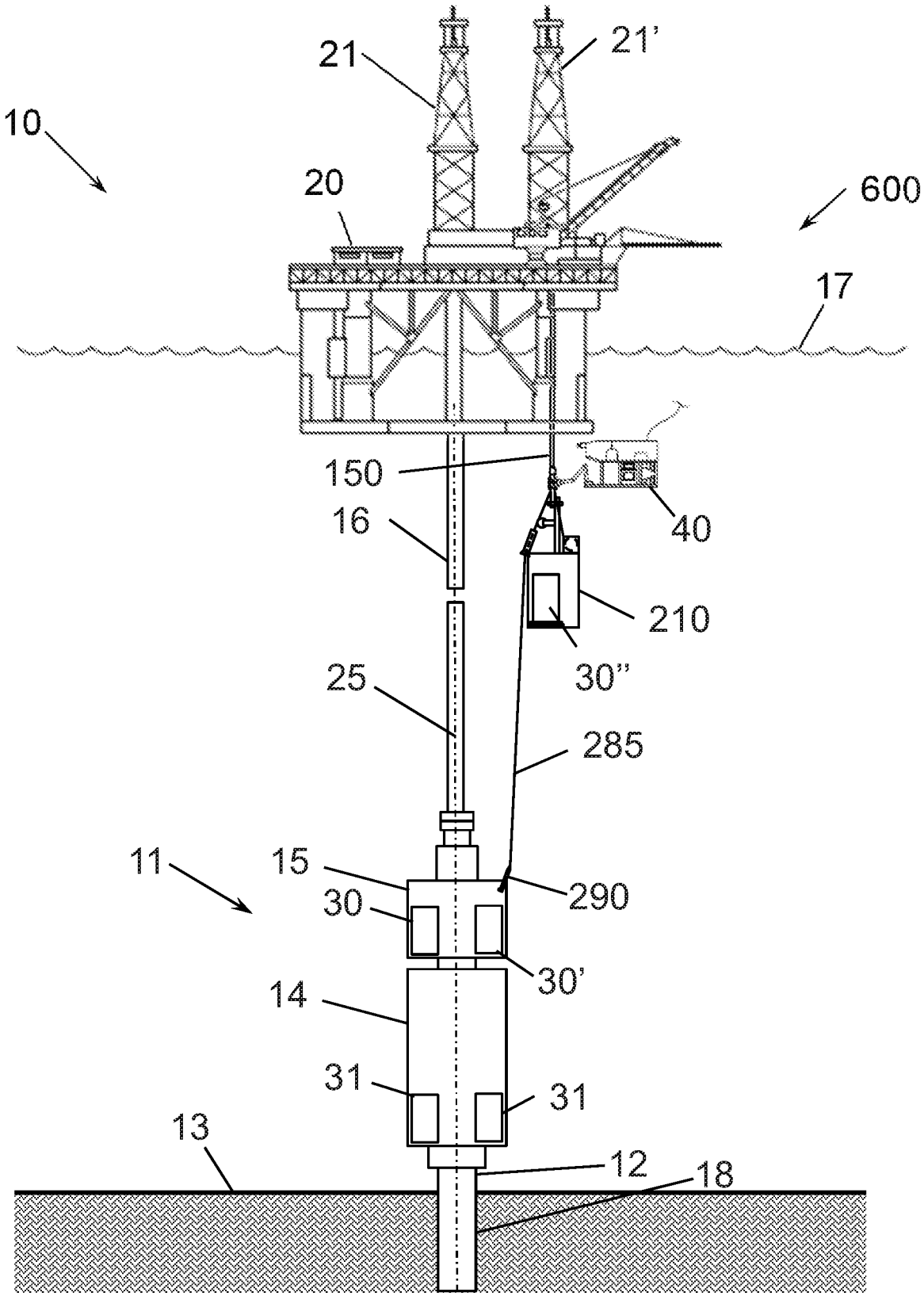

Referring now to FIG. 9C, once stack connection members 290 are secured to BOP stack 11, derrick 21' applies a lifting force to pipe string 150 to pull any slack from ropes 285 and place ropes 285 in tension. Next, ROV 40 pulls pin 262 from base member 271 and housing connector 261, thereby decoupling exchange device 210 from connection assembly 270 so that exchange device 210 can be lowered to BOP stack 11. To enable ROV 40 to easily remove pin 262 from the throughbores in member 271 and connector 261, the shear loads acting on pin 262 by member 271 and connector 261 are eliminated as previously described. In particular, the tension in pipe string 150, the tension in ropes 285, and the weight of exchange device 210 can be utilized to control and time the removal of pin 262 with ROV 40. Namely, once stack connection members 290 is secured to BOP stack 11, derrick 21' is operated to lift pipe string 150 until the tension pipe string 150 (measured at derrick 21') is twice the weight of exchange device 210, at which point—pin 262 is no longer in shear and ROV 40 can remove pin 262.

Figure 9D:
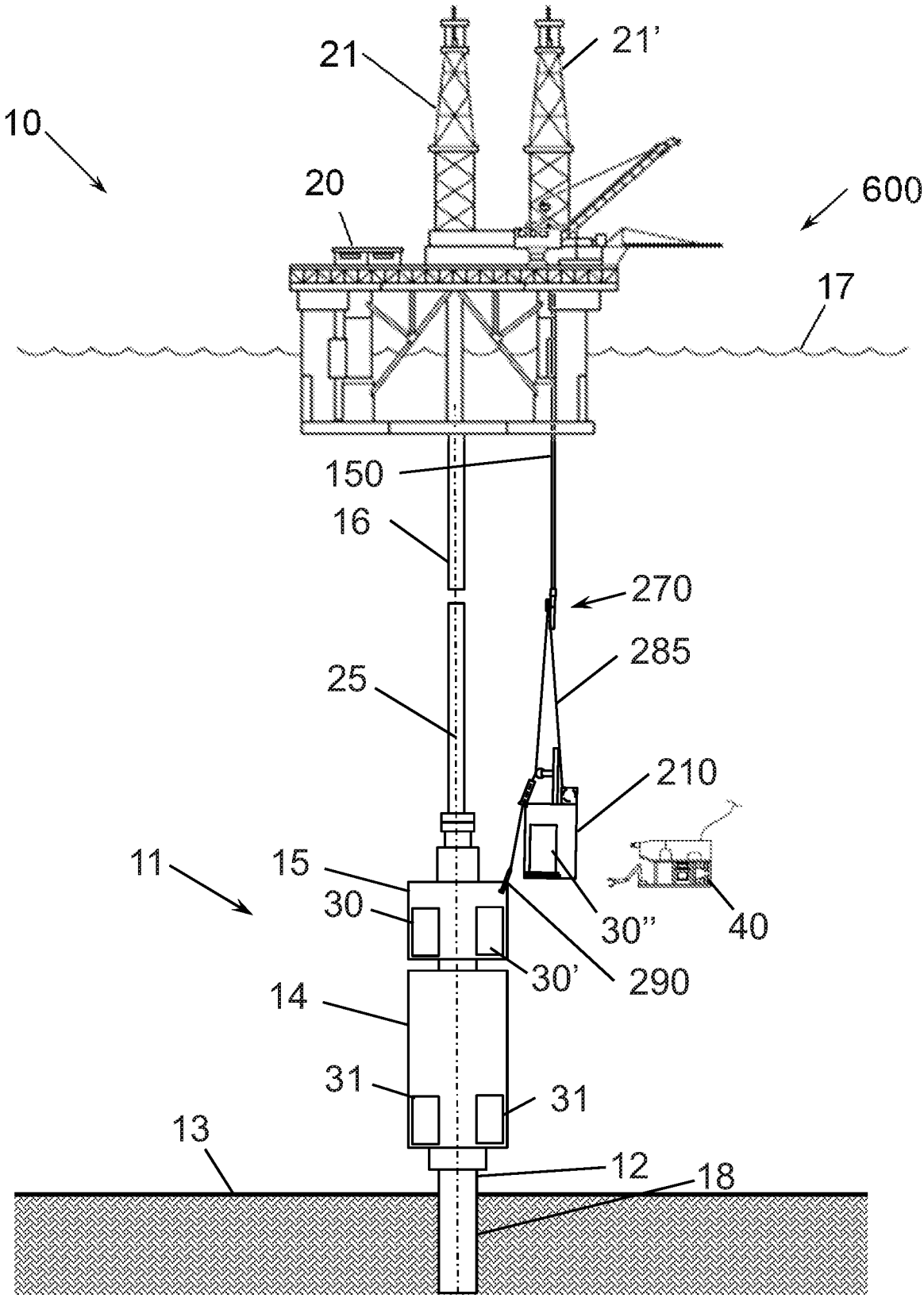
Figure 9E:
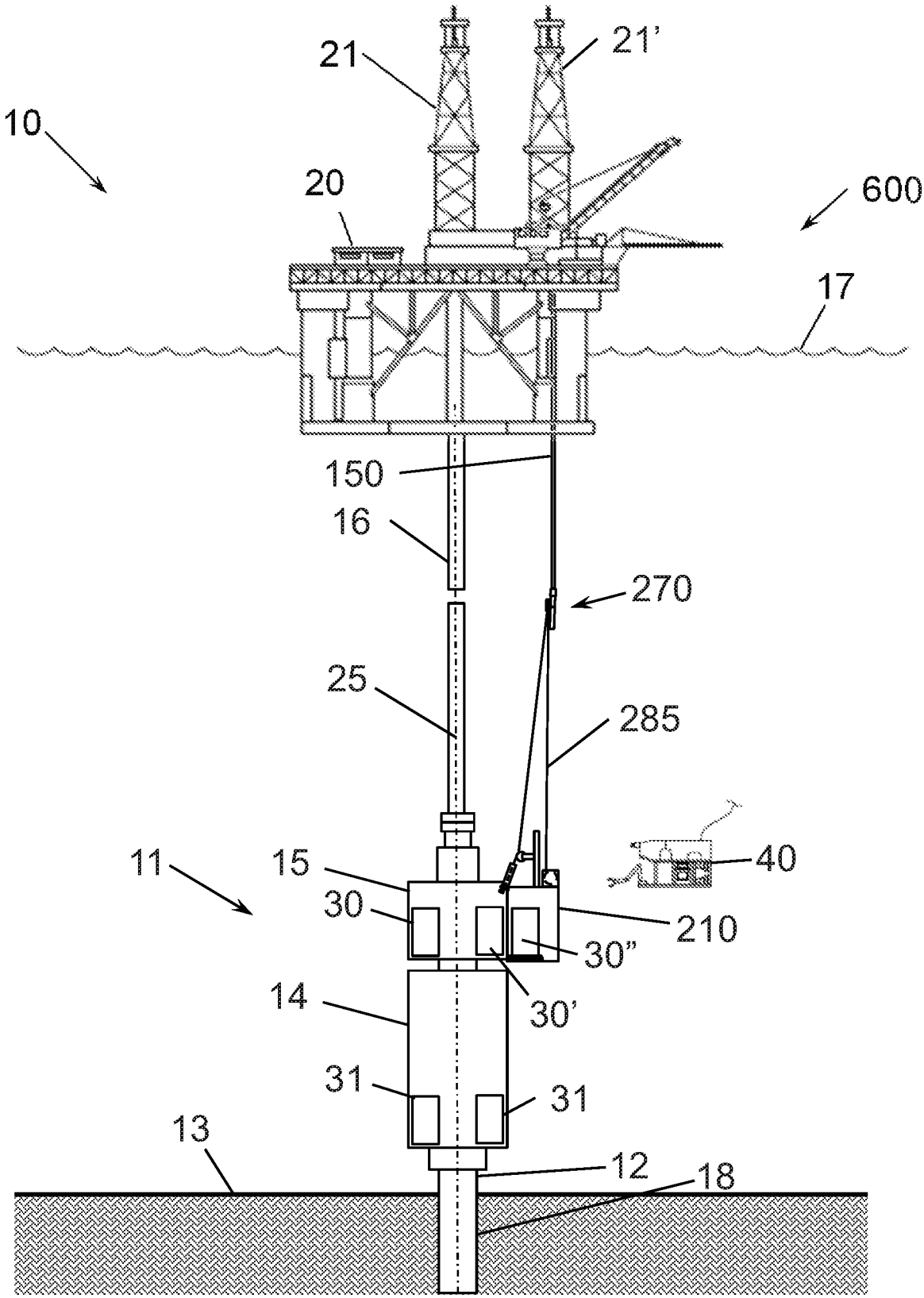

Moving now to FIGS. 9D and 9E, upon removal of pin 262, exchange device 210 is decoupled from connection assembly 270 and is lowered by lowering pipe string 150 with derrick 21'. As pipe string 150 is lowered, ropes 285 move around sheaves 273 as exchange device 210 slides along ropes 285 extending through guides 295 towards connection members 290 and BOP stack 11. As exchange device 210 approaches BOP stack 11, connection members 290 are slidingly received into guides 295, thereby aligning exchange device 210 in the desired positon relative to BOP stack 11 (i.e., with bay 212*b* aligned with and adjacent to control pod 30').

As previously described, in this embodiment, pin 262 is removed by ROV 40 once the shear loads acting on pin 262 are sufficiently reduced and/or eliminated. However, in other embodiments, the pin (e.g., pin 262) may be biased out of the corresponding throughbores (e.g., spring loaded) such that the pin automatically moves out of the aligned throughbores once the the shear loads acting on pin 262 are sufficiently reduced and/or eliminated.

Figure 9F:
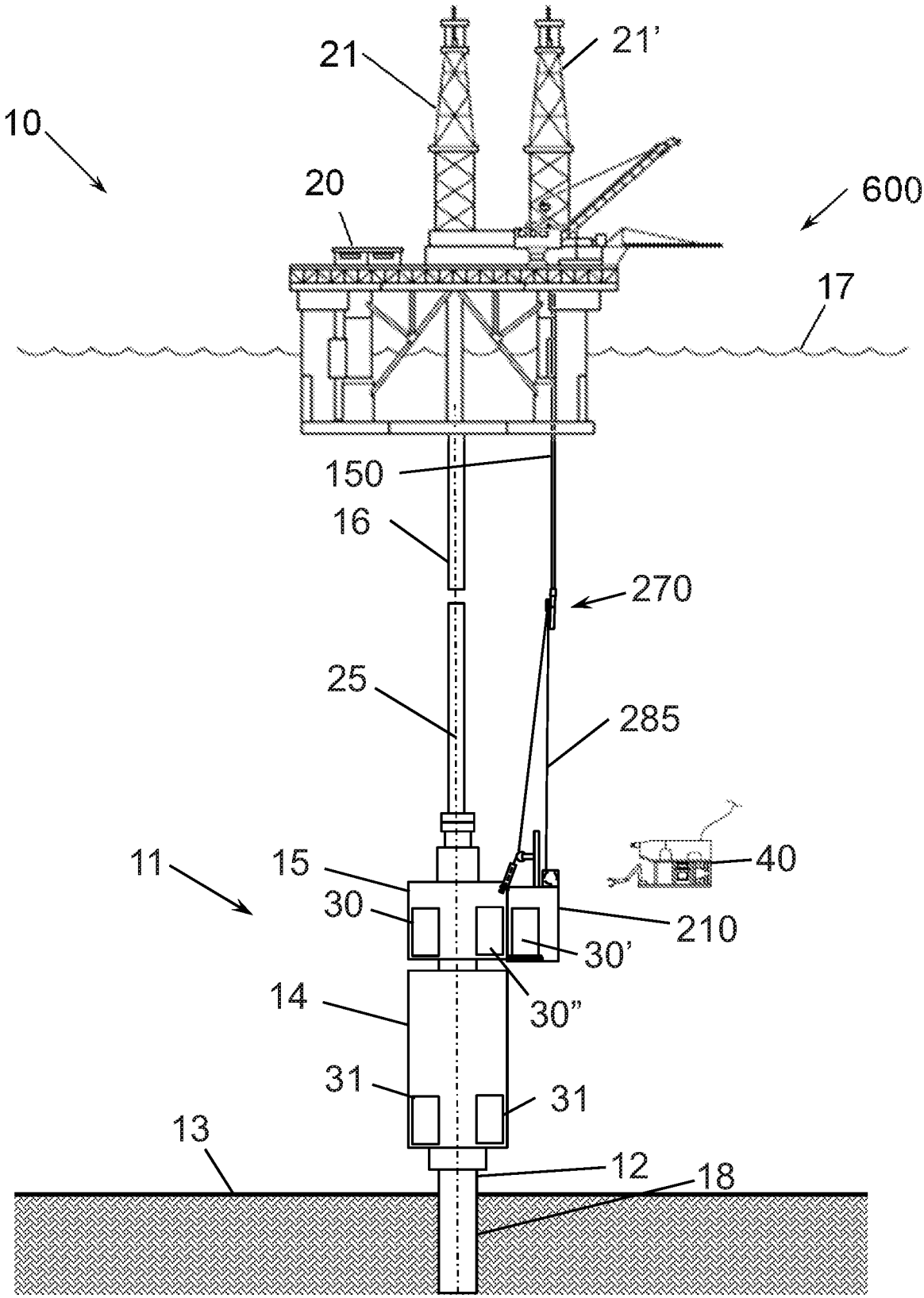

As shown in FIGS. 9E and 9F, with device 210 coupled to BOP stack 11 with middle bay 212*b* aligned with and adjacent the control pod 30', pod 30' is removed from BOP stack 11 and then pod 30" is installed in BOP stack 11 (i.e., pod 30' is replaced with pod 30"). In this embodiment, exchange device 210 replaces pod 30' with pod 30" in the same manner as previously described and shown in FIGS. 3D-3K.

Figure 9G:
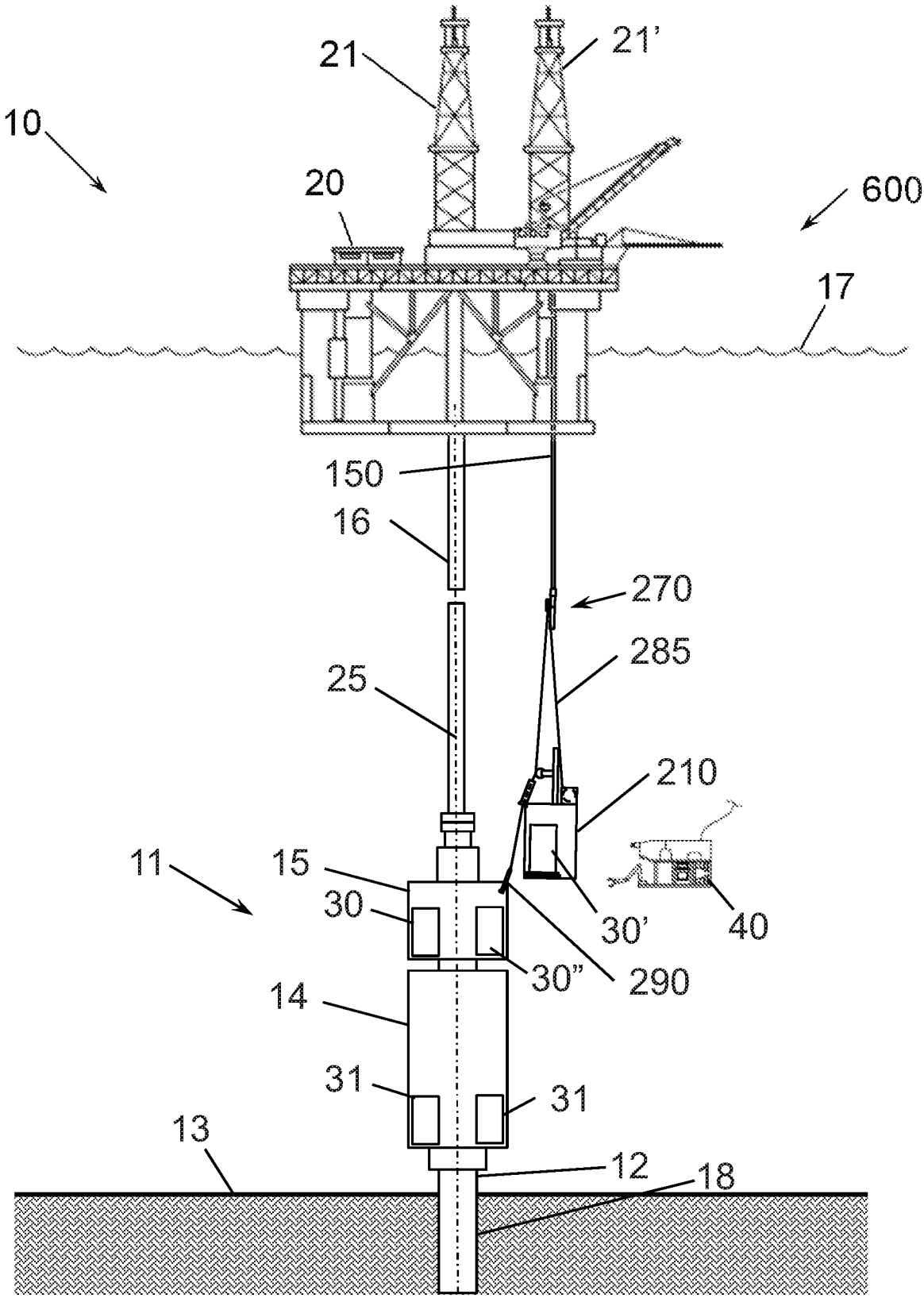
Figure 9H:
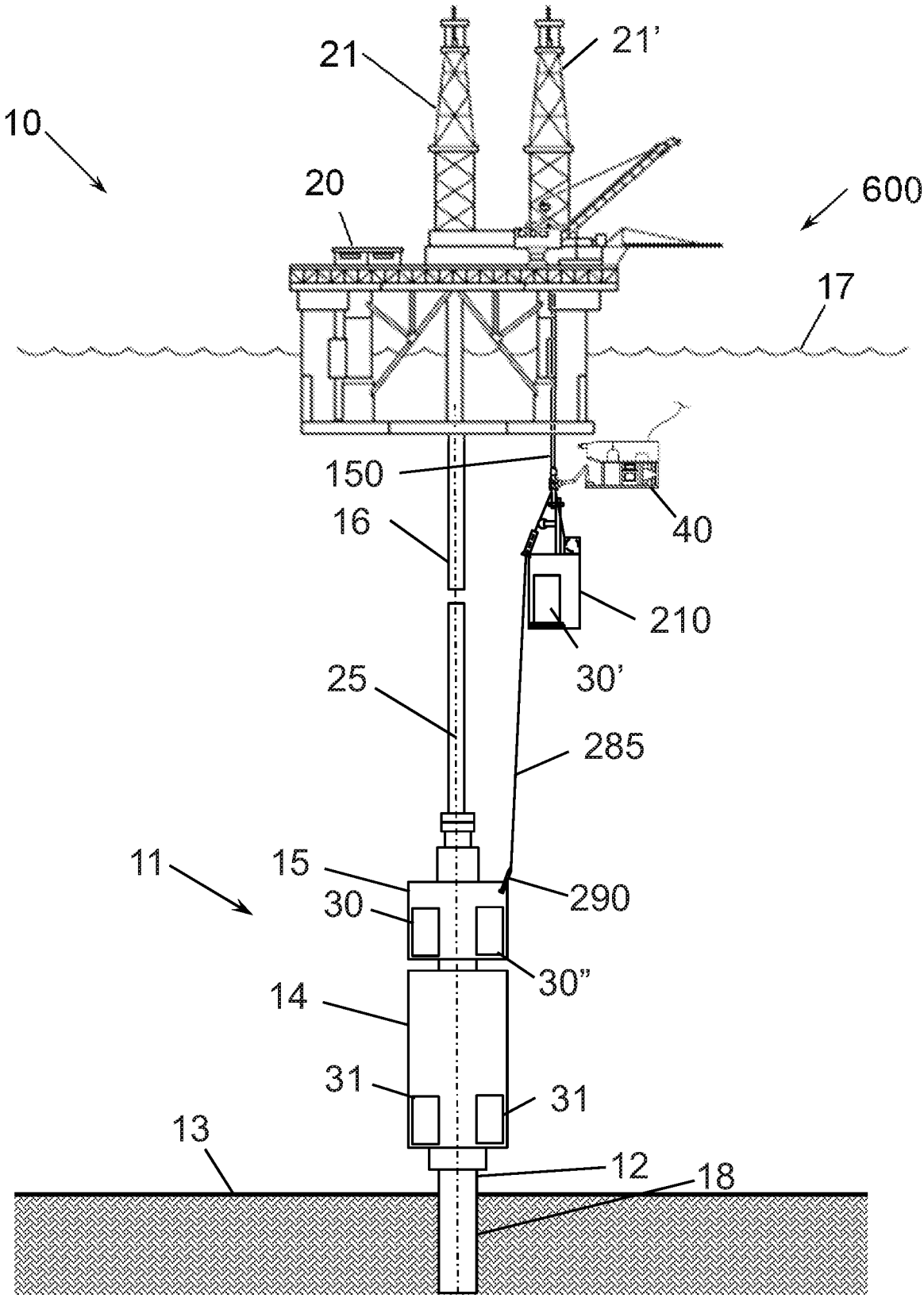

Referring now to FIGS. 9F-9H, after swapping pods 30', 30", exchange device 210 is lifted from BOP stack 11. In particular, derrick 21' is operated to lift pipe string 150, thereby pulling exchange device 210 upward toward the surface 17 and connection assembly 270. As pipe string 150 is lifted, ropes 285 move around sheaves 273 as exchange device 210 slides along ropes 285 extending through guides 295 away from stack connection members 290 and BOP stack 11. As shown in FIG. 9H, upon arrival at connection assembly 270, the throughbores in member 271 and connector 261 are aligned and ROV 40 inserts pin 262 therethrough, thereby pivotally coupling exchange device 210 and connection assembly 270.

Figure 9I:
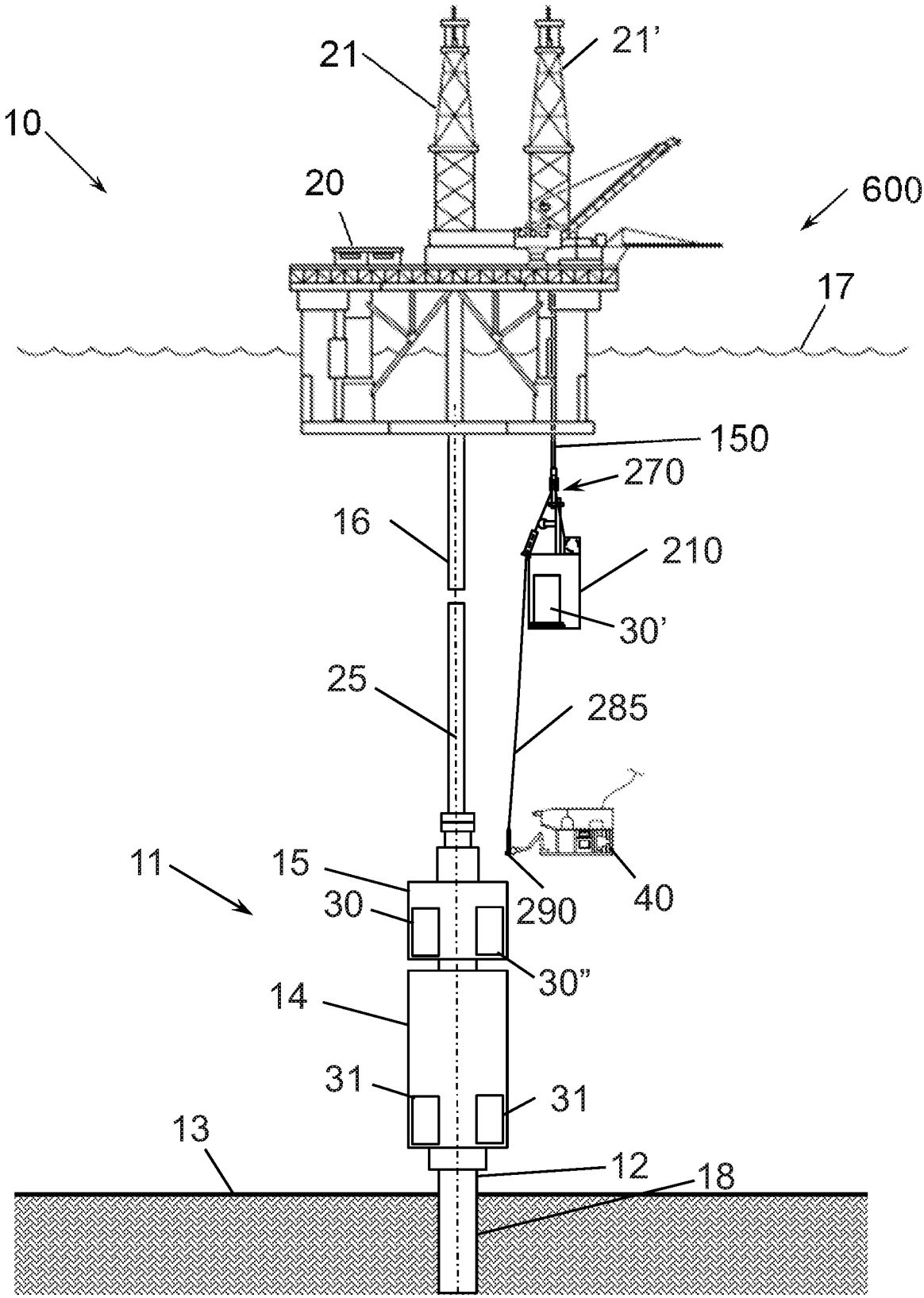
Figure 9J:
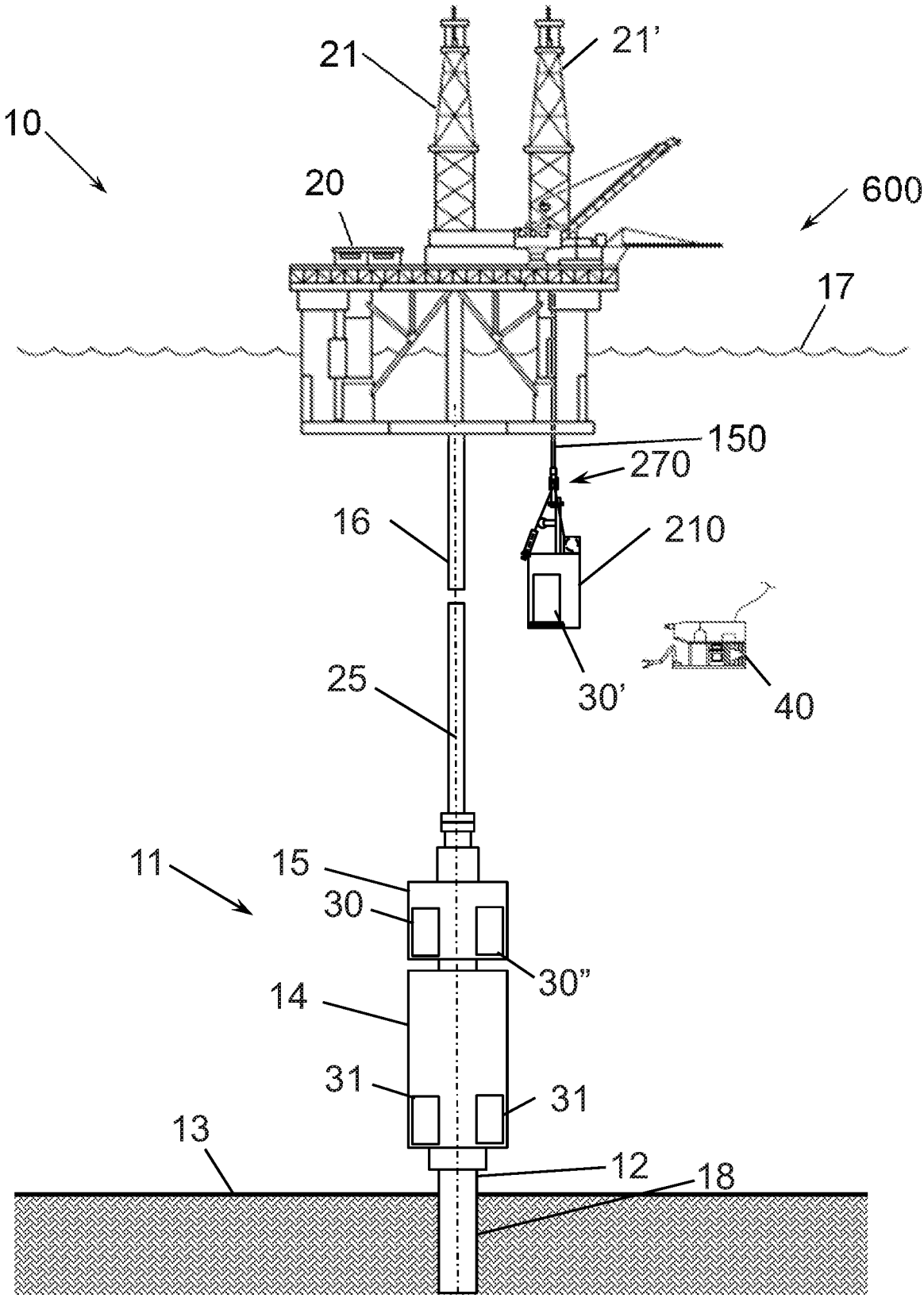

Moving now to FIGS. 9H-9J, after coupling exchange device 210 and connection assembly 270, the weight of exchange device 210 is supported by pipe string 150 while derrick 21' is operated to lower pipe string 150, thereby removing any tension in ropes 285. Next, ROV 40 decouples stack connection members 290 from BOP stack 11. At this point, winch 280 can be operated to pay in ropes 285 and pull stack connection members 290 upward to exchange device 210, or alternatively, ropes 285 can be left hanging while exchange device 210. Derrick 21' can then be used to lift exchange device 210 (carrying pod 30') to vessel 20 via pipe string 150 and connection assembly 270.

In the manner described and shown in FIGS. 9A-9J, system 600 can be used to deploy control pod 30", exchange or swap control pods 30', 30" at BOP stack 11, and retrieve control pod 30' to the surface 17 in a single subsea trip. During deployment of pod 30" and retrieval of pod 30', derrick 21' raises and lowers pipe string 150 to move exchange device 210 to and from BOP stack 11. Thus, in this embodiment, control over the deployment and retrieval of exchange device 210 is primarily controlled from the surface with derrick 21'. For example, winch 280 need not be operated to lower and raise exchange device 210 to and from, respectively, BOP stack 11. In addition, ROV 40 can be used to guide and/or monitor exchange device 210 (and pod 30', pod 30" disposed thereon) as it is lifted, lowered, or otherwise moved subsea. However, it should be appreciated that during deployment of pod 30", exchanging of pods 30', 30" at BOP stack 11, and retrieval of pod 30', the weight of exchange device 210 (and any pod 30', 30" thereon) is supported by pipe string 150 and/or ropes 285, thereby reducing the payload lifting requirements for ROV 40.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method for replacing a first control pod of a BOP stack, the method comprising:
(a) lowering a control pod exchange device subsea with a second control pod positioned on the control pod exchange device;
(b) coupling the control pod exchange device to the BOP stack;
(c) transferring the first control pod from the BOP stack into a first bay of the control pod exchange device and then transferring the second control pod from a second bay of the control pod exchange device to the BOP stack to replace the first control pod with the second control pod while the control pod exchange device is coupled to the BOP stack;
(d) decoupling the control pod exchange device from the BOP stack after (c); and
(f) lifting the control pod exchange device and the first control pod disposed thereon to the surface after (c) and (d).

2. The method of claim 1, further comprising:
(g) repairing the first control pod at the surface after (f);
(h) loading the repaired first control pod onto the control pod exchange device after (g);
lowering the control pod exchange device and the repaired first control pod disposed thereon subsea after (h);
(j) coupling the control pod exchange device to the BOP stack after (i); and
(k) transferring the second control pod from the BOP stack to the control pod exchange device and transferring the repaired first control pod from the control pod exchange device to the BOP stack while the control pod exchange device is couple to the BOP stack after (j).

3. The method of claim 1, further comprising:
loading the second control pod onto the control pod exchange device at the surface before (a).

4. The method of claim 1, wherein (b) comprises coupling a first rope extending from the control pod exchange device to the BOP stack.

5. The method of claim 4, further comprising operating a winch to pay in the first rope and pull the control pod exchange device to the BOP stack, wherein the winch is attached to the control pod exchange device.

6. The method of claim 5, wherein the first rope extends over a sheave coupled to a second rope extending from a lifting device mounted to a surface vessel or a pipe string extending from a derrick mounted to the surface vessel.

7. The method of claim 4, wherein the first rope has a first end coupled to the BOP stack and a second end coupled to the control pod exchange device.

8. The method of claim 1, further comprising:
lowering the second control pod subsea with a first rope extending from a lifting device mounted to a surface vessel, wherein the first rope has a lower end coupled to a connection assembly that is releasably connected to the control pod exchange device;
monitoring a first tension in the rope;
applying a second tension to a second rope having a first end coupled to the control pod exchange device and a second end coupled to the BOP stack;
increasing the first tension until the monitored first tension reaches a predetermined amount;
disconnecting the control pod exchange device from the connection assembly such that the control pod exchange device can move relative to the first rope and the connection assembly when the monitored first tension reaches the predetermined amount.

9. The method of claim 8, wherein the control pod exchange device has a weight, and wherein predetermined amount is equal to about twice the weight of the control pod exchange device.

10. The method of claim 1, further comprising:
lowering the control pod subsea with a pipe string extending from a derrick mounted to a surface vessel, wherein the pipe string has a lower end coupled to a connection assembly that is releasably connected to the control pod exchange device;

monitoring a first tension in the pipe string;

applying a second tension to a rope having a first end coupled to the control pod exchange device and a second end coupled to the BOP stack;

increasing the first tension until the monitored first tension reaches a predetermined amount;

disconnecting the control pod exchange device from the connection assembly such that the control pod exchange device can move relative to the pipe string and the connection assembly when the monitored first tension reaches the predetermined amount.

11. A system for replacing a first control pod coupled to a subsea BOP stack with a second control pod, the system comprising:

a lifting device coupled to a surface vessel;

a control pod exchange device suspended from the lifting device and configured to be raised and lowered subsea by the lifting device, wherein the control pod exchange device comprises:

a housing;

a plurality of laterally adjacent bays disposed within the housing, wherein each bay is sized to accommodate the first control pod or the second control pod; and a control pod transfer assembly moveably disposed in the housing, wherein the control pod transfer assembly is configured to move the first control pod and the second control pod within the housing between at least two of the plurality of laterally adjacent bays;

a BOP stack connection assembly coupled to the control pod exchange device, wherein the BOP stack connection assembly is configured to couple the control pod exchange device to the BOP stack.

12. The system of claim 11, wherein the BOP stack connection assembly comprises a pair of arms extending from the housing and configured to mate and engage with the BOP stack.

13. The system of claim 11, wherein the BOP stack connection assembly comprises a winch coupled to the housing and a rope configured to be paid out and paid in to the winch, wherein the rope has a free end configured to be coupled to the BOP stack.

14. The system of claim 11, wherein the control pod exchange device is suspended from a first rope extending from the lifting device;

wherein the BOP stack connection assembly comprises a sheave coupled to a free end of the first rope and a second rope extending over the sheave, wherein the second rope has a first end coupled to the housing and a second end configured to be coupled to the BOP stack.

15. The system of claim 14, further comprising a guide member coupled to the housing, wherein the second rope is slidingly disposed in a passage extending through the guide member.

16. The system of claim 11, wherein the control pod exchange device is suspended from a pipe string extending from the lifting device;

wherein the BOP stack connection assembly comprises a sheave coupled to a free end of the pipe string and a rope extending over the sheave, wherein the rope has a first end coupled to the housing and a second end configured to be coupled to the BOP stack.

17. The system of claim 16, further comprising a guide member coupled to the housing, wherein the rope is slidingly disposed in a passage extending through the guide member.

18. The system of claim 11, wherein the BOP stack connection assembly comprises:

a connection assembly attached to a pipe string extending from the lifting device or a first rope extending from the lifting device, wherein the connection assembly is pivotally coupled to the control pod exchange device;

a winch coupled to the housing;

a BOP stack connector moveably coupled to the housing, wherein the BOP stack connector is configured to be secured to the BOP stack;

a second rope configured to be paid in and paid out from the winch, wherein the rope extends over a sheave of the connection assembly and has an end coupled to the BOP stack connector.

19. The system of claim 18, further comprising a housing connector extending from the housing;

wherein the connection assembly is pivotally coupled to the control pod exchange device with a pin extending through a bore in the housing connector and a bore in the connection assembly.

20. The system of claim 11, wherein the plurality of bays comprise a first bay, a second bay, and a third bay, wherein the second bay is disposed between the first bay and the third bay;

wherein the control pod transfer assembly is configured to move the second control pod from the first bay to the second bay and move the first control pod from the first bay to third bay.

21. The system of claim 20, wherein the control pod transfer assembly is configured to move the first control pod from the BOP stack to the second bay and move the second control pod from the second bay to the BOP stack.

22. A method for replacing a first control pod of a BOP stack, the method comprising:

(a) loading a second control pod onto a control pod exchange device;

(b) lowering the control pod exchange device subsea after (a) with a lifting device mounted to a surface vessel, wherein the control pod exchange device is suspended from the lifting device with a first rope or a pipe string;

(c) coupling a BOP stack connector to the BOP stack after (b), wherein a second rope has a first end coupled to the control pod exchange device and a second end coupled to the BOP stack connector; and (d) lowering the first rope or the pipe string to allow the control pod exchange device to be lowered along the second rope, and relative to the first rope or the pipe string, to the BOP stack connector after (c).

23. The method of claim 22, further comprising:

monitoring a tension in the first rope or the pipe string before (d);

increasing the measured tension in the first rope or the pipe string with the lifting device until the tension reaches a predetermined amount before (d);

disconnecting the control pod exchange device from a connection assembly coupled to a lower end of the first rope or the pipe string such that the control pod exchange device can move relative to the first rope or the pipe string when the monitored tension reaches the predetermined amount.

24. The method of claim 23, wherein the control pod exchange device has a weight, and wherein the predetermined amount is equal to about twice the weight of the control pod exchange device.

25. The method of claim 22, further comprising:

(f) moving the first control pod from the BOP stack to the control pod exchange device;

(g) moving the second control pod from the control pod exchange device to the BOP stack after (f);

(h) raising the control pod exchange device to the surface after (f) and (g).

* * * * *